US008402900B2

(12) United States Patent
Burak et al.

(10) Patent No.: US 8,402,900 B2
(45) Date of Patent: Mar. 26, 2013

(54) INTERACTIVE WORKSTATION

(75) Inventors: Edward John Burak, Paraparaumu (NZ); Christopher Warren Bisman, Wellington (NZ); Paul Michael Wilkinson, Wellington (NZ); Mark Rundle Pennington, Wellington (NZ); Ian Colin Footitt, Upper Hutt (NZ)

(73) Assignee: Formway Furniture Limited, Lower Hut (NZ)

( * ) Notice: Subject to any disclaimer, the term of this patent is extended or adjusted under 35 U.S.C. 154(b) by 441 days.

(21) Appl. No.: 12/444,372

(22) PCT Filed: Oct. 8, 2007

(86) PCT No.: PCT/NZ2007/000296

§ 371 (c)(1),
(2), (4) Date: Nov. 24, 2009

(87) PCT Pub. No.: WO2008/041873

PCT Pub. Date: Apr. 10, 2008

(65) Prior Publication Data

US 2010/0126394 A1 May 27, 2010

Related U.S. Application Data

(60) Provisional application No. 60/828,591, filed on Oct. 6, 2006, provisional application No. 60/894,421, filed on Mar. 12, 2007.

(51) Int. Cl.
*A47B 37/00* (2006.01)

(52) U.S. Cl. ..... 108/50.01; 108/64

(58) Field of Classification Search ..... 108/64, 108/50.01, 50.02, 144.11, 147.11; 248/188.2, 248/188.4, 188.5, 188.8; 312/223.3, 257.1, 312/159, 259

See application file for complete search history.

(56) References Cited

U.S. PATENT DOCUMENTS

| | | | | |
|---|---|---|---|---|
| D48,320 | S | 12/1915 | Hodge | |
| D144,045 | S | 3/1946 | Fletcher | |
| 3,181,484 | A * | 5/1965 | Keppler | 108/50.02 |
| D218,176 | S | 7/1970 | Des Marais et al. | |
| 3,688,419 | A | 9/1972 | Woolman | |
| 3,858,528 | A | 1/1975 | Petersen | |
| 3,869,992 | A | 3/1975 | Kramer | |
| 4,365,561 | A | 12/1982 | Tellier et al. | |
| 4,604,955 | A | 8/1986 | Fleischer et al. | |
| 4,646,655 | A * | 3/1987 | Robolin | 108/64 |
| 4,679,510 | A * | 7/1987 | Veyhl et al. | 108/64 |
| 4,838,177 | A | 6/1989 | Vander Park | |
| 4,840,023 | A | 6/1989 | Borsani | |
| 4,879,955 | A | 11/1989 | Moll et al. | |

(Continued)

FOREIGN PATENT DOCUMENTS

| | | |
|---|---|---|
| DE | 3 744 703 | 1/1989 |
| DE | 3 911 017 | 10/1990 |

(Continued)

OTHER PUBLICATIONS

*Nomos design: Foster Associates*, Tecno spa Milano, published by at least as early as Oct. 1, 2006.

*Primary Examiner* — Jose V Chen
(74) *Attorney, Agent, or Firm* — Workman Nydegger

(57) ABSTRACT

A workstation system (1) comprising with a plurality of desktops e.g. (3*a*), each desktop (3*a*) comprising a primary work area (33) and at least one recessed portion e.g. (34*b*) providing an auxiliary work area e.g. (36*b*). The recessed portions (34*b*) of adjacent desktops (3*a*-3*d*) can be arranged to provide an interactive work area (6*a*-6*d*) for multiple people.

20 Claims, 59 Drawing Sheets

U.S. PATENT DOCUMENTS

| | | | | | |
|---|---|---|---|---|---|
| D305,706 | S | | 1/1990 | Mark | |
| D306,101 | S | | 2/1990 | Borsani | |
| 4,936,228 | A | | 6/1990 | Capo-Bianco | |
| 4,966,341 | A | | 10/1990 | Borsani | |
| 4,974,915 | A | | 12/1990 | Bussard | |
| 5,016,405 | A | | 5/1991 | Lee | |
| D320,129 | S | | 9/1991 | Perrego et al. | |
| 5,078,055 | A | | 1/1992 | Bellini et al. | |
| 5,103,741 | A | | 4/1992 | Grund et al. | |
| D331,672 | S | | 12/1992 | Brodbeck | |
| D332,189 | S | | 1/1993 | Brodbeck | |
| 5,224,429 | A | | 7/1993 | Borgman et al. | |
| 5,237,935 | A | | 8/1993 | Newhouse et al. | |
| D341,272 | S | | 11/1993 | Pesso | |
| D341,507 | S | | 11/1993 | Harvey et al. | |
| 5,259,326 | A | | 11/1993 | Borgman et al. | |
| 5,265,952 | A | * | 11/1993 | Greshem et al. | 108/50.01 |
| 5,323,695 | A | | 6/1994 | Borgman et al. | |
| 5,352,033 | A | | 10/1994 | Gresham et al. | |
| D359,631 | S | | 6/1995 | Bubb | |
| D359,640 | S | | 6/1995 | Newhouse et al. | |
| 5,435,254 | A | | 7/1995 | Amey et al. | |
| 5,438,937 | A | | 8/1995 | Ball et al. | |
| 5,473,994 | A | | 12/1995 | Foley et al. | |
| 5,522,323 | A | | 6/1996 | Richard | |
| 5,522,324 | A | * | 6/1996 | van Gelder et al. | 108/50.02 |
| 5,546,873 | A | | 8/1996 | Conner et al. | |
| D381,222 | S | | 7/1997 | O'Sullivan et al. | |
| 5,655,822 | A | | 8/1997 | Roberts et al. | |
| D389,680 | S | | 1/1998 | Moore | |
| 5,704,298 | A | | 1/1998 | Corpuz, Jr. et al. | |
| 5,743,193 | A | | 4/1998 | Kakuta et al. | |
| D394,569 | S | * | 5/1998 | O'Malley | D6/511 |
| 5,752,449 | A | * | 5/1998 | Simon et al. | 108/50.02 |
| 5,765,315 | A | * | 6/1998 | Nagamitsu et al. | 108/64 |
| D401,776 | S | | 12/1998 | Weng | |
| 5,848,497 | A | | 12/1998 | Henderson | |
| D412,625 | S | | 8/1999 | Montague, III et al. | |
| 5,931,103 | A | * | 8/1999 | Huang | 108/50.02 |
| 5,943,966 | A | * | 8/1999 | Machado et al. | 108/64 |
| 5,974,985 | A | * | 11/1999 | Flototto et al. | 108/157.18 |
| D430,763 | S | | 9/2000 | Scheffer | |
| 6,161,487 | A | * | 12/2000 | Chang | 108/50.01 |
| 6,170,410 | B1 | | 1/2001 | Gioacchini et al. | |
| 6,202,567 | B1 | | 3/2001 | Funk et al. | |
| D440,798 | S | | 4/2001 | Kuhlman et al. | |
| 6,267,064 | B1 | * | 7/2001 | Ostertag et al. | 108/50.02 |
| 6,283,043 | B1 | * | 9/2001 | Stern et al. | 108/50.02 |
| D455,911 | S | | 4/2002 | Rogers et al. | |
| 6,427,608 | B1 | | 8/2002 | Crinion | |
| 6,725,784 | B2 | | 4/2004 | Crinion | |
| 6,739,560 | B1 | * | 5/2004 | Pajerski | 248/188.5 |
| 6,792,876 | B2 | | 9/2004 | Lin | |
| D512,851 | S | | 12/2005 | Chang | |
| 6,990,909 | B2 | | 1/2006 | Gosling et al. | |
| 7,036,438 | B2 | | 5/2006 | Okamoto et al. | |
| 7,231,676 | B2 | * | 6/2007 | Cloer et al. | 108/147.19 |
| 7,357,086 | B2 | * | 4/2008 | Petrick et al. | 108/50.02 |
| D573,820 | S | | 7/2008 | Burak | |
| 7,438,002 | B2 | * | 10/2008 | Murray | 108/50.01 |
| 7,765,937 | B2 | * | 8/2010 | Weissenrieder et al. | 108/50.02 |
| 7,934,459 | B2 | * | 5/2011 | Frazier | 108/64 |
| 2001/0003960 | A1 | * | 6/2001 | Lininger et al. | 108/50.01 |
| 2005/0045073 | A1 | | 3/2005 | Wasley | |
| 2008/0178779 | A1 | * | 7/2008 | Agee | 108/147 |

FOREIGN PATENT DOCUMENTS

| | | | |
|---|---|---|---|
| EP | 0 006 707 | A1 | 1/1980 |
| EP | 6 31 744 | | 1/1995 |
| GB | 2 309 164 | | 7/1997 |
| NL | 1 002 354 | C | 8/1997 |
| WO | WO 00-25632 | | 5/2000 |

* cited by examiner

Detail of B

INTERACTIVE WORKSTATION

FIELD OF THE INVENTION

The present invention relates to workstations and workstation systems.

BACKGROUND TO THE INVENTION

Office workers usually carry out their work at a workstation which comprises a desk top for supporting their computer, keyboard and other items and on which they can conduct their work. The desk top is supported by some type of support structure. Often, a number of such workstations are arranged in a modular fashion to provide a number of workstations for people to work in close proximity.

While such workstation systems provide a suitable space for an individual to carry out their tasks, the systems are not conducive to office workers carrying out work interactively or collaboratively. There is no suitable space on the desk tops for co-workers to easily interact. Often, this requires co-workers who wish to work collaboratively to leave their workstations and conduct their interactive work in another space, perhaps at a meeting table.

Is an object of at least preferred embodiments of the present invention to provide a workstation or workstation system to assist with collaboration, or at least to provide the public with a useful choice.

In this specification where reference has been made to patent specifications, other external documents, or other sources of information, this is generally for the purpose of providing a context for discussing the features of the invention. Unless specifically stated otherwise, reference to such external documents or such sources of information is not to be construed as an admission that such documents or such sources of information, in any jurisdiction, are prior art or form part of the common general knowledge in the art.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

SUMMARY OF INVENTION

In one aspect the present invention may be said to consist in a workstation adapted for use in combination with a corresponding workstation, the workstation comprising a desktop with a front edge, and at least one support adapted to support the desktop at a vertical distance above the ground, wherein the shape of the desktop is profiled along the front edge to comprise a first protruding surface providing a primary work area on the desktop, a first recessed portion adjacent a first lateral side of the protruding surface and a second recessed portion adjacent a second lateral side of the protruding surface, wherein each recessed portion is adapted to be arranged adjacent a corresponding recessed portion of a corresponding workstation, such that when arranged adjacent the recessed portion of the workstation and the corresponding recessed portion of the corresponding workstation provide an interactive work area adapted to accommodate at least two people, and wherein the or each support is disposed to provide free space under the primary work area and the recessed portions to accommodate a user's legs under the primary work area and the recessed portions without impediment from the support(s), and to enable a user to readily move between the recessed portions with their legs under the desktop without impediment from the support(s).

Preferably, at least one support is adapted to provide at least some support for one or more further workstations.

Preferably, each recessed portion is adapted to be arranged adjacent a corresponding recessed portion in a side-by-side relationship forming a combined recessed area to provide the interactive work area.

Preferably, at least one support is disposed to provide a space to accommodate a user's legs under the area where a recessed portion abuts a corresponding recessed portion when arranged adjacent a corresponding recessed portion.

Preferably, each recessed portion is adapted to be arranged adjacent a corresponding recessed portion in an opposing relationship to provide the interactive work area.

Preferably, the desktop comprises: a side edge adjacent each recessed portion, a working edge corresponding to each recessed portion forming a section of the front edge, and a back edge comprising at least one substantially straight section, wherein the desktop comprises an auxiliary work surface adjacent each recessed portion bounded by the respective side edge and corresponding working edge and a least a portion of the back edge, wherein each recessed portion is adapted to be arranged adjacent a corresponding recessed portion in an opposing relationship by arranging at least a portion of the back edge of the desktop in an opposing relationship to at least a portion of a back edge of a desktop of the corresponding recessed portion to provide an interactive work area comprising two recessed portions which are separated by respective auxiliary work surfaces.

Preferably, a work top is provided supported above the desktop in the vicinity of a recessed portion to provide an interactive work surface.

Preferably, the protruding surface is profiled as a convex edge forming a section of the front edge of the desktop.

Preferably, each recessed portion is profiled as a concave edge forming a section of the front edge of the desktop.

Preferably, the support is adapted to adjust the vertical distance of the desktop above the ground.

Preferably, the desktop further comprises a back edge comprising two substantially straight sections arranged at an angle of substantially 120 degrees with respect to each other.

Preferably, the desktop further comprises a substantially straight bath edge.

Preferably, the part of each recessed portion that is adapted to be arranged adjacent a corresponding recessed portion of a corresponding workstation, defines the narrowest forward to rearward dimension of the desktop.

Preferably, the desktop comptises a side edge adjacent each recessed portion and a substantially straight back edge, wherein the side edges are substantially parallel to one another.

In another aspect the present invention may be said to consist in a workstation system comprising: at least two workstations, each workstation comprising a desktop with a front edge and a back edge, the shape of the desktop being profiled along the front edge to comprise a first protruding surface providing a primary work area on the desktop, a first recessed portion adjacent a first lateral side of the protruding surface and a second recessed portion adjacent second lateral side of the protruding surface, and at least one support adapted to support the desktops at a vettical distance above the ground, wherein the back edges of the desktops of the two workstations are arranged in an opposing relationship such that the protruding surfaces of the desktops extend in a substantially opposite directions and the recessed portions of one desktop are at least partially aligned with the opposing recessed portions of the other desktop to provide opposing recessed portion pairs, wherein each recessed portion pair provides an interactive work area adapted to accommodate at least two people in a facing relationship, and wherein the or each support is disposed to provide free space under the primary work area and the recessed portions of each desktop to accommodate a user's legs under the primary work area and the recessed portions of the respective desktop without impediment from the support(s), and to enable a user to readily move between the recessed portions of the respective desktop with their legs under the desktop without impediment from the support(s).

In another aspect the present invention may be said to consist in a workstation system comprising: at least two workstations, each workstation comprising a desktop with a ftont edge and a back edge, the shape of the desktop being profiled along the front edge to comprise a first protruding surface providing a primary work area on the desktop, a first recessed portion adjacent a first lateral side of the protruding surface and having a side edge and a second recessed portion adjacent second lateral side of the protruding surface and having a side edge, and at least one support adapted to support the desktops at a vertical distance above the ground, wherein the workstations are arranged such that the side edge of one recessed portion of a first of the workstations is adjacent the side edge of a corresponding recessed portion of a second of the workstations to provide an adjacent recessed portion pair, such that the respective recessed portions provide an interactive work area adapted to accommodate at least two people in a side-by-side relationship, and wherein the or each support is disposed to provide free space under the primary work area and the recessed portions of each desktop to accommodate a user's legs under the primary work area arid the recessed portions of the respective desktop without impediment from the support(s), and to enable a user to readily move between the recessed portions of the respective desktop with their legs under the desktop without impediment from the support(s).

Preferably, there is at least partial visibility between each recessed portion of a recessed portion pair.

Preferably, between each recess is substantially free of objects that impede interactive work.

Preferably, each desktop comprises: a side edge adjacent each recessed portion, and a working edge for each recessed portion forming a section of the front edge, wherein the desktop also comprises an auxiliary work surface adjacent each recessed portion bounded by the respective side edge and corresponding working edge and a least a portion of the back edge, and wherein each opposing recessed portion pair provides an interactive work area comprising two recessed portions that are separated by respective auxiliary work surfaces.

Preferably, at least two supports, each support comprising a leg portion and at least two desktop supports wherein each desktop support is independently coupled to the leg portion, and wherein the supports are arranged in a spaced apart relationship and the first and second desktop support of a first support are coupled at a first position of the desktops of the first and second workstations respectively, and the first and second desktop supports of the second support are coupled at second position of the desktops of the first and second workstations respectively, wherein the desktop supports are moveable to independently adjust the vertical distance above the ground of the desktops of the first and second workstations.

Preferably, a third workstation is provided comprising a desktop with a front edge and a back edge, the shape of the desktop being profiled along the front edge to comprise a first protruding surface providing a first work surface on the desktop, a first recessed portion adjacent a first lateral side of the protruding surface and a second recessed portion adjacent second lateral side of the protruding surface, wherein the desktop of the third work station is arranged such that a. first recessed portion is adjacent a corresponding recessed portion of the first desktop, such that the recessed portion of the third desktop and the corresponding recessed portion of the first desktop provide an interactive work area adapted to accommodate at least two people in a side-by-side relationship.

Preferably, a fourth workstation is provided comprising a desktop with a front edge and a back edge, the shape of the desktop being profiled along the front edge to comprise a first protruding surface providing a Era work surface on the desktop, a first recessed portion adjacent a first lateral side of the protruding surface and a second recessed portion adjacent second lateral side of the protruding surface, wherein the back edge of the desktop of the fourth workstations is arranged in an opposing relationship with the back edge of the desktop of the third workstation such that the protruding surfaces of the respective desktops extend in a substantially opposite directions and the recessed portions of the desktop of the fourth workstation ate at least partially aligned with the opposing recessed portions of the desktop of the third workstation to provide opposing recessed portion pairs, and wherein each recessed portion pair provides an interactive work area adapted to accommodate at least two people in a facing relationship.

Preferably, the desktop of the fourth workstation is arranged such that a first recessed portion is adjacent a corresponding recessed portion of the second workstation, such that the recessed portion of the desktop of the fourth workstation and the corresponding recessed portion of the desktop of the second workstation provide an interactive work area adapted to accommodate at least two people in a side-by-side relationship.

Described herein is a workstation system comprising: at least two workstations, each workstation comprising a desktop with front edge, the shape of the desktop being profiled along the front edge to comprise a first protruding surface providing a first work surface on the desktop, a first recessed portion adjacent a first lateral side of the protruding surface and a second recessed portion adjacent second lateral side of the protruding surface, and at least one support adapted to support the desktops at a vertical distance above the ground, wherein a first recessed portion of one desktop is arranged adjacent a corresponding recessed portion of the other desktop to provide an interactive work area adapted to accommodate at least two people, and wherein the at least one support is disposed to accommodate a user's legs under the first work surfaces of each desktop.

In another aspect the present invention may be said to consist in a workstation system comprising at least two workstations, each workstation comprising a desktop with a front edge and a back edge, the shape of the desktop being profiled along the front edge to comprise: a first protruding surface providing a first work surface on the desktop, a first lateral extension adjacent a first lateral side of the protruding surface to provide a first auxiliary work area, and a second lateral extension adjacent a second lateral side of the protrading surface to provide a second auxiliary work area, and at least one support adapted to support the desktops at a vertical distance above the ground, wherein the back edge of each desktop comprises at least a first section and a second section that extend at an angle of substantially 120 degrees with respect to each other, and wherein the first section of the back edge of a first desktop is arranged in an opposing relationship with the second section of the back edge of a second desktop such that the first lateral extension of the first desktop is at least partially aligned with the second lateral extension of the second desktop to provide opposing work area pairs that provide an interactive work area adapted to accommodate at least two people in a facing relationship.

Preferably, at least one support is disposed to accommodate a user's legs under the first work surface and the interactive area.

Preferably, there is at least partial visibility between auxiliary work areas of opposing work area pairs.

Preferably, between each recess is substantially free of objects that impede interactive work.

Preferably, for each desktop the portion forming the first lateral extension provides a first auxiliary work surface and the portion forming the second lateral extension provides a second auxiliary work surface wherein each opposing work area pair comprise respective auxiliary work surfaces.

Preferably, a third work station is provided comprising a desktop supported on at least one support and with a front edge and a back edge, the shape of the desktop being profiled along the front edge to comprise: a first protruding surface providing a first work surface on the desktop, a first lateral extension adjacent a first lateral side of the protruding surface to provide a first auxiliary work area, and a second lateral extension second lateral side of the protruding surface to provide a second auxiliary work area, and wherein the back edge of each desktop comprise at least a first section and a second section that extend at an angle of substantially 120 degrees with respect to each other, wherein the first section of the back edge of the third desktop is arranged in a opposing relationship with the second section of the back edge of the first desktop, and the second section of the back edge of the third desktop is arranged in an opposing relation with the first section of the back edge of the second desktop such that the first lateral extension of the third desktop is at least partially aligned with the second lateral extension of the first desktop to provide opposing work area pairs that provide an interactive work area adapted to accommodate ar least two people in a facing relationship and the second lateral extension of the third desktop is at least partially aligned with the first lateral extension of the second desktop to provide opposing work area pairs that provide an interactive work area adapted to accommodate at least two people in a facing relationship.

Preferably, at least three supports are provided, each support comprising a leg portion and at least two desktop supports, wherein each desktop support is independently coupled and moveable relative to the leg portion, and wherein the supports are arranged in a spaced apart relationship and first and second desktop support of a. first support are coupled at a first position of the desktops of the first and second workstations respectively, and first and second desktop supports of the second support are coupled at a second position of the desktops of the first and second workstations respectively, wherein the desktop supports are moveable to independently adjust the vertical distance above the ground of the desktops of the first and second workstations.

Described herein is a workstation system comprising: at least two workstations, each workstation comprising a desktop with front edge and a back edge, the shape of the desktop being profiled along the front edge to comprise a first protruding surface providing a first work surface on the desktop, a first auxiliary work area adjacent a first lateral side of the protruding surface and a second auxiliary work area adjacent second lateral side of the protruding surface, wherein the first work surface comprises a working edge at which a person can be positioned to use the first work surface, and wherein the first and second auxiliary work areas have working edges at which a person can be positioned, wherein the working edges of the first and second auxiliary work areas are not colinear with the working edge of the first work surface, at least one support adapted to support the desktops at a vertical distance above the ground, wherein the back edges of the desktops of the two workstations are arranged in an at least partially overlapping opposing relationship such that at least one auxiliary work area of one desktop is at least partially aligned with a corresponding auxiliary-work area of the other desktop to provide opposing work area pairs that provide an interactive work area adapted to accommodate at least two people in a facing relationship.

Preferably, each desktop comprises an auxiliary work surface adjacent the working edge of each auxiliary work area and wherein each opposing work area pair provides an interactive work area comprising two respective auxiliary work surfaces.

Preferably, at least two supports are provided, each support comprising a leg portion and at least two desktop supports wherein each desktop support is independently coupled and moveable relative to the leg portion, and wherein the supports are arranged in a spaced apart relationship and the first and second desktop support of a first support are coupled at a first position of the desktops of the first and second workstations respectively, and the first and second desktop supports of the second support are coupled at second position of the desktops of the first and second workstations respectively, wherein the desktop supports are moveable to independently adjust the vertical distance above the ground of the desktops of the first and second workstations.

Preferably, a worktop is provided supported above the desktops of the first and second workstations in the vicinity of the interactive work area to provide an interactive work surface.

Preferably, at least one support is disposed to accomtnodate a user's legs under the first work surfaces of the first and second desktops.

Preferably, at least one support is disposed to accommodate a user's legs under the auxiliary work surfaces adjacent the working edge of each auxiliary work area.

Preferably, the back edge of each work station comprises two substantially straight sections arranged at an angle of substantially 120 degrees.

Preferably, ,three workstations arranged with respective straight sections arranged in an opposing relationship.

Preferably, the back edge is substantially straight.

Preferably, two pairs of workstations are arranged in a side-by-side relationship, each pair comprising two workstations arranged with back edges arranged in an opposing relationship.

Preferably, a work top is supported above the desktops in the vicinity of the interactive work area, and wherein the plurality of supports are adapted to support the desktops at an adjustable vertical distance above the ground, wherein the vertical distance above the ground of each desktop can be independently adjusted on the supports and the work top is fixed at a vertical distance above the ground to provide an interactive work top.

Preferably, the worktop comprises a work surface and at least one uptight support coupled to the work surface at one end and coupled to a support at the other end.

Preferably, the worktop comprises two upright supports that are rods.

In another aspect the present invention may be said to consist in a workstation system comprising; at least two workstations, each comprising a desktop, at least one support adapted to support the desktops at a vertical distance above the ground, each leg support comprising: a leg portion with a foot portion adapted to rest on the ground, and at least two desktop supports, each desktop support coupled to a respective desktop, wherein each desktop support is independently coupled to the leg portion and is independently moveable relative to the leg portion to adjust the vertical distance above the ground of the respective desktop to which it is coupled.

Preferably, four workstations, are provided each comprising a desktop, and wherein at least one leg support comprises four desktop supports, each desktop support coupled to a respective desktop and independently coupled and moveable relative to the leg portion to adjust the vertical distance above the ground of the desktop to which it is coupled.

Preferably, each desktop is adjustable to an independent vertical distance above the ground.

In another aspect the present invention may be said to consist in a leg support adapted for use in a workstation system comprising at least two workstations with respective desktops, the leg support adapted to at least partially support at least two desktops and comprising: a leg portion with a foot portion adapted to rest on the ground, and at least two desktop supports, each desktop support adapted to coupled to a respective desktop, wherein each desktop support is independently coupled to the leg portion and is independently moveable relative to the leg portion to adjust the vertical distance above the ground of a respective desktop to which it is coupled.

Preferably, each kg support comprises four desktop supports.

Preferably, each desktop support comprises: a body potion with a coupling for attachment to a desktop, and a threaded rod attached to the body portion, wherein the threaded rod is threadably engaged in a threaded portion coupled to the leg portion, whereby rotation of the threaded rod moves the body portion and coupling relative to the leg portion.

Preferably, the leg portion comprises an adjustment screw threadably engaged in a threaded portion coupled to the leg, and the leg support further comprises: a foot portion adapted to rest on. the ground, the foot portion slidingly engaged with the leg portion and comprising an upper end adapted to abut a first end of the adjustment screw or a block coupled to the adjustment screw, a spring attached to the leg portion and foot portion to bias the upper end of the foot portion into abutment with the first end of the adjustment screw or a block coupled to the adjustment screw, and at least one desktop support attached or coupled to the leg support, the desktop support adapted to be coupled to a respective desktop, wherein rotation of the adjustment screw in a first direction moves the screw through the threaded potion to slide the foot portion relative to the leg portion against the bias of the spring, and wherein rotation of the adjustment screw in a second direction moves the screw through the threaded portion allowing the foot portion to slide relative to the leg portion under bias of the spring.

Preferably, the adjustment screw comprises a coupling on at least one end for coupling to a handheld rotary tool for rotation of the adjustment screw.

Preferably, the foot portion is an extendable and retractable foot that can be extended from and retracted into the leg portion to provide a levelling adjustment.

Preferably, the foot portion comprises an adjustment screw one end of which is engaged in a block slideably engaged with a top surface of a foot via a coupling, wherein rotation of the adjustment screw causes longitudinal, movement of the block to retract or extend the foot and wherein the foot slides laterally with respect to the coupling during retraction or extension.

Preferably, the adjustment screw comprises a tool coupling on at least one end for coupling to a handheld rotary tool for rotation of the adjustment screw.

Preferably, the tool coupling on the end of the adjustment screw is a screwdriver fitting and the handheld rotary tool is a drill or an electric screw driver comprising a bit or coupling corresponding to the screwdriver fitting.

Preferably, the tool coupling is on the top end of the adjustment screw and can be accessed via an aperture in the top of an end cap of the leg support.

Preferably, the tool coupling is on the bottom end of the adjustment screw and can be accessed by an aperture on an underside of the leg support.

In another aspect the present invention may be said to consist in a workstation system comprising: at least two workstations, each comprising a desktop, a workstation support structure supporting the desktops above the ground, the workstation support structure comprising: at least two supports adapted to support the desktops at a vertical distance above the ground, the supports positioned in a spaced apart relationship and each support comprising: at least one leg portion with a foot portion adapted to test on the ground, a beam support member, and at least two desktop supports, each desktop support coupling a desktop to a leg portion, the workstation support structure further comprising a beam extending between and coupled to the at least two beam support members to hold the supports in an upright position, and a support frame attached directly to the beam and not directly to the supports for supporting modular accessories above the desktops, the support frame comprising: one or more upright supports coupled to and extending from the beam, and wherein each upright support comprises at least one coupling for coupling to a corresponding coupling on a modular accessory, the configuration of the workstation support structure being such to at least partly mechanically isolate the desktops from a modular accessory when coupled to an upright support, to provide at least partial vibration isolation between the modular accessory and the desktops.

Preferably, the modular accessory is one or more of a: a shelf, a terrace, a cupboard, a cabinet, an opaque screen, a variable visibility screen, a bracket, a drawer.

Preferably, each modular accessory comprises a top surface and bottom surface each comprising a coupling, wherein the bottom surface coupling is for attachment to the corresponding couplings of an upright suppott or top surface coupling of another modular accessory and the top surface coupling is for coupling to the bottom surface coupling of another modular accessory.

Preferably, each coupling on the upright support comprises an aperture and the corresponding coupling on the bottom surface of a modular accessory comprises a corresponding protrusion.

Preferably, each coupling on the top surface of a modular accessory comprises an aperture.

Preferably, one or more modular accessories coupled to at least one upright support.

Preferably, further comprising: an overhead beam support structure attached to the beam for supporting an overhead services beam, the overhead beam support structure comprising one or more vertical supports coupled directly or indirectly to the beam, and an overhead services beam attached to the overhead beam support structure.

Preferably, the beam extending between and coupled to the at least two supports has a square or rectangular cross-section, the beam being oriented such at least two corners of the cross-section are aligned substantially vertically to provide rigidity in the workstation support structure.

Preferably, at least one cable tray attached to and extending along the beam.

In another aspect the present invention may be said to consist in a workstation system providing multiple work areas, the system comprising a desktop with a first longitudinal edge and second longitudinal edge, and at least one support that supports the desktop at a vertical distance above the ground, wherein the shape of the desktop is profiled along the first longitudinal edge to comprise at least a first and second protruding surface providing respective first and second work surfaces on the desktop with respective first and second working edges, and the shape of the desktop is profiled along the second longitudinal edge to comprise at least a third and fourth protruding surface providing respective third and fourth work surfaces with respective third and fourth working edges on the desktop, and wherein the shape of the desktop is profiled along the first longitudinal edge to comprise at least one recessed portion between the first and second protruding surfaces to provide a first auxiliary work area with an auxiliary working edge that is not colinear with first and second working edges and the shape of the desktop is profiled along the second longitudinal edge to comprise at least one recessed portion between the third and fourth protruding surfaces to provide a second auxiliary work area with an auxiliary working edge that is not colinear with third and fourth working edges, wherein the first and second auxiliary work areas are positioned to be substantially aligned to provide an interactive work area.

Preferably, one or more further recesses along the first and second longitudinal edges to provide further interactive work areas.

In another aspect the present invention may he said to consist in a workstation system providing multiple work areas, the system comprising a desktop with a first longitudinal edge and second longitudinal edge, and at least one support that supports the desktop at a vertical distance above the ground, wherein the shape of the desktop is profiled along the first longitudinal edge to comprise at least a first protruding surface providing a first work surface on the desktop with a first working edge, and the shape of the desktop is profiled along the second longitudinal edge to comprise at least a second protruding surface providing a second work surface with a second working edge on the desktop, and wherein the shape of the desktop is profiled along the first longitudinal edge to comprise at least two recesses one either side of the first protruding surface to provide respective first and second auxiliary work areas with corresponding auxiliary working edges that are not colinear With first working edge and the shape of the desktop is profiled along the second longitudinal edge to comprise at least two recesses one either side of the second protruding surface to provide third and fourth auxiliary work areas with corresponding auxiliary working edges that are not colinear with second working edge, wherein the auxiliary work areas on the first longitudinal edge are positioned substantially aligned with corresponding auxiliary work areas on the second longitudinal edge to provide two respective interactive work areas.

In another aspect the present invention may be said to consist in a workstation system providing multiple work areas, the system comprising a desktop with a first longitudinal edge and second longitudinal edge, and at least one support that supports the desktop at a vertical distance above the ground, wherein the shape of the desktop is profiled along the first longitudinal edge to comprise at least a first protruding surface providing a first work surface on the desktop with a first working edge and a second protruding surface providing a second work surface on the desktop with a second working edge, wherein the shape of the desktop is profiled along the first longitudinal edge to comprise at least one recess either side of each of the first and second protruding surfaces to provide interactive work areas.

In another aspect the present invention may be said to consist in a workstation system providing multiple work areas, the system comprising a desktop with a first edge, second edge, and a third edge and at least one support that support the desktop at a vertical distance above the ground, wherein the shape of the desktop is profiled along the first edge to form a first protruding edge that protrudes in a first forward direction and that defines a first primary work area and two recesses one either side of the first primary work area to provide first and second auxiliary work areas with corresponding first and second auxiliary working edges, wherein the first and second auxiliary working edges diverge outwardly in the first forward direction from where they contact the first protruding edge, wherein the shape of the desktop is profiled along the second edge to form a first protruding edge that protrudes in a second forward direction and that defines a second primary work area, and two recesses one either side of the first primary work area to provide third and fourth auxiliary work areas with corresponding third and fourth auxiliary working edges, wherein the third and fourth auxiliary working edges diverge outwardly in the second forward direction from where they contact the second protruding edge, wherein the shape of the desktop is profiled along the first edge to form a first protruding edge that protrudes in a third forward direction and that defines a third primary work area, and two recesses one either side of the third primary work area to provide fifth and sixth auxiliary work areas with corresponding fifth and sixth auxiliary working edges, wherein the fifth and sixth auxiliary working edges diverge outwardly in the third forward direction from where they contact the third protruding edge, and wherein the auxiliary work areas provide adjacent auxiliary work area pairs, each work area pair forming an interactive work area adapted to accommodate at least two people in opposed relationship.

Preferably, first and second upright supports are attached to opposing sides and towards one end of the vertical support, such that when the first and second upright supports are attached to the workstation support structure, the vertical support is supported on and extends from the workstation support structure.

Preferably, the first and second upright supports comprise support brackets for at least partially supporting a worktop disposed above a desktop and adjacent to a modular accessory supported by the support frame.

Preferably, further comprising: at least one terrace coupled to the support frame providing a surface for supporting work items, wherein the at least one terrace comprises a slot for receiving a dividing panel, for dividing the terrace into two separate adjacent surfaces for supporting work items.

Preferably, a dividing panel is inserted in the slot.

Preferably, the dividing panel extends below the terrace to provide a screen between the two adjacent surfaces above and/or below the terrace.

Preferably, two vertically spaced apart terraces are provided providing two surfaces for supporting work items wherein both surfaces comprise a slot for receiving a dividing panel, for dividing each terrace. into two separate adjacent surfaces for supporting work items.

Preferably, a cabinet is coupled to the support frame with a top and bottom terrace providing a storage space for supporting work items, wherein the top and bottom terrace each comprise a vertically aligned slot for receiving a dividing panel, for dividing the cabinet into two separate opposed compartments for storing work items.

Preferably, a dividing panel is inserted in the slots wherein the dividing panel comprises: a lower section that resides between the top and bottom terrace to divide the cabinet into two separate compartments, and an upper section that resides above the top terrace to divide a top surface of the top terrace into two adjacent surfaces, wherein the upper section provides a screen.

Preferably, the dividing panel extends below the bottom terrace to provide a screen between two adjacent surfaces above and/or below the terrace.

Preferably, the dividing panel is opaque to provide a screen.

Preferably, the dividing panel is configured to provide a variable visibility screen.

Preferably, a recessed portion of a desktop of the first workstation is arranged adjacent a first lateral extension of a desktop of the second workstation such that the first lateral extensions of the desktop of the second workstation is at least partially aligned with the recessed portion of the desktop of the first workstation to provide adjacent work area pairs that provide an interactive work area adapted to accommodate at least two people in a side-by-side relationship.

In one aspect the present invention may be said to consist in a workstation system comprising: at least two workstations, each workstation comprising a desktop with a front edge and a back edge, the shape of the desktop being profiled along the front edge to comprise: a first protruding surface providing a first work surface on the desktop, a first lateral extension adjacent a first lateral side of the protruding surface to provide a first auxiliary work area, and a second lateral extension adjacent a second lateral side of the protruding surface to provide a second auxiliary work area, and at least one support adapted to support the desktops at a vertical distance above the ground, wherein the back edge of each desktop comprises at least a first section and a second section that extend at an angle of substantially 120 degrees with respect to each other, and wherein the fust lateral extension of the first desktop is arranged adjacent to the second lateral extension section of the second desktop such that the first lateral extension of the first desktop is at least partially aligned with the second lateral extension of the second desktop to provide adjacent work area pairs that provide an interactive work area adapted to accommodate at least two people in a side-by-side relationship.

Preferably, one or more further workstation systems are provided comprising four workstations, each workstation system arranged adjacent at least one other workstation system.

Preferably, one or more further workstation systems are provided comprising three workstations, each workstation system arranged adjacent at least one other workstation system.

Preferably, one or more of the terraces is fanned from two adjacently arranged plates to form the slot.

Preferably, a plurality of supports are provided.

Preferably, between each recess is substantially free of objects that impede interactive work.

The term "comprising" as used in this specification means "consisting at least in part of". When interpreting each statement in this specification that includes the term "comprising", features other than that or those prefaced by the term may also be present. Related terms such as "comprise" and "comprises" are to be interpreted in the same manner.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

Where specific integers are mentioned herein which have known equivalents in the art to which this invention relates, such known equivalents are deemed to be incorporated herein as if individually set forth.

The invention consists in the foregoing and also envisages constructions of which the following gives examples only.

BRIEF DESCRIPTION OF DRAWINGS

Preferred embodiments of the invention will be described with reference to the following drawings of which.

DETAILED DESCRIPTION OF PREFERRED EMBODIMENTS

Figure 1A:
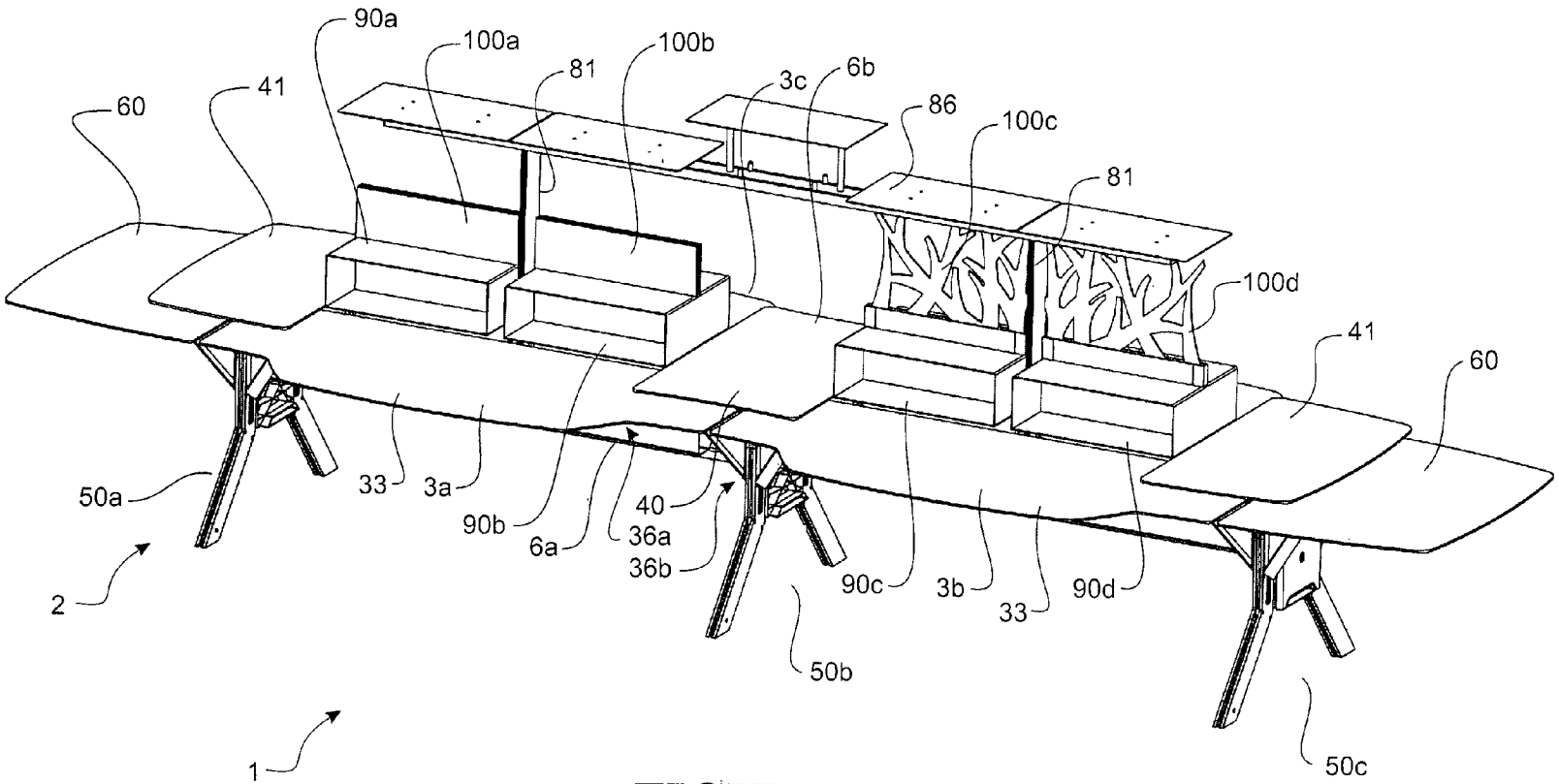
FIG. 1*a* shows a perspective view of a first embodiment of an assembled workstation system comprising four workstations.

Embodiments of a workstation system and the components comprising the workstation system will be described with reference to FIGS. 1 to 52*b*. In general terms, the workstation system is constructed as a modular system from a number of components to provide one or more workstations for use by office workers and the like. The workstations can be used to support computers and other office equipment, and can also be used by office workers as a desk upon which to perform usual office work. Each embodiment of the workstation system is adapted to comprise the required number of workstations that are desired. It will be appreciated that the invention is not restricted to a workstation system comprising solely the number of workstations described in the following embodiments. Typically, a workstation system will be used in an office environment, but it will be appreciated that the workstation system is not restricted to use in an office environment. Many other applications are possible.

In general terms the desk top comprises a profiled front edge, which comprises a protruding or convex portion with a working edge at which a person can sit. The person can use the work surface on the protruding portion of the desktop as a primary working surface for a keyboard, books, paper or the like. A second working edge is provided either side of the protrusion, which could be in form of a recessed portion in the front edge of the desktop, an extended portion or the like. The working edge either side is not co-linear with the first working edge. This provides several auxiliary work areas on the desktop for a worker. The work area either side of the protrusion are adapted to be aligned or arranged adjacent in some manner with a corresponding working edge on another corresponding desktop to provide an interactive work area.

First Embodiment

A first embodiment of the invention is shown in FIGS. 1 to 2*a* and 3*a*-3*i*. It will be first described generally with reference to FIG. 1*a*. The workstation system 1 is a modular system comprising a number of components to provide a number of workstations eg. 3*a* for office workers or the like. FIG. 1*a* shows a preferred form of the workstation comprising four workstations, although it will be appreciated that the work station 1 system according to the invention can comprise any suitable number of workstations. As shown in FIG. 1*c*, two desktops can be arranged side-by-side. This uses a slightly different leg support in the support structure to be described later. Referring to FIG. 1*c*, it will be clear that just a single workstation could comprise the workstation system, by only having one desktop and associated support structure such as shown in FIGS. 40-45.

The workstation system comprises a support structure 2, the legs of which are partially shown in FIG. 1. A number of desktops 3*a*-3*d* are also shown that are supported on the support structure 2. Each desktop provides a workstation at which an office worker can carry out their usual tasks. This might include, for instance, a space for supporting and using a computer or other office equipment and a space for conducting other work.

Figure 3A:
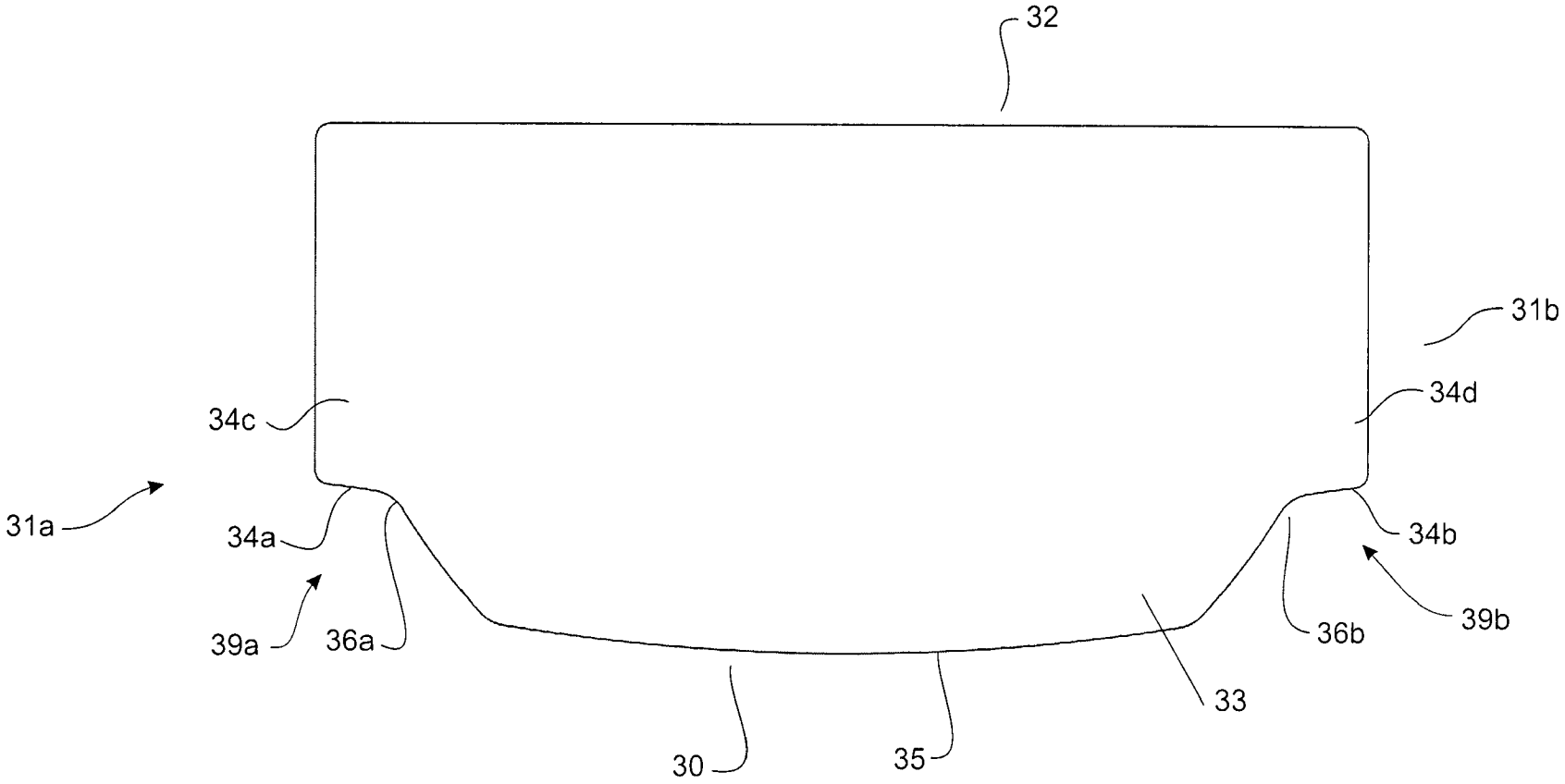
FIGS. 3*a*-3*c* show three possible embodiments of a desktop used in the first embodiment of the workstation system.
Figure 3B:
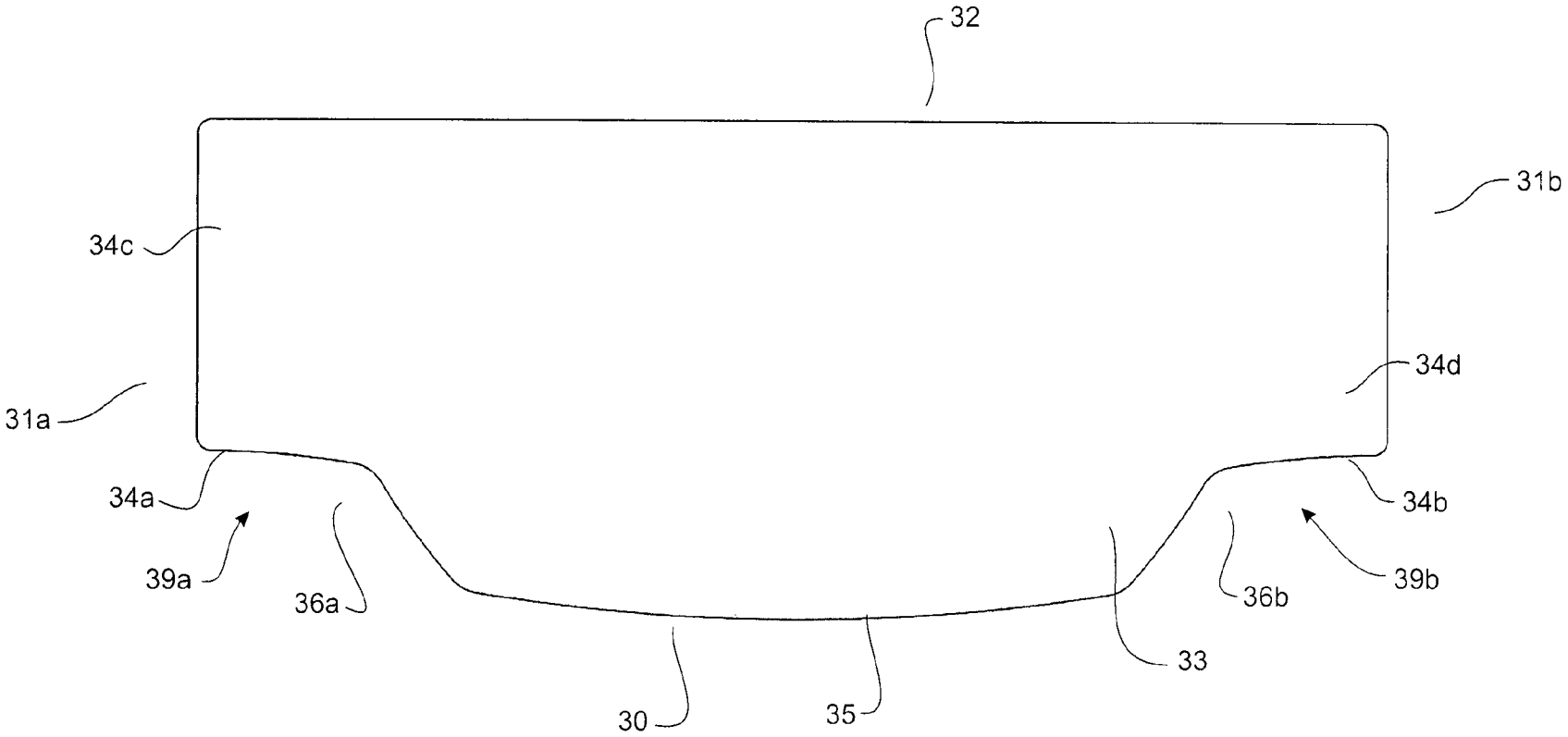
Figure 3C:
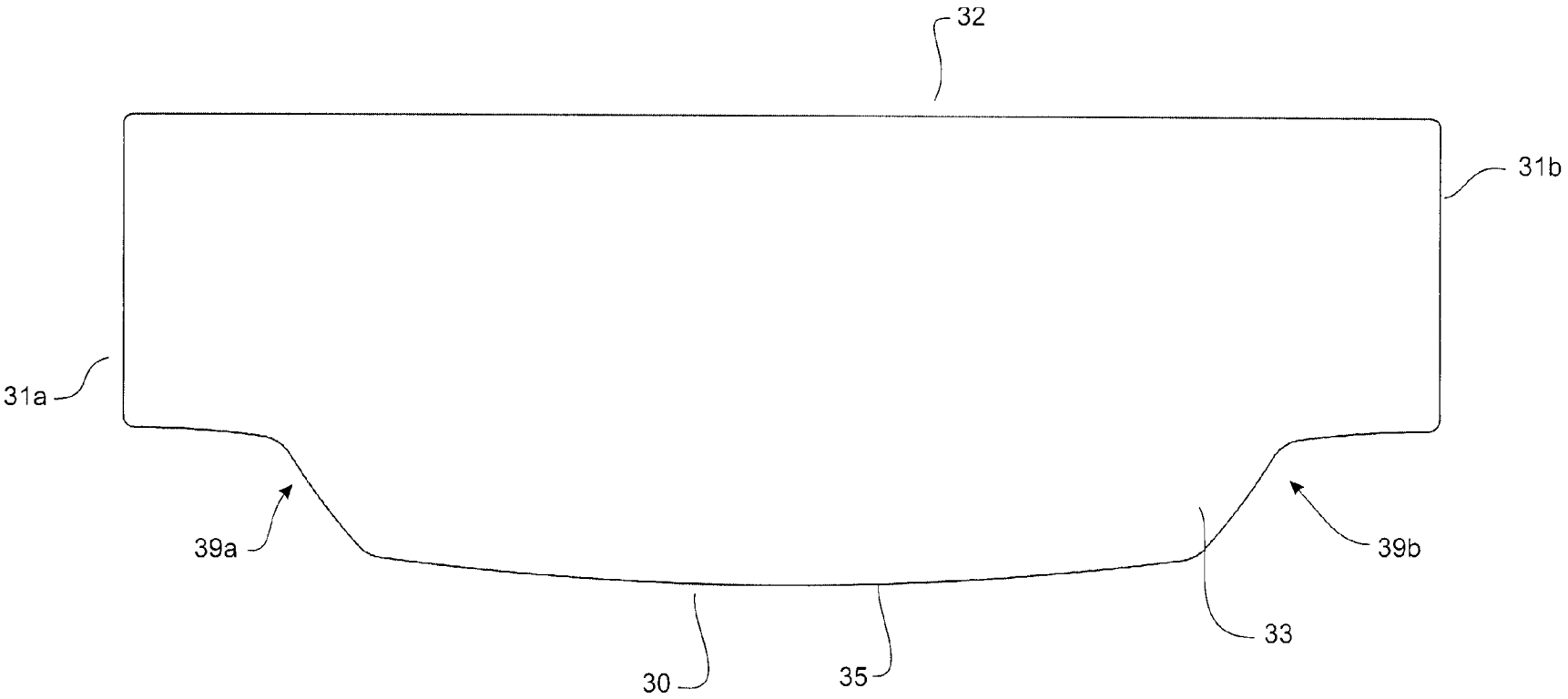
Figure 3D:
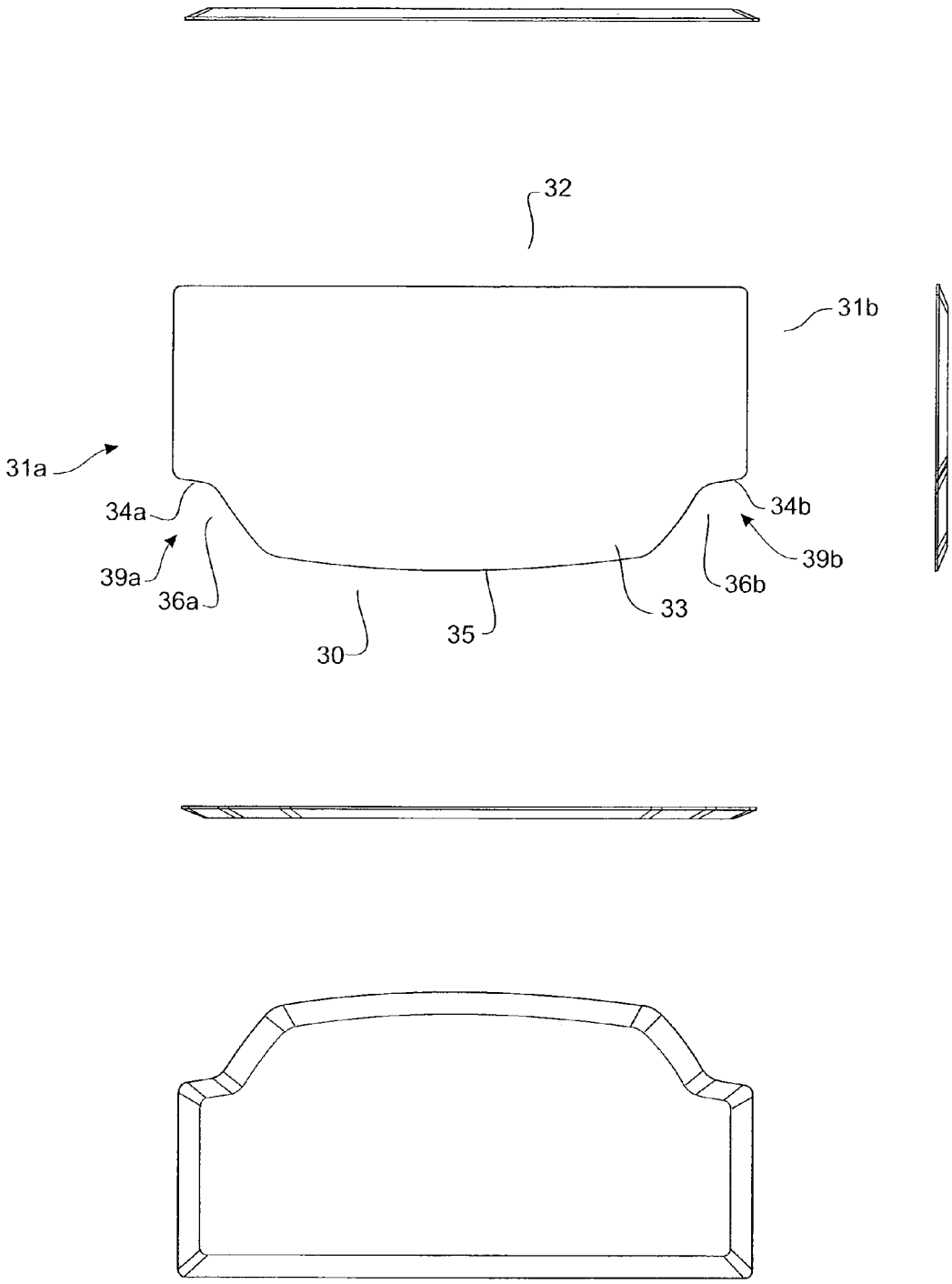
FIGS. 3*d*-3*i* show plan, elevation and perspective views of the respective desktops shown in FIGS. 3*a*-3*c*, FIGS. 4*a*,4*b* show possible embodiments of end desktops for use in the workstation system.
Figure 3E:
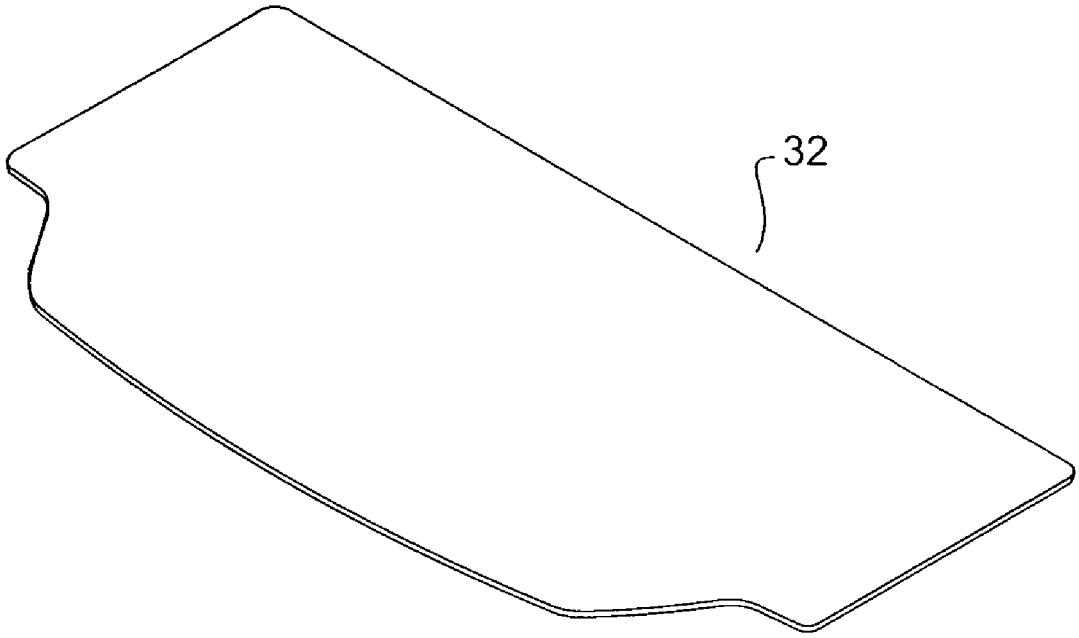
Figure 3F:
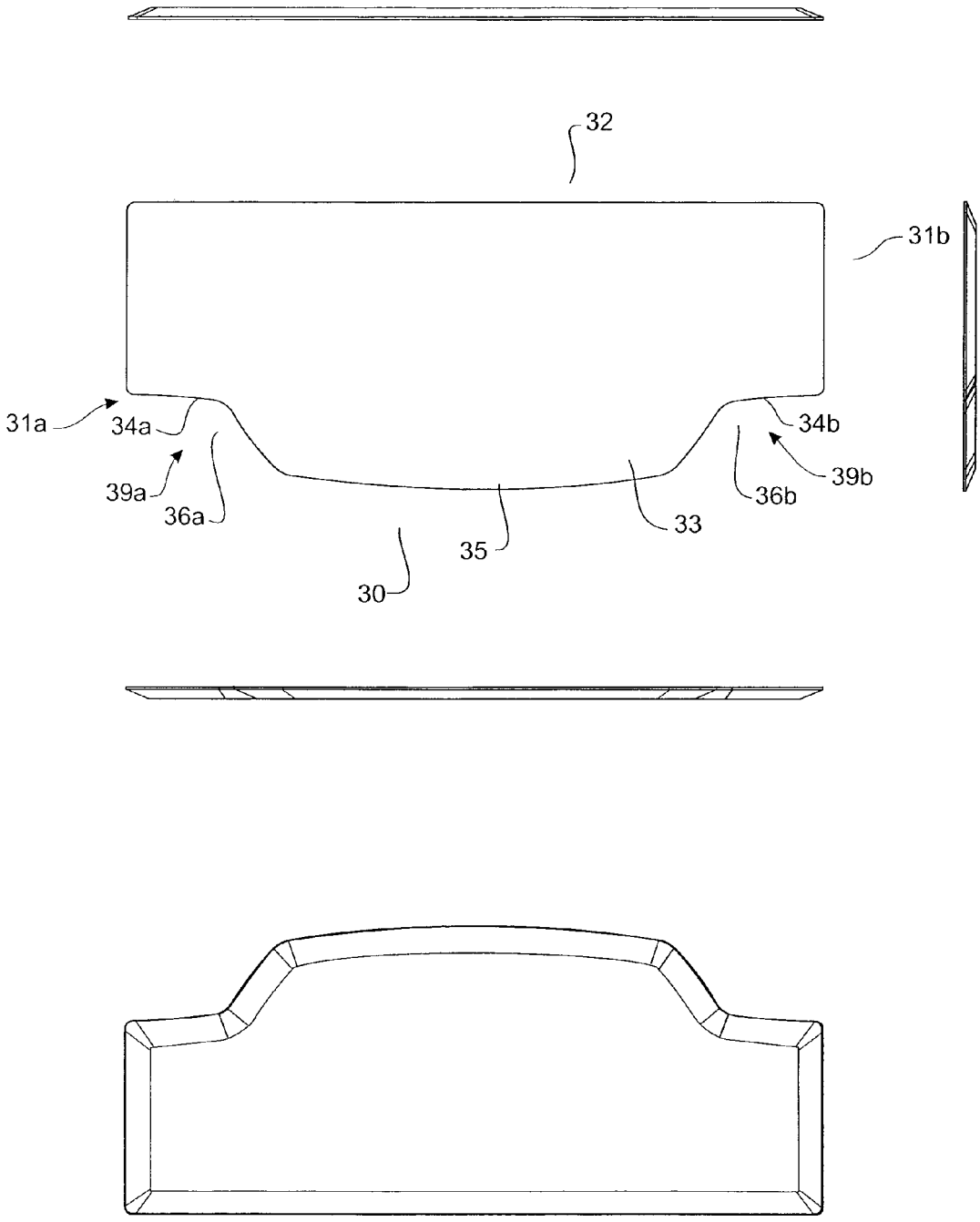
Figure 3G:
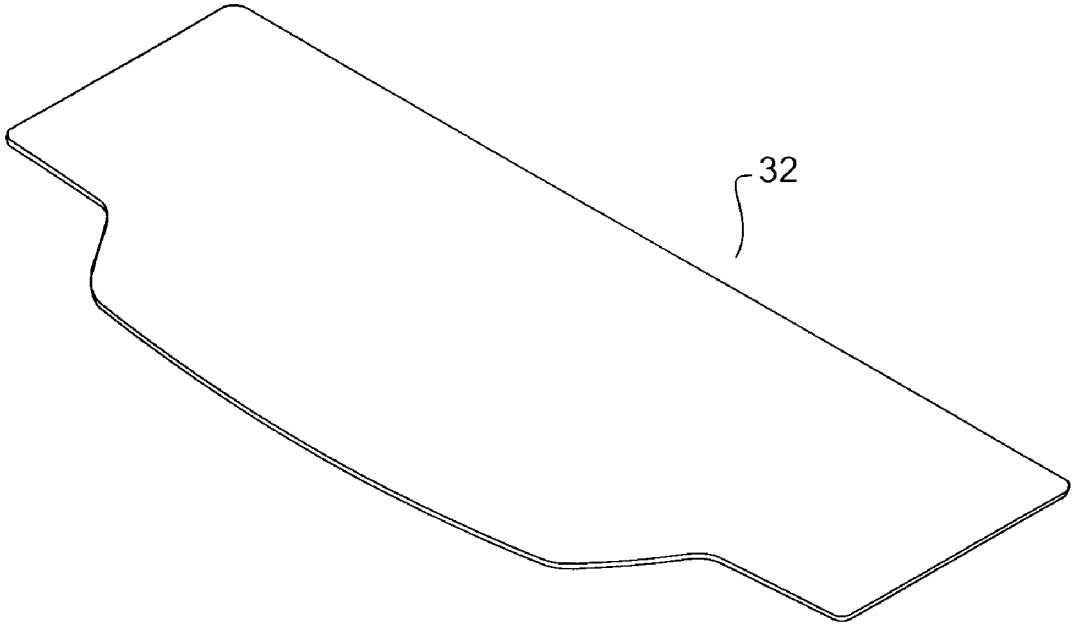
Figure 3H:
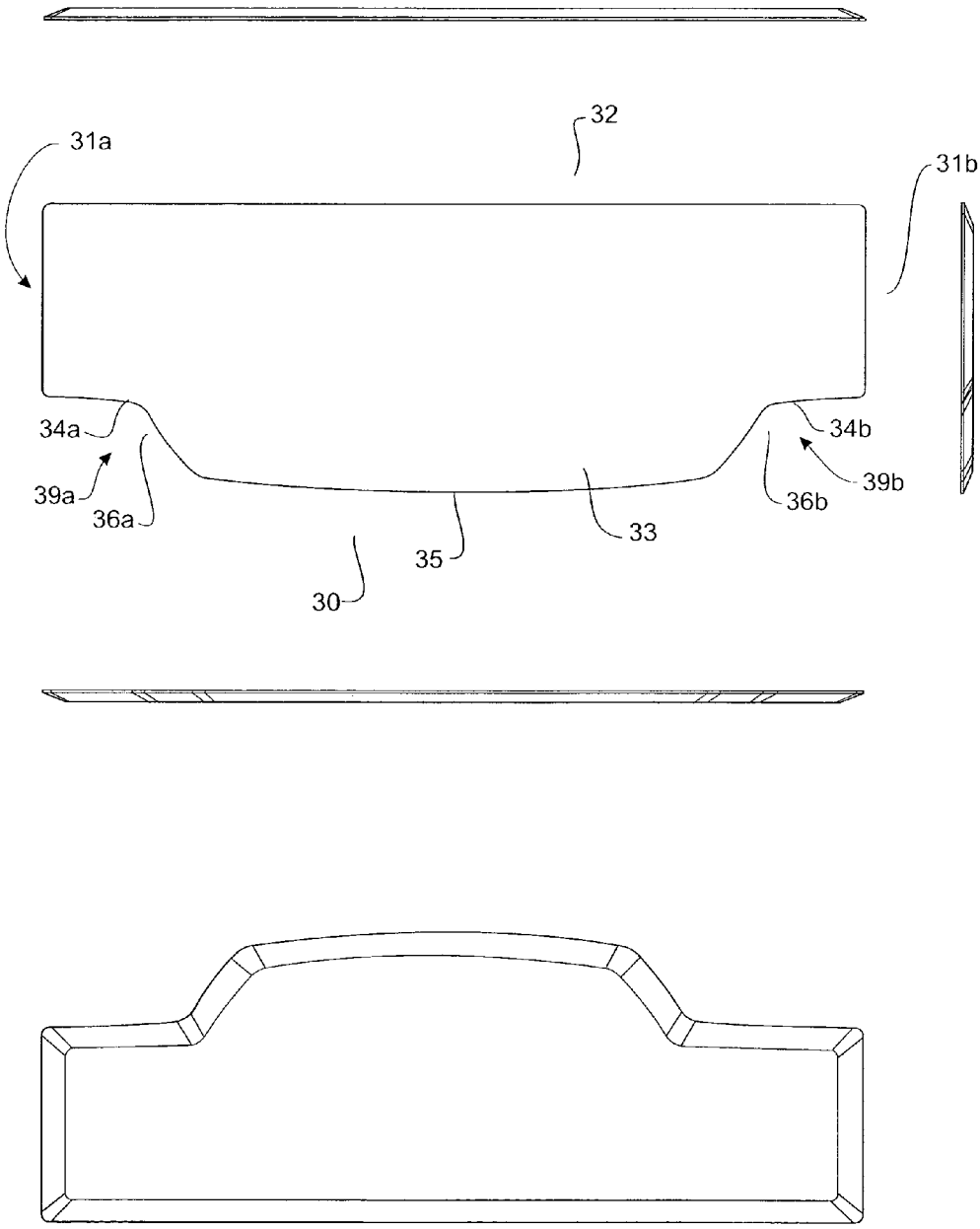
Figure 3I:
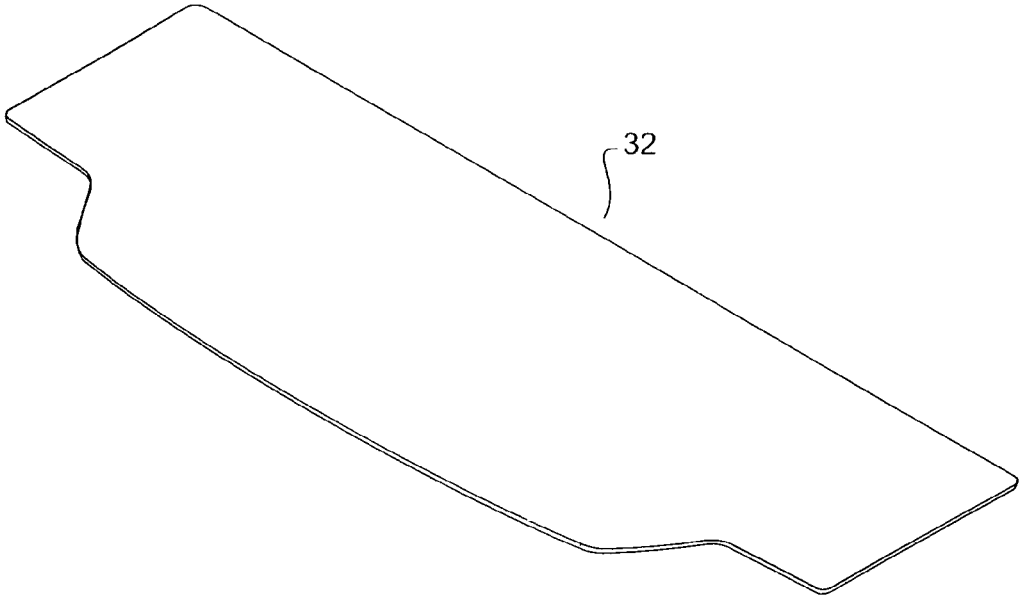

Each workstation of the system 1 comprises a desktop, eg. 3*a*-3*d*. Three possible shapes of a desktop for the first embodiment are shown in FIGS. 3*a*-3*i*. FIGS. 3*a*-3*c* show desktops with different dimensions and front edge profiles. FIGS. 3*d*-3*i* show respective plan, elevation and perspective views. Referring to FIG. 1*a* and FIGS. 3*a*-3*c*, each desktop comprises a front edge 30, two side edges 31*a*, 31*b* and a back edge 32. The desk top can be made from MDF or other suitable wood product, pressed sheet metal or moulded from plastics in a moulding process. In this embodiment the back edge and the side edges are substantially straight. The shape of the desktop is profiled along the front edge 30 to include a protruding surface 33, preferably substantially arranged in the middle of the front edge 30. The protruding surface provides a primary or first work surface on the desktop, for supporting a keyboard, other equipment, papers, books and the like on which a person can work. The protruding surface is bounded by a first or primary working edge 35, which forms a section of the front edge 30. This is an edge 35 at which a person can sit when utilising the first working surface. The first working edge 35, protruding work surface 33 and/or area in front of the working edge 35 provide a first or primary work area of the desktop alone or in combination.

Each desktop 3*a*-3*d* also comprises two auxiliary work areas e.g. 39*a*, 39*b* either side of the first work area or protruding work surface. Each auxiliary work area 39*a*, 39*b* comprises a working edge 34*a*, 34*b* that is not co-linear with the working edge 35 of the first work area or protruding surface 33. In this embodiment, to achieve this, the shape of the desktop is profiled along the front edge 30 to comprise two recessed portions 36*a*, 36*b* positioned laterally either side of the protruding work surface 33. Each auxiliary work area comprises a working edge 34*a*, 34*b* set back from the working edge 35 of the protruding surface 33 and bounded by a respective side edge 31*a*, 31*b*. Each working edge 34*a*, 34*b* comprises one section of the entire front edge 30 of the desktop 3*a*-3*d*. The auxiliary work area 39*a*, 39*b* of the desktop is adapted to be arranged adjacent a corresponding auxiliary work area of another desktop to provide an auxiliary working area pair to form an interactive work area e.g. 6*a*-6*d* that can accommodate at least two people. Each auxiliary work area comprises the auxiliary working edge 34*a*, 34*b* the area in front of the working edge 39*a*, 39*b* and/or the desktop surface 34*c*, 34*d* adjacent the auxiliary working edge alone or in combination. The desktop surface adjacent the auxiliary working edge provides an auxiliary working surface 34*c*, 34*d*. When the auxiliary working areas are arranged as a pair to form an interactive work area 6*a*-6*d* as described above, the corresponding auxiliary working surfaces 34*c*, 34*d* provide an auxiliary working surface pair.

In a preferred embodiment the protruding work surface 33 may have at least a partially convex front edge which blends into an at least partially convex auxiliary working edge at either side. The first working edge and auxiliary working edges may not be fully convexed or concaved but rather generally of that nature. Alternatively, the first working edge could be straight and comprise square straight sides that are adjacent straight auxiliary working edges. Many other variations on the general shape are possible. The important feature is that the auxiliary working areas are arranged in a manner such that when arranged adjacent a corresponding auxiliary work area they provide an interactive work area that can accommodate at least two people for interactive work activity.

Figure 1B:
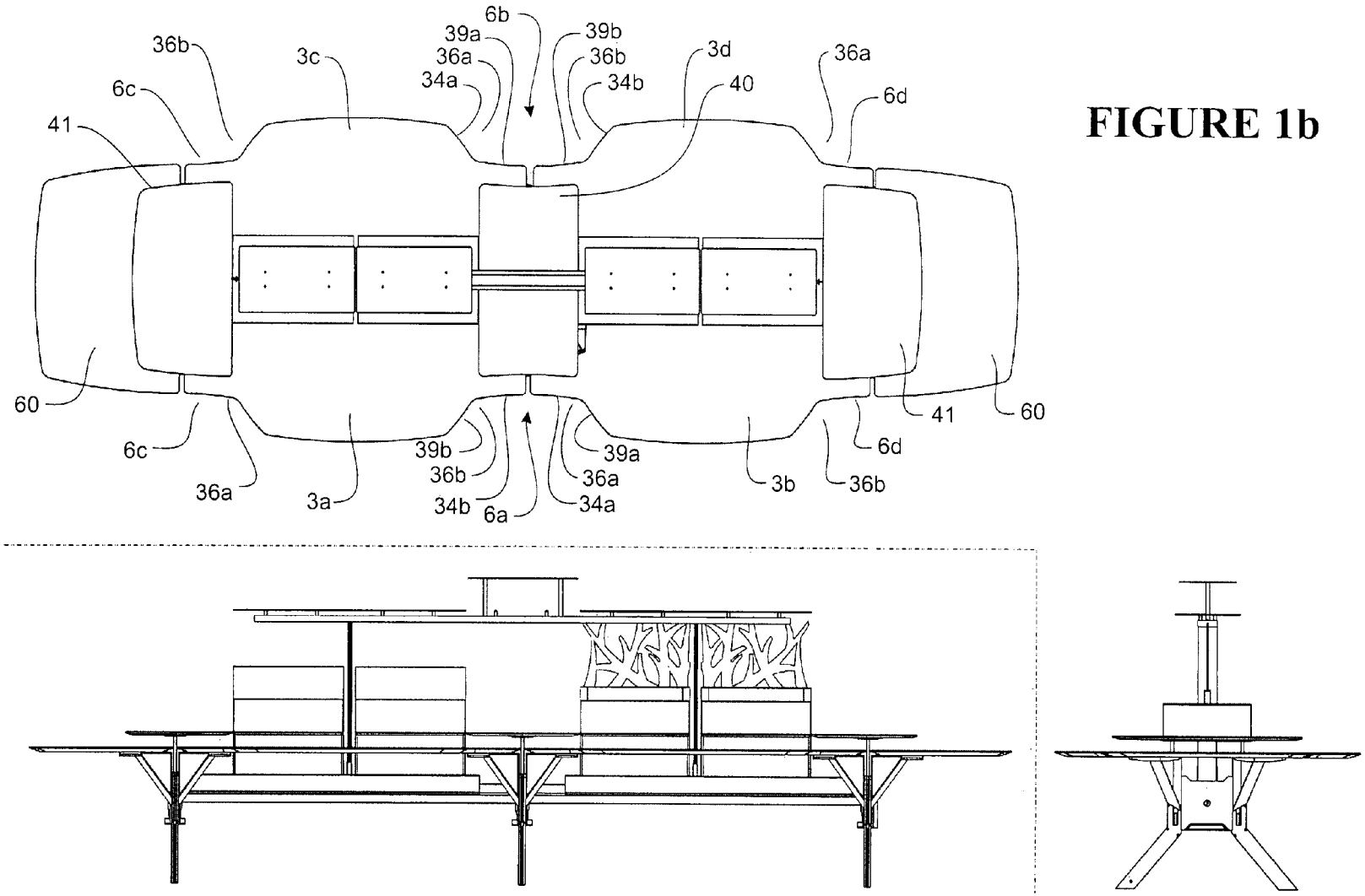
FIG. 1*b* shows plan and elevation views of the workstation system.

Referring to FIG. 1*b* which shows a plan view of the desktops 3*a*-3*d*, the arrangement of the desktops will be described in further detail along with the configuration of the interactive work areas. Each desktop 3*a*-3*d* can be arranged adjacent to at least one other desktop. Each desktop can be arranged adjacent a corresponding desktop in a side-by-side relationship, such as 3*a* and 3*b* or alternatively in an opposing or back-to-back relationship such as 3*a* and 3*c*. Each desktop could be arranged adjacent up to three other corresponding workstations desktops, although this is not shown in FIG. 1*b*.

Referring first to desktops 3*a*, 3*b*, these are arranged in a side-by-side relationship, such that the edge 31*b* of desktop 3*a* is arranged adjacent the side edge 31*a* of desktop 3*b*. In this configuration, the auxiliary work area 39*b* of the first desktop 3*a* is arranged adjacent the auxiliary work area 39*a* of the second desktop 3*b* to form a pair. That is the corresponding recessed portions are arranged to provide a recessed portion pair. This provides a combined recess 36*b*, 36*a* that provides an interactive work area 6*a* comprising the two corresponding auxiliary work areas 39*a*, 39*b*. This recess provides a position that can accommodate up to two people in a side-by-side relationship. It also provides an auxiliary work surface pair 34*c*, 34*d* that provides an interactive work surface. The interactive work area 6*a* might comprise the recess 6*a* itself, or the recess and the corresponding adjacent work area surfaces on the desktops 3*a*, 3*b*. It can also comprise an interactive table 40 to be described later. In use, a person who is carrying work out on the protruding work surface 33 at the first working edge 35 can conduct interactive work with the person sitting in the workstation adjacent by moving to the interactive work area 6*a*. This provides a location where two people can sit in proximity to assist interactive working.

Similarly, an interactive work area can be formed in desktops arranged in an opposing relationship. For example, referring to desktops 3*a* and 3*c*, the back edges 32 of these are arranged adjacent in an opposing relationship, such that the respective protruding work surfaces 33 extend in substantially opposite directions. While the back edges of the desktops may abut, in the preferred embodiment there is a gap between them which includes a framework to be described later. The desktops 3*a*, 3*c* are arranged in the opposing relationship such that the auxiliary work areas 39*a*, 39*b* formed either side of the protruding surface are substantially or at least partially aligned. They are shown substantially aligned in FIG. 1*b*. In this case, the auxiliary work area 39*a* of first desktop 3*a* is arranged in an aligned and opposing adjacent configuration with the corresponding auxiliary work area 39*b* of desktop 3*c*. Similarly, the auxiliary work area 39*b* of desktop 3*a* is arranged substantially aligned with the auxiliary work area 39*b* of desktop 3*c*.

Referring to, for example, opposing and aligned work areas 39*b* and 39*a* of desktops 3*a*, 3*c* respectively, the arranged auxiliary work areas provide an interactive work area 6*b* comprising the recesses 36*b*, 36*a* and optionally also the combined work surface of desktops 3*a* and 3*b* extending between the auxiliary working edges 34*b*, 34*a*. It can also comprise the interactive table 40. This provides another type of interactive work area 6*b* which can accommodate two people in a face-to-face relationship. Interactive area 6*b* can also be considered to comprise auxiliary work areas 39*a*, 39*b* of desktops 3*b*, 3*d* respectively. The recesses 39*b* of desktop 3*a*, 39*a* of desktop 3*b*, 39*a* of desktop 3*c* and 39*b* of desktop 3*d* provide a narrow zone between work edges 34*b*, 34*a* to facilitate closer interaction. The narrow zone comprises the respective desktops and/or interactive table. The nature of the recessed auxiliary work area 39*a*, 39*b* that is set back from the first working edge 35 enables workers sitting opposite each other to come closer together when working in an interactive relationship in the interactive area 6*b*.

For example, ordinarily office workers will be working at the respective protruding work surfaces 35 on desktops 3*a* and 3*c*. When they wish to conduct interactive work they can both move to their respective auxiliary work areas 36*b*, 36*a* and be in a closer face to face arrangement that facilitates interactive work in interactive area 6*a*/6*b*. Clearly, they could also use the alternative auxiliary work areas 36*a*, 36*b* on the other side of their desks 3*a*, 3*c* respectively. This provides interactive area 6*c*. Another interactive area is provided at 6*d*. As can be seen, the interactive work area 6*b* comprising 36*b* of desk top 3*a*, 36*a* of desk top 3*b*, 36*b* of desk top 3*d*, and 36*a* of desk top 3*c* can provide an interactive work area 6*a*/6*b* for up to four people.

FIG. 1*b* shows only four desktops arranged in this manner, but it could be possible to have further desktops arranged in a side-by-side relationship either side of desktops 3*a*, 3*c* and/or desktops 3*b*, 3*d*. This would provide more interactive areas. It is also possible to have fewer than four desktops. For example, the workstation system might only have side-by-side desktop arrangements, such as 3*a*, 3*b*, or solely face-to-face desktop arrangements, such as 3*a*, 3*b*. Other combinations are also possible.

Figure 1C:
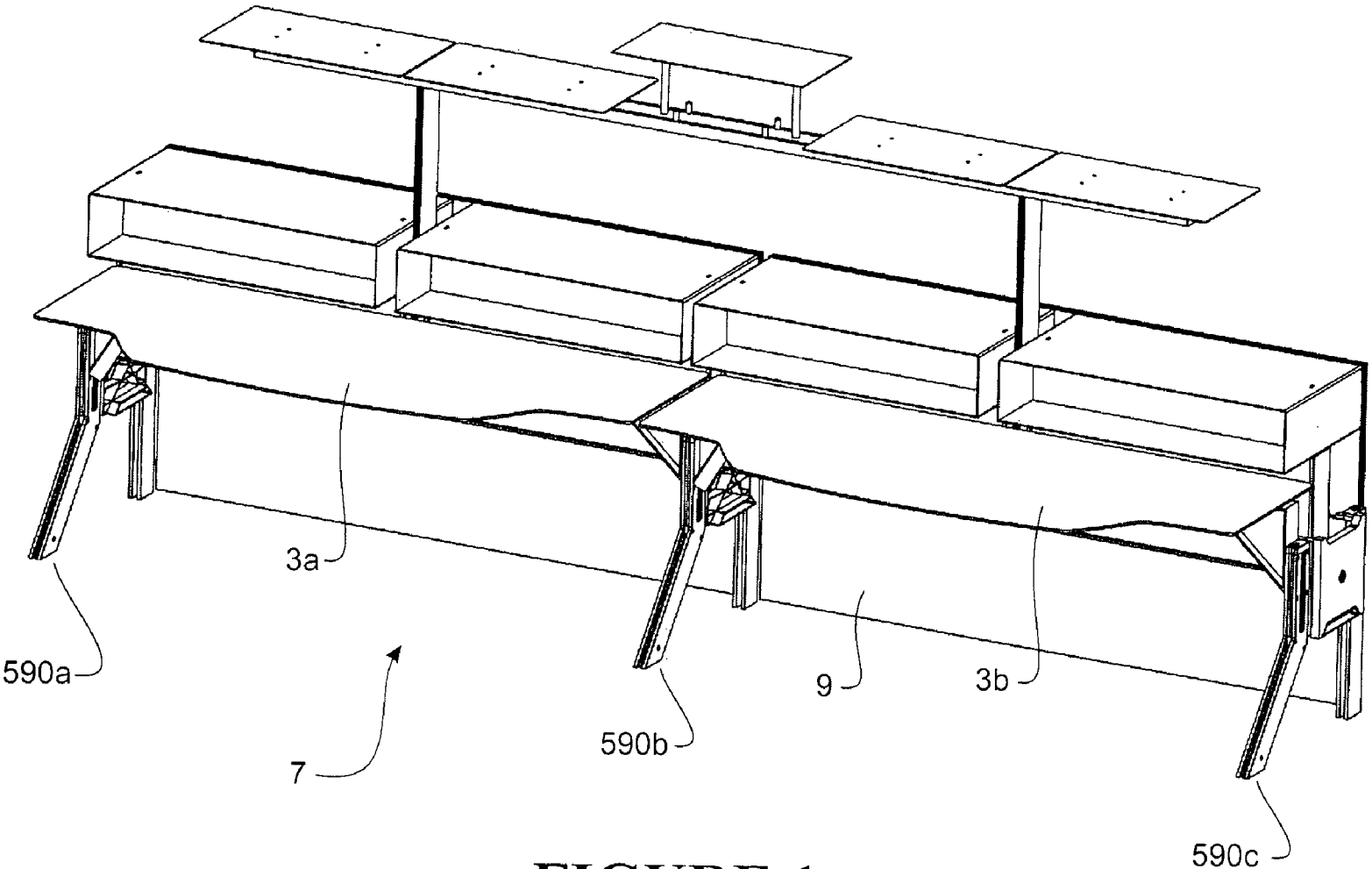
FIG. 1*c* shows a perspective view of a first embodiment of an assembled workstation system comprising two workstations.

FIG. 1*c* shows a possibility where only two workstations are provided in a side-by-side relationship to provide a two desktop workstation system 7. The arrangement is identical to the side-by-side description in relation to the four desktop workstation described in relation to FIGS. 1*a*, 1*b*. No further description is required here. However, it is possible to use a different leg support where only two desktops 3*a*, 3*b* are provided side-by-side as shown in FIG. 1*c*. The leg supports 590*a*-590*c* of this option are similar to leg supports 50*a* to 50*c*. However, instead of the leg support comprising two angled leg portions, it comprises one angled and one straight leg portion. This will be described in more detail with respect to FIG. 5*e*. This enables the workstation system 7 to be placed adjacent a wall. The two desktop workstation system 7 might also comprise a back panel 9 as shown spanning between the legs 590*a*-590*c*. It will be appreciated however that the two desktop system could be implemented using the leg supports 50*a*-50*c* instead, although this would increase the footprint size of the workstation system 7. All other features of the workstation system 7 are the same as that for the workstations system 1 shown in FIG. 1*a*, and as described below.

Referring to FIG. 1*c*, it would be possible to reduce the system down to a single workstation, comprising a single desktop, eg 3*a*, and two leg supports 590*a*, 590*b*. This would effectively form one half of the system 7 shown in FIG. 1*c* and as shown in FIGS. 40-45.

Referring back to FIG. 1*a*, the remaining features will be briefly described. It will be appreciated that all features described will also apply to the two desktop workstation system 7, and a one desktop workstation system, or a workstation system with more than four desktops. The modular nature of the system allows any configuration with any required number of components. The four desktop system will be used as an example for describing the features/components. Each desktop 3*a*-3*d* is supported on a leg support 50*a* to 50*c* that is adjustable. It will be appreciated that each desktop could be supported by any type of suitable support above the ground. For example, the desktops could be attached to a partition, wall or other supporting structure. The terms "leg support" and "support" should be interpreted as meaning any suitable type of support structure to hold the desktops off the ground. The height or vertical distance of a desktop 3*a*-3*d* above the ground of each desktop can be independently adjusted on the leg support 50*a* to 50*c* to which it is attached such that each desktop can be set at a different height to suit the ergonomics of the person working at the desktop. The leg support and adjustment mechanism will be described later with respect to FIG. 5*a*-5*d*.

Figure 6A:
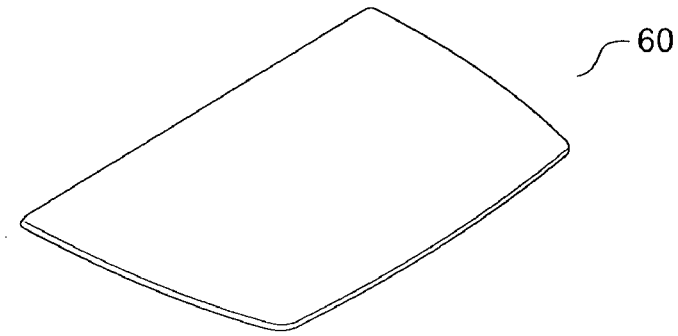
FIGS. 6*a*, 6*b* show a table end.
Figure 6B:
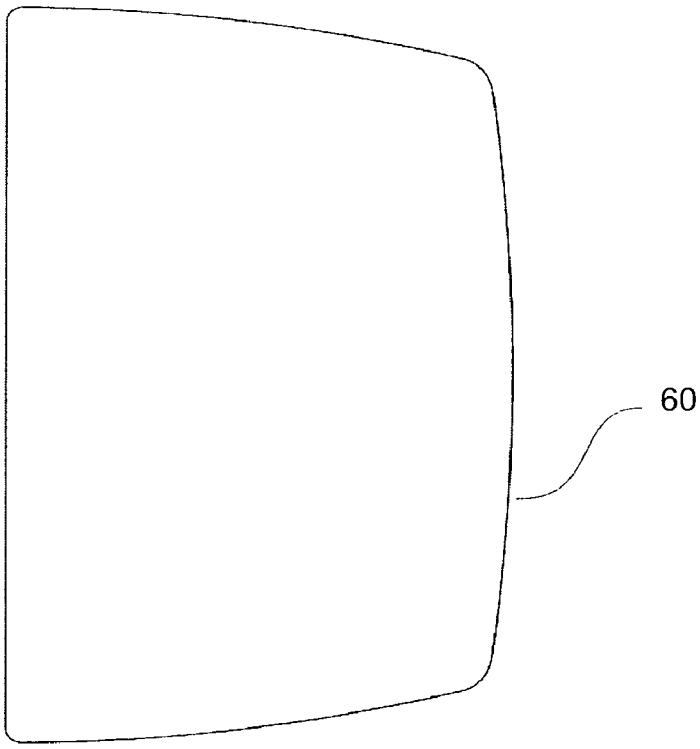

When attached to respective desktops, each leg support is attached so that it is positioned well clear of the respective primary and auxiliary work areas/work surfaces/working edges of the desktops to which it is attached. This enables a user to sit/stand at the primary and auxiliary work areas without any or minimal impediment to their legs. The legs are positioned in any suitable place to accommodate a user's legs under the primary/auxiliary work surfaces. For example, when sitting at a primary or auxiliary work area, the user can sit at the area and have their legs under the respective portion of the desktop. The leg supports might be positioned under the desktops to which they are connected in a suitable position to prevent impediments to users' legs. They might be fully or only partially under the respective desktops. That is, the legs might be positioned at least partially at a position not covered by the respective desktop. Alternatively, they might be positioned "remotely" so they are not covered at all by the desktops, for example by being slightly to the side or back of the respective desktops. In a preferred embodiment, the leg supports will be at least partially covered by the respective desktops to which they are coupled, as shown in the Figures. They will be connected to the desktops via couplings (to be described later) towards the back edge of the desktops, and towards the sides. Other arrangements will be possible also that provide free space under the primary and auxiliary work surfaces.

Where there are no additional desktops arranged adjacent, an end desktop 60 can be used. A possible embodiment of such a desktop is shown in FIGS. 6*a*, 6*b*.

Figure 4A:
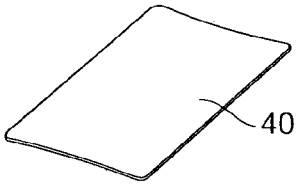
Figure 4B:
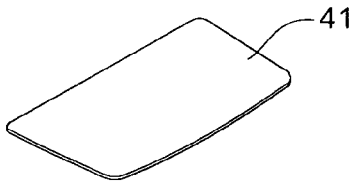

The workstation systems also preferably comprises one or more interactive work tops 40 or 41. Two possible embodiments of the interactive work top are shown in further detail in FIGS. 4*a* and 4*b*. Each interactive worktop is supported above the desktops 3*a*-3*d* in the vicinity of an interactive work area 6*a*-6*d*. The manner in which the worktops are supported will be described later with reference to FIGS. 2*a* and 5*c*. Preferably, each interactive worktop 41 or 40 is held at a fixed level above the corresponding desktops. As each desktop, such as the auxiliary work surface 34*c*, 34*d*, in the vicinity of an interactive work area may be adjusted to a separate or independent height, this can create an unlevel surface when working from the desktops in the vicinity of an interactive work areas 6*a*-6*d*. Therefore, the interactive worktops 40, 41 provide a fixed level work top, i.e. an interactive work surface, that can be used by people utilising the interactive work areas 6*a*-6*d*. As the height of the worktop comprising and extending over the interactive work area 6*a*-6*d* is the same for both or all users of the interactive work area, that worktop 40, 41 can be utilised more conveniently for sharing work, papers and working upon. The workstation system can utilise an end interactive work top 41 where the worktop is provided towards one end of the workstation system, or alternatively a standard interactive worktop can be used 40 where it is utilised in a position between two adjacent desktops eg. 3*a*, 3*b*. The end worktops 41 can be utilised by two people working in a work area in an opposed relationship eg. 6*c*, 6*d*, whereas the standard interactive work top can be utilised by up to four people in an interactive work area 6*b* either by those in a face-to-face relationship and/or those in side-by-side relationship.

The workstation 1 also preferably comprises or is adapted to be installed with a number of modular accessories eg. 90*a*. These accessories can be cabinets, shelves, cupboards or the like. Four cabinets 90*a*-90*d* are shown in FIG. 1. Screens 100*c* and 100*d* are also shown. The modular accessories are described in further detail in relation to FIGS. 9*a*-9*e*. The modular accessories can be attached to the structure of the workstation to provide storage space or the like for users at the workstations. Modular accessories are arranged so that they can be configured in a number of ways and multiple levels of modular accessories can be stacked upon one another (such as the cabinets 90*c*, 90*d* and screens 100*c*, 100*d*). The modular accessories can provide supports for computers and computer monitors. It should be noted that monitors and computers can be supported on any other part of the workstation system also. Further, the system might comprise a monitor moveable extension arm (not shown) attached to vertical upright 81 or the like for supporting a monitor. Extending from the support structure are vertical supports 81 for holding an overhead services beam 80. The overhead services beam can retain lighting and the like and provide shelving. It will be described in further detail with reference to FIG. 8.

Figure 15:
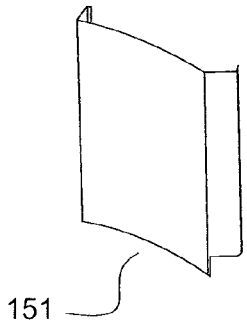
FIG. 15 shows a possible screen for use with the system of the second embodiment.

Preferably the workstation system 1 also comprises a number of screens eg. 100*a*-100*d* for providing privacy between workstations. The screens 100*a*-100*d* will be described in further detail with reference to FIGS. 10*a*, 10*b* and 15. In one possible embodiment the screens are variable visibility screens which are the subject of the U.S. patent application 60/828,588 "A Screen" filed on 6 Oct. 2006 with the same assignee. The specification of this US application is incorporated herein by reference in its entirety.

Figure 2A:
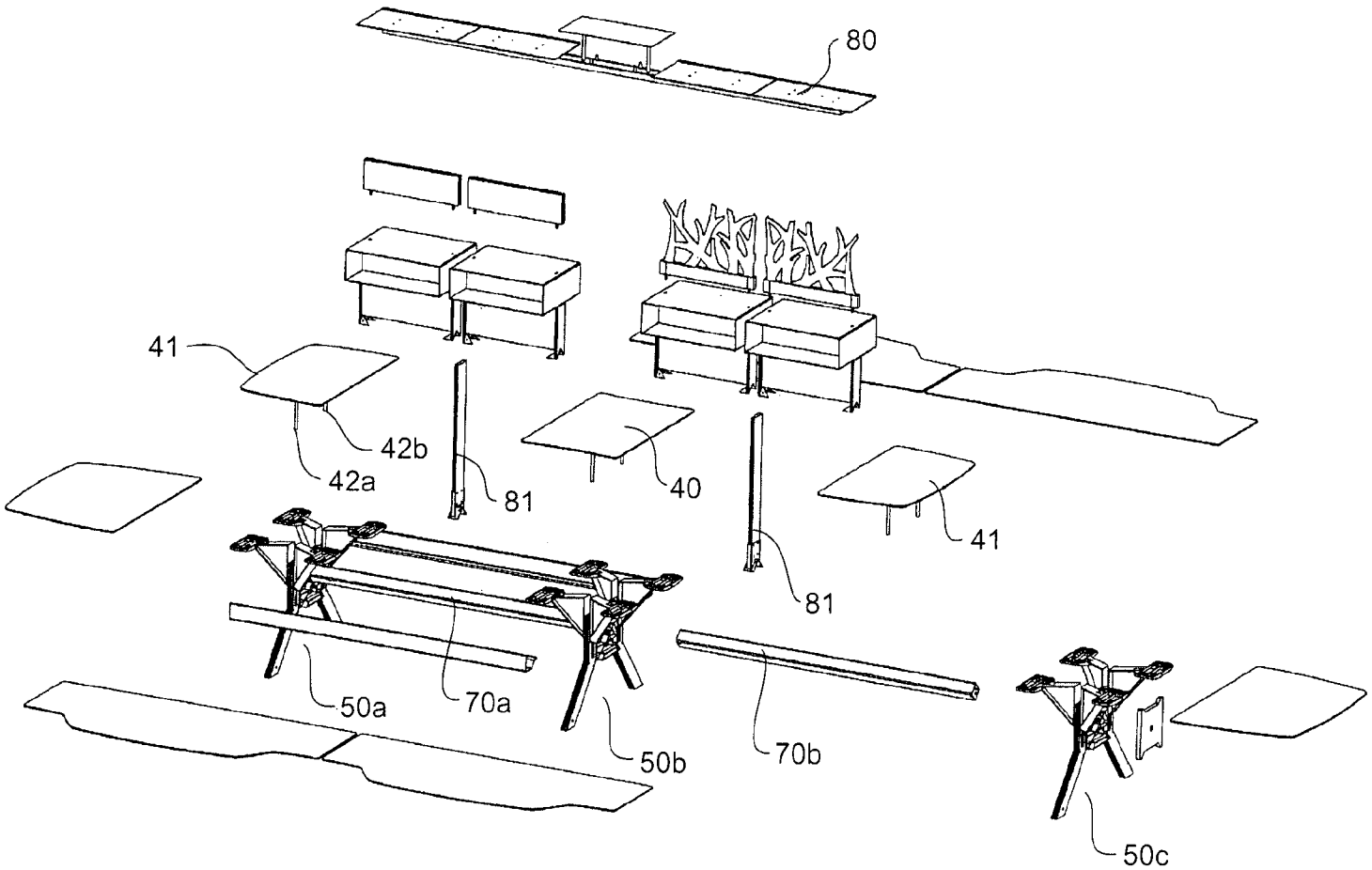
FIG. 2*a* shows an exploded perspective view of the workstation system.

The support structure of the workstation system 1 will now be described with reference to FIG. 2*a*. The support structure 2 is shared by the desktops 3*a*-3*d* of each workstation comprising the workstation system. The structure is modular to enable a desired number of workstations to be configured in a desired arrangement. This arrangement could include a single desktop, two desktops arranged in an opposing relationship or in a side-by-side relationship, or three or more workstations arranged in some combination of side-by-side and opposing relationships. The structure shown in FIG. 2*a* is configured to provide up to four workstations. Where only two workstations are required in an opposing or face-to-face relationship, the one leg section and one beam section would not be required.

The support structure 2 comprises three leg supports 50*a*-50*c* arranged in a spaced apart relationship. The leg supports are spaced apart substantially at the same distance of the width of a desktop. The leg supports are arranged so they are not positioned in the area underneath the primary and auxiliary work areas. Or, they can be positioned near or under the primary/auxiliary work areas, but not in a manner to interfere with the legs of someone sitting at those areas. This allows a person to sit and work at each of the primary and auxiliary work areas on a chair or the like, and allows the legs of the user to be positioned underneath the primary and auxiliary work areas without obstruction. The leg supports are retained in their upright position by way of one or more support beams extending between the leg supports 50*a*-50*c*. The beams also support one or more frameworks for supporting the modular accessories 90*a*-90*d*, 100*a*-100*d*, along with vertical supports for supporting the overhead services beam 80. These will be described later. Each of the features of the support structure will now be described in further detail. The support structure is such that it at least partially mechanically isolates the desktops 3*a*-3*d* from the modular accessories and/or from the overhead services beam. This is because the desktops are supported on respective leg assemblies/desktop supports held by the beam. These are separate from the modular accessory and overhead services beam which are supported separate from the beam on their own vertical support. This means that there is at least partial vibration isolation, so that vibrations that occur in the modular accessories/overhead services beam, do not transfer to the desktops (and vice versa). This provides for a more stable working surface, in contrast to existing systems.

Referring to FIGS. 2*a* and 5*a*-5*d* the leg supports 50*a*-50*c* will be described in further detail. The leg support eg. 50*a* comprises preferably two leg portions 501*a*, 501*b* connected by a beam support member 502. Each leg support 501*a*, 501*b* comprises a substantially vertical portion 503 from which extends an angular portion 504 that extends towards the ground and includes a base configured to rest on the ground. Each leg support is adapted to receive up to 4 desktop supports, eg 506, which are movable in a substantially vertical manner with respect to the vertical portion 503 of the leg support 501*a*. This enables height adjustment of the desktop to which the desk support 506 is attached. The leg support might also include a retractable and extendable foot (shown in FIGS. 5*c*, 5*d*) for adjusting the height of the leg support from the ground.

Figure 5A:
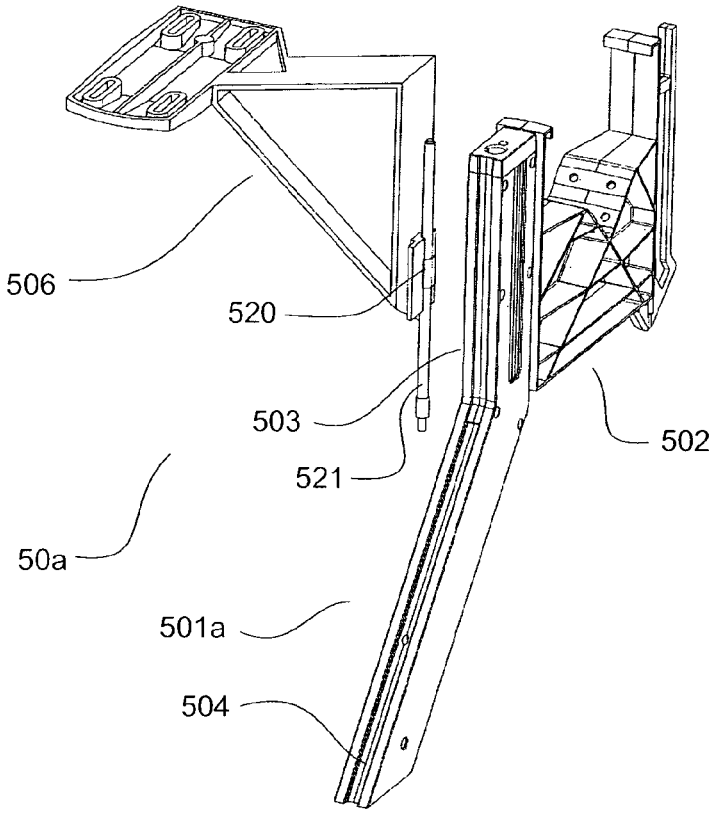
FIG. 5*a* shows a partially exploded perspective view of a portion of a leg support for the workstation.
Figure 5B:
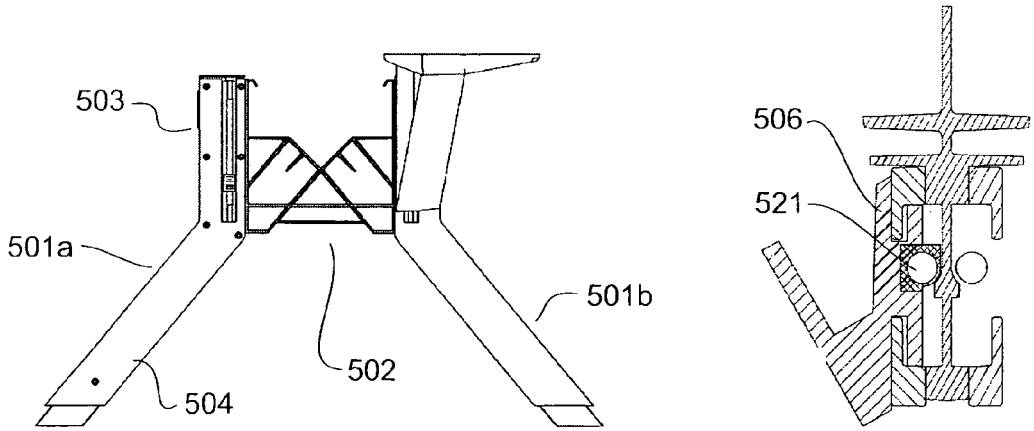
FIG. 5*b* shows a plan cross-sectional views of the leg support.
Figure 5C:
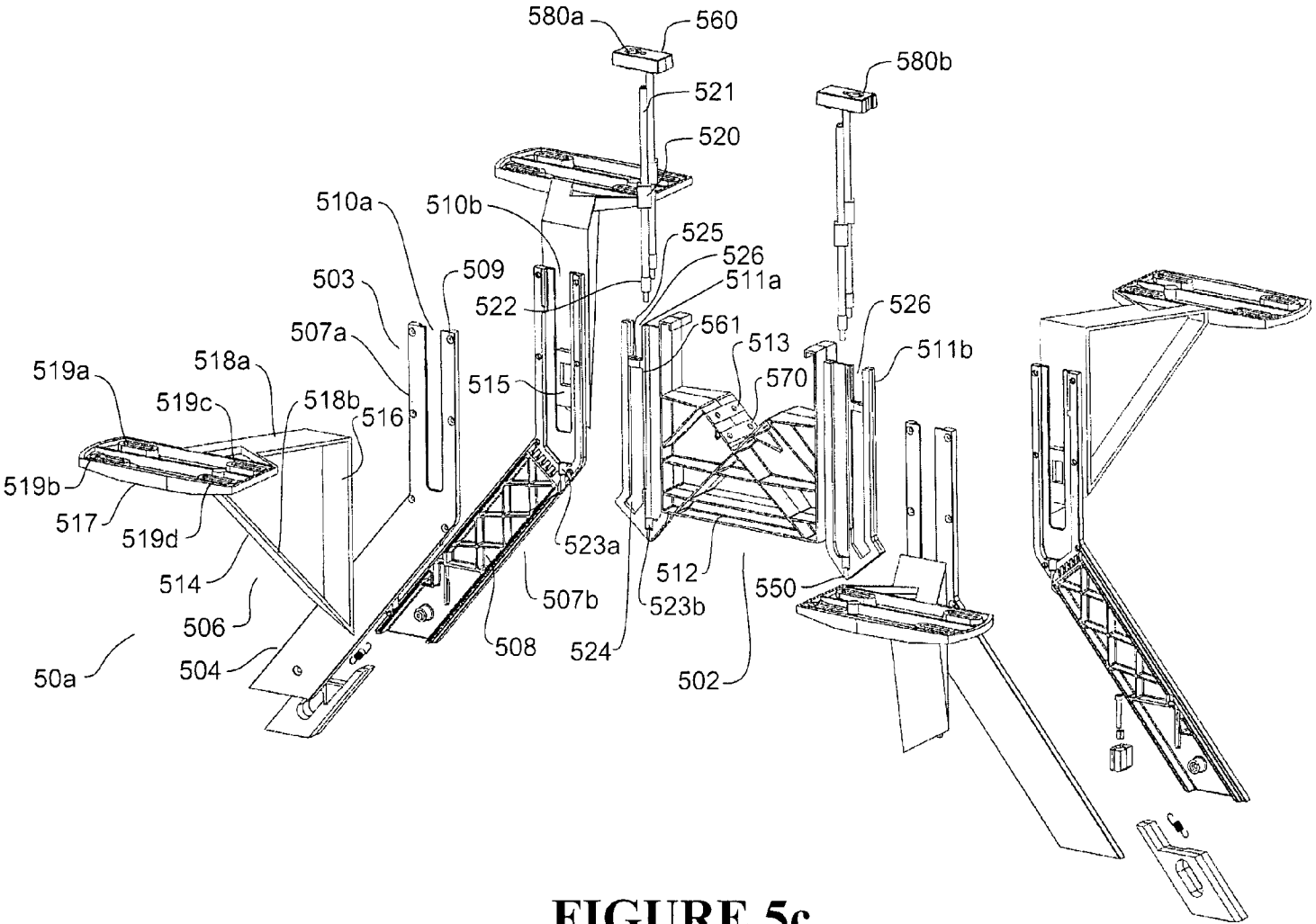
FIG. 5*c* shows an exploded perspective view of the leg support.

The construction of the leg support will be described in more detail with reference to FIGS. 5*c* and 5*d*. It will be appreciated that a number of the features in the leg support are replicated. For clarity only one occurrence will be described. It will be appreciated by those skilled in the art that the description will relate to other occurrences of the feature. As can be seen, threaded rods 521 are provided for corresponding desk support 506. The leg support can comprise up to four desk supports e.g. 506 as shown in FIG. 5*c*. A single desk support will be described with reference to the various visible portions of the four depicted desk supports. It will be appreciated that each desk support means contains the same features. The leg support 501*a* comprises two opposing plates 507*a*, 507*b* angled to form the upright 503 and angled 504 portions of the leg support. Each plate 507*a*, 507*b* includes internal bracing 508, and screw holes, eg 509, for receiving screws (not shown) to couple the plates together. The plates 507*a*, 507*b* also include U shaped slots 510*a*, 510*b* adapted to receive a desk support coupling 515 in a sliding arrangement to allow the desk support 506 to move in a relative linear motion up and down the length of the upright portion of the leg support 503.

Each leg support plate 507*a*, 507*b* is adapted to attach over a joiner bracket 511*a*, 511*b* of the beam support member 502. The beam support member 502 comprises a beam support structure 512 with a joiner bracket 511*a*, 511*b* extending vertically either side of the beam support structure 512. The beam support structure includes cross and angular beam networks to provide rigidity and also an angled recess 513 for receiving, supporting and coupling to a workstation support beam 70*a*, 70*b*.

The desktop support 506 comprises a body portion comprising a primary bracket 514 that comprises a slidable coupling 515 for slidable engagement in the channel 510*a*, 510*b* of the leg support. The coupling 515 is attached to one upright member 516 forming the bracket 514. The desktop support 506 further comprises a desktop coupling 517 supported by a cantilever member 518*a* extending from the upright member 516 and an angled member 518*b* extending from the other end of the upright member 516. The desktop coupling 517 is moulded to include four elongated bolt holes 519*a*-519*b* through which bolts can be located to couple the desktop support to a corresponding desktop.

The leg support coupling 515, which is slidably received in the channel 510*a* or 510*b* for leg support, is adapted to attach to a threaded portion 520 (seen in FIG. 5*a*) or height adjust nut through which an elongated threaded rod 521 can be engaged.

A bottom end 522 of the threaded rod 521 is adapted to be engaged in an semi cylindrical recess positioned at the bend in the leg support 523*a*-523*b*.

The joiner brackets 511*a*, 511*b* positioned either side of the beam support member 512 comprise a flange extending from the beam support member, the flange being die cast to include an elongated channel 524, an upper cross member 525 and a U shaped opening 526. The bottom portion of the flange is angled commensurate with the angle between the upright 503 and the angled 504 portion of the leg support. The bottom of the flange includes a semi cylindrical recess 523*b* on each side which is adapted to abut against the corresponding semi cylindrical recess in the leg support plate, e.g. 523*a* to provide an aperture for receiving the end 522 of threaded rod 521. It will be appreciated that the semi cylindrical recess 523*b* actually corresponds to a semi cylindrical recess on the plate 507*a* which is hidden in FIG. 5*c*, and another recess on the other side of the flange is adapted to correspond to the depicted recess 523*b* on the leg plate 507*b*.

Figure 5D:
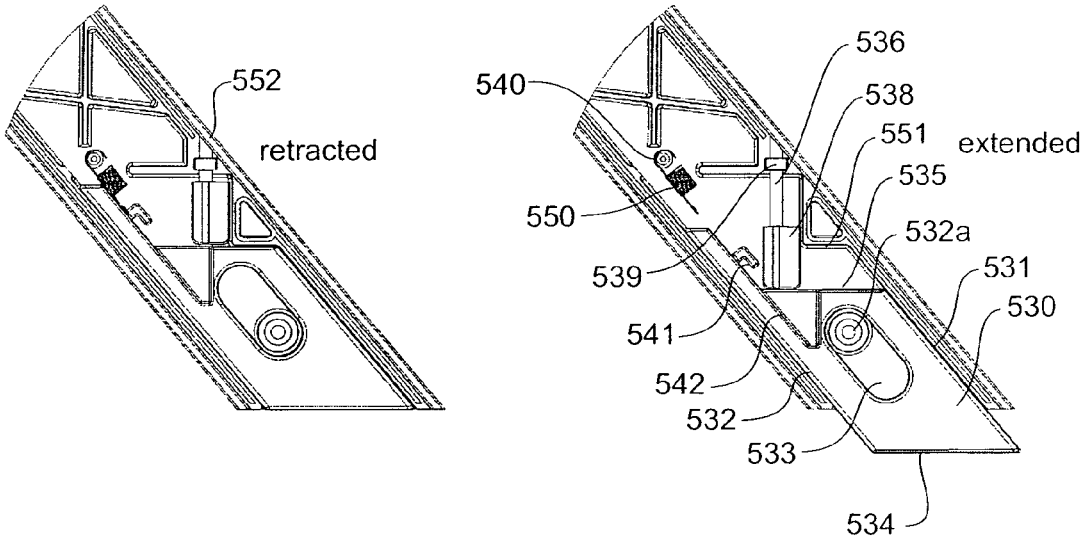
FIG. 5*d* shows further detail of a foot portion of the leg support in extended and retracted positions.

The leg support means includes a levelling foot 530 as shown in FIG. 5*d*. The foot comprises two halves which are drawn together as shown in FIG. 5*c*. The levelling foot 530 is adapted to slide to retract into and extend from the inner portion of the leg support plates 507*a*, 507*b* to provide some levelling adjustment means for a workstation system 1 comprising the leg supports 50*a*-50*c*. As can be seen in FIG. 5*d*, the foot levelling portion 530 has a generally parallelogram shape where they first surface 531 and a second surface 532 adapted to slide on inside surfaces of the leg support plates 507*a*, 507*b*. One leg support plate, eg 507*b*, of a leg support comprises a bearing 532*a* adapted to protrude through an elongated aperture 533 in the foot 530. The combination of the bearing 532*a* and elongated aperture 533 provide a limit to the extent to which the foot can retract and extend or slide within the plates 507*a*, 507*b* of a leg support. The foot 530 also comprises a bottom surface 534 for resting on the ground and a top surface 535 for abutment against an adjustment means housed in or assembled in the leg support. The adjustment means includes a levelling adjuster screw 536 comprising a threaded rod which extends into a levelling block nut that sits within a foot levelling block 538. The adjuster screw 536 is also threaded through a threaded nut 539 attached to the leg plate. A tensioning spring 550 or other bias means is attached between an anchor point 540 on the leg plate 507*b* and a hook portion 541 extending from an elongated side 542 of the foot 530. FIG. 5*d* shows the spring in both an attached and an unattached position on the hook 541. In normal operation the spring is attached. The spring biases the foot 530 such that it slides towards and abuts against the foot levelling block 538 to retain the foot in a desired position as adjusted by the adjuster screw 536. Assembly of the leg support will now be described with reference to FIGS. 5*a*-5*d*. The threaded rods 521 are assembled in the semicircular channel 561 extending down the length of each side of the flange 511*a*, on each respective side of the beam support 512. When in place the collars eg. 522 sit within the respective semi cylindrical recess eg. 523*b*. The leg plates 507*a*, 507*b* are sandwiched either side of the flange 511*a*. At this point the foot and associated components in 5*d* are also assembled in the lower portions of the leg plates 507*a*, 507*b*. The leg plates are then brought together and secured together with screws through screw holes 509 to secure the assembly in place. This is then repeated for the other flange 511*b* of the beam support 502. The couplings, eg 515 of the desktop support 506 is inserted in the respective U channels 510*b* and slid into position and engaged with the height adjust nut 520 of the respected threaded rod 521. The end caps are then placed over the assembled leg plates and beam support. The leg support is then ready for attachment to a beam and also the desktop supports are ready for attachment to the respective desktops.

When all components of the leg support are assembled, an end cap can be placed over the top of the leg support plates for closure. The end cap 560 comprises an opening for a rod for supporting a work top.

The adjustment mechanisms of the leg support 50*a*-50*c* will now be described. It is possible to manoeuvre the desktop support within the channel of the leg support 510*b* to place the desk support, and therefore the attached desktop at a desired height above the ground. This is achieved by rotating the respective threaded rod, eg. 521 to move the desktop support in a linear manner up and down relative to the leg portion. As the threaded rod is threadably engaged with the coupling 515 and because the coupling is retained and prevented from rotational movement in the channel 510*b*, rotation of the threaded rod will start a screw action in the screw portion 520 thus creating a linear force to move the coupling and therefore the attached desktop coupling linearly within the channel. Preferably the bottom end of the threaded rod 521 includes a screwdriver coupling or the like (such as flat head Phillips rex, torx or any other suitable coupling). Possible screwdriver couplings 570-575 are shown in FIG. 5*f*. Other types of couplings will be known to those skilled in the art and these are provided as an example. An aperture 550 through the wall of the leg plate near the bend allows access to the end of the threaded rod 521 and the coupling therein. This enables a tool to be inserted into the opening 550 to rotate the threaded rod 521 and adjust the desktop support height accordingly. In a preferred embodiment a rotary hand tool, such as an electric drill or an electric screwdriver with an appropriate bit or coupling corresponding to the coupling at the end of the threaded rod 521 can be used to cause rotation of the threaded rod in the desired direction and therefore adjust the height of the desktop coupling accordingly. A manual winding handle or tool could be used, or an electric motor.

Similarly as shown in FIG. 5*d* the extent to which the foot 530 extends or retracts into or out of the inner portion of the leg support can be set by the adjuster screw 536. Again, the adjuster screw 536 comprises a suitable coupling, such as one of those shown in FIG. 5*f*, in the end that allows rotation of the adjuster screw 536 with a suitable tool. As the threaded adjuster screw 536 is engaged in the threaded nut 538 which is affixed to the leg support, any rotation of the threaded adjuster screw will provide an upwards or downwards force on the foot levelling block 538. Rotation in one direction will provide a downward force which will cause the levelling block 538 to push down on the top surface 535 of the foot 530 which will coerce the foot to slide downwards and extend out of the leg support. The abutment portion 551 abuts to the levelling block 538 to prevent it twisting and therefore it coerce into linear movement upon rotation of the adjuster screw 536. It will do this to a maximum extent as determined by the bearing 532*a* within the extended slot 533. The tension spring 540 keeps the foot level abutted against the levelling block 538 to prevent the foot level slipping out of the leg support to an undesired degree.

Similarly by rotating the adjuster screw 536 in the opposite direction the levelling block will retract upwards towards the top of the leg support. The abutment portion 551 abuts to the levelling block 538 to prevent it twisting and therefore coerce it into linear movement upon rotation of the adjuster screw 536. As the levelling block retracts upwards the tension spring 540 will retain the foot 530 in abutment with the levelling block and in doing so retract the foot 530 into the leg support. The foot will be retracted to a maximum extent as determined by the bearing 532*a* that extends through the elongated aperture 533. The leg support plate 507*b* includes an aperture 552 that allows access to the coupling on the end of the adjuster screw 536 to allow rotation of the adjuster screw as required. Rotation can take place by a manual tool such as a screwdriver or other winding implement, or preferably by an electric drill or electric screwdriver with an appropriate coupling or bit corresponding to that in the adjuster screw. This enables the foot levelling means to be adjusted with an electronic tool. Alternatively a manual wind handle might be provided, or alternatively an electric motor which can automatically adjust the foot 530 upon actuation of the motor to the desired degree.

Preferably the top cap, joiner bracket, leg supports, desktop brackets are made from die cast aluminium. The foot levelling block is made from plastic along with the foot.

Packers might be provided within the leg support to fix the height of the desktop supports if required. The interactive work tables 40, 41 comprise two upright rods eg. 42*a*, 42*b* which are adapted to sit within the aperture eg. 580*a*, 580*b* of the end caps of the leg support 506. When the rods 42*a*, 42*b* are inserted in the apertures in the end caps the rods rest upon the cross portion eg. 525 thus retaining the interactive work table 40, 41 at a fixed position above the desktop. The rods are shown as cylindrical rods, but they could have an alternative cross-section shape, such as square.

Preferably, the leg supports are coupled towards the back edge of the desktops forming the workstation system, such that the desktops are cantilevered out from the leg supports.

The leg support described above relates to that used in a multi workstation configuration. As mentioned above with reference to FIG. 1*c*, it is possible for the present invention to comprise just one workstation comprising just one desktop supported on a support structure. In this case the support structure comprises two leg support assemblies connected by a beam. In this case the leg support comprises one angled leg portion 501*a* as shown in one straight leg portion (FIG. 5*e*) coupled together by the support member 502. In this manner, a desktop can be supported against a wall or the like. In one possibility, the leg supports are position to the back of the single desktop and the desktop cantilevered out from the leg supports. Similarly, two desktops could be arranged as described in relation to FIG. 1*c*.

Figure 5E:
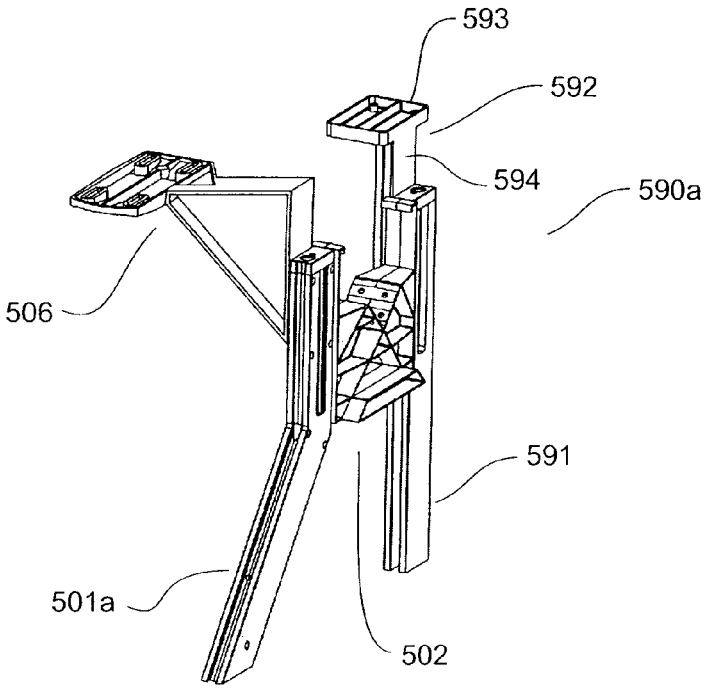
FIG. 5*e* shows a second embodiment of the leg support.
Figure 5F:
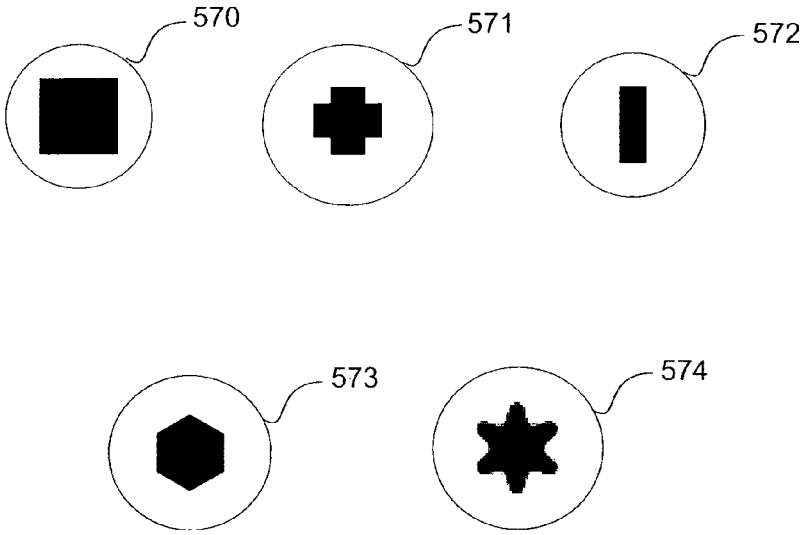
FIG. 5*f* shows five possible embodiments of a coupling for the threaded rod and adjustable screw.

FIG. 5*e* shows of the leg support, eg 590*a*, that could be used in the one and two desktop workstation systems instead of the leg support 50*a*. Most features of the support 590*a* are the same as those described for leg support 50*a*. Only the differences will be described. All other features can be assumed the same. Attached to one beam support 502 is an angled leg portion 501*a*. Attached to the other side of the beam support 502 is a straight leg portion 591. This comprises two plates and is formed in exactly the same manner as the angled leg portion described with reference to FIG. 5*c*, and has the same features. The difference is that instead of having an angled leg portion 504, the straight leg portion 591 has a straight portion 503 that continues to the ground without angling. This enables the straight leg portion 591 to abut against a wall or similar. The internal features of the plates and leg portion 591 are the same as those for the leg portion 501*a* with the angled end 504.

The desktop support of the leg support 590*a* might be the same as that for the first embodiment of the leg support 50*a*. Alternatively, another support 592 could be provided. This is similar to the desktop coupling 506, except that the body portion does not comprise an angled primary bracket 514. Rather, the desktop coupling 593 is attached directly to an upright portion 594 coupled to the leg portion 591. The desktop support 592 is coupled to the leg portion 591 in the same manner as the other desktop support 506, namely via threaded rod.

Figure 7:
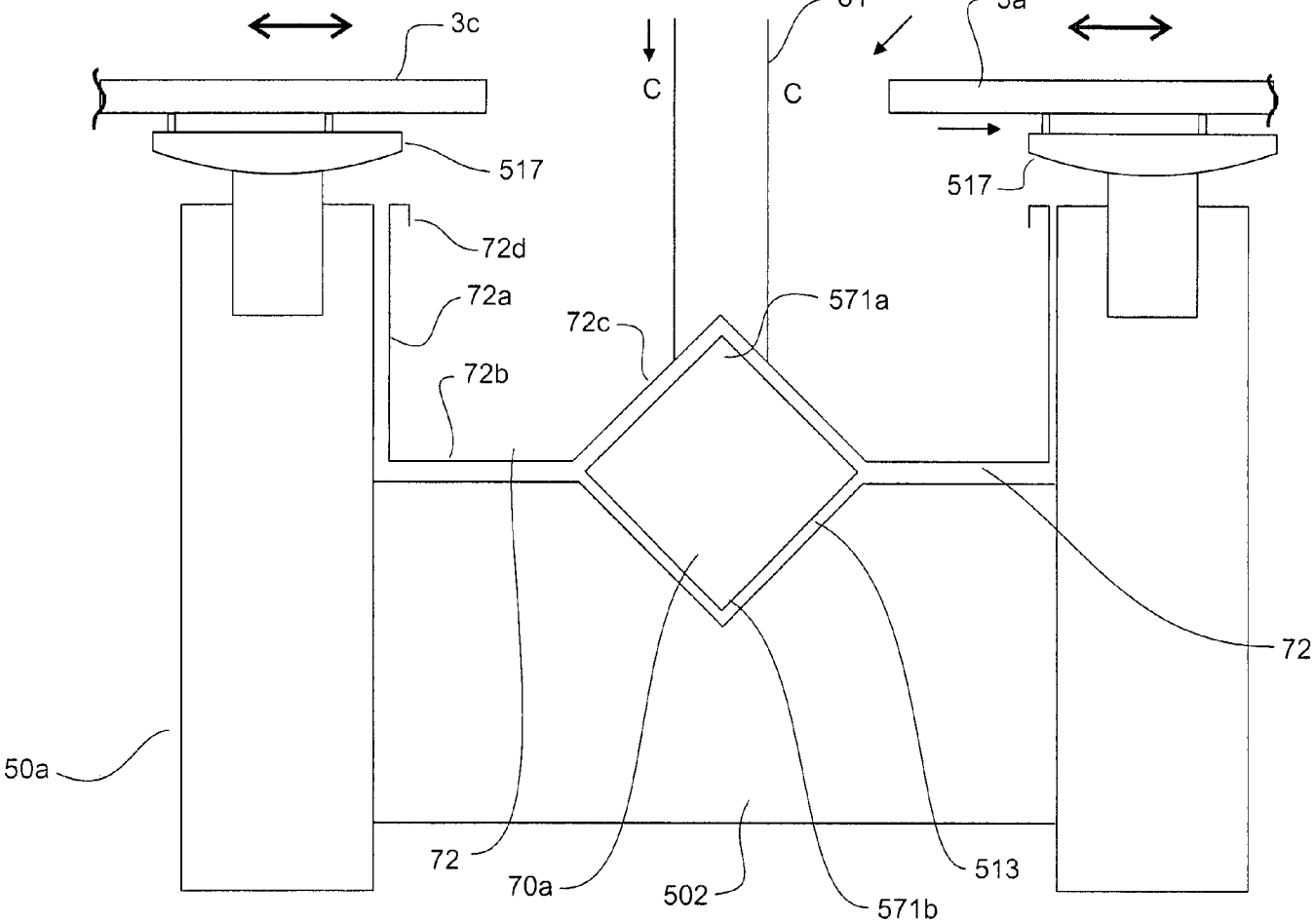
FIG. 7 shows in an end view of a leg portion in which the central beam is engaged with the leg portion.

The beam 70*a*, 70*b* of the support structure will now be described with reference to FIGS. 2*a* and 7 as mentioned previously beams 70*a*, 70*b* extend between the leg supports 50*a*-50*c* to retain them in the upright position. Preferably the beams are constructed of a square or rectangular sectioned steel beam or the like and they are rotated such that two opposite edges of the square section 571*a*, 571*b* lie substantially vertically aligned as shown in FIG. 7. Having the beam aligned in this manner provides additional rigidity in the support structure 2. The beam sits in the recess portion 513 formed in the beam member 502 of the beam support. The recessed portion is angled commensurate with the square angle of the beam. The beam is coupled to the recess portion 513 bolts, rivets or otherwise that protrude through apertures in the beam (seen in FIG. 7) and corresponding apertures 570 (seen in FIG. 5*c*) in the two faces of the recess portion on the beam support. Each beam end is coupled in this manner to a leg support. Each beam end only extends half way onto the thickness of the recess portion in the beam support to allow for another corresponding beam section to be attached for another portion of the workstation system. In a possible embodiment, a single length of beam could be used, however it is preferable that beam lengths are kept to one per set of leg supports to retain the modular nature of the system. As shown in FIG. 1, three sets of leg supports 50*a*-50*c* are retained to provide support for up to four workstations by way of two beam sections. The first beam section extending between leg support 50*a* and 50*b*, and the second beam section extending between legs 50*b* and 50*c*.

A channel section forming a cable tray 72 can be attached to the length of a beam. The cable tray is for retaining cabling for networking, communication, power and the like. The cable tray comprises a cross section including an upright barrier 72*a*, a floor portion 72*b* and an angular anchor portion 72*c* for attachment to the rotated beam 70*a*. The barrier 72*a* might also include a overhang or lip 72*d* if required. The cable tray can be attached to the beam by the anchor 72*c* in any suitable manner such as with bolts, rivets or the like. Another cable tray can be attached to the other side of the beam if required and likewise additional cable trays can be attached to additional beams to provide a conduit or similar channel for cables and the like for the entire length of the workstation assembly. The cable tray might have end caps splines to receive cables etc and feed them into the channels from the ceiling or floor. There may be clips on the back leg support that run cable up into the channels. Lower parts of the end caps may have openings.

As shown diagrammatically in FIG. 7 the desktops 3*a*, 3*b* are coupled to the desktop supports in a manner to provide slidability to enable access to the cable trays. Preferably this is by way of the elongated slots in the desktop support. In a first position shown in FIG. 7 *a* the desktop bolts (not shown) or other couplings that couple the desktop through the elongated slots on the desk supports 506 can be loosened to allow the desktop to be slid within the elongated slots 519*a*-519*d*. The desktop can then be pushed to the full extent to the centre c of the support structure 2 such that the desktop covers or substantially covers the cable tray 72 and the cables within the cable tray. The desk might not slide fully to the centre and leave a gap as shown. The bolts or other couplings can then be tightened or locked off to retain the desktop in this position. When access to the cables and cable tray is required, the couplings can be loosened and the desktop slid on the couplings within the elongated slots of the desktop support to a second position (see desktop 3*c*) shown in FIG. 7 whereby the desktop 3*c* is slid away so that it only partially covers or completely uncovers the cable tray channel. This then allows access to the cables therein. Once the access is no longer required, the desktop can be slid back into its normal working position and secured in place.

Figure 8:
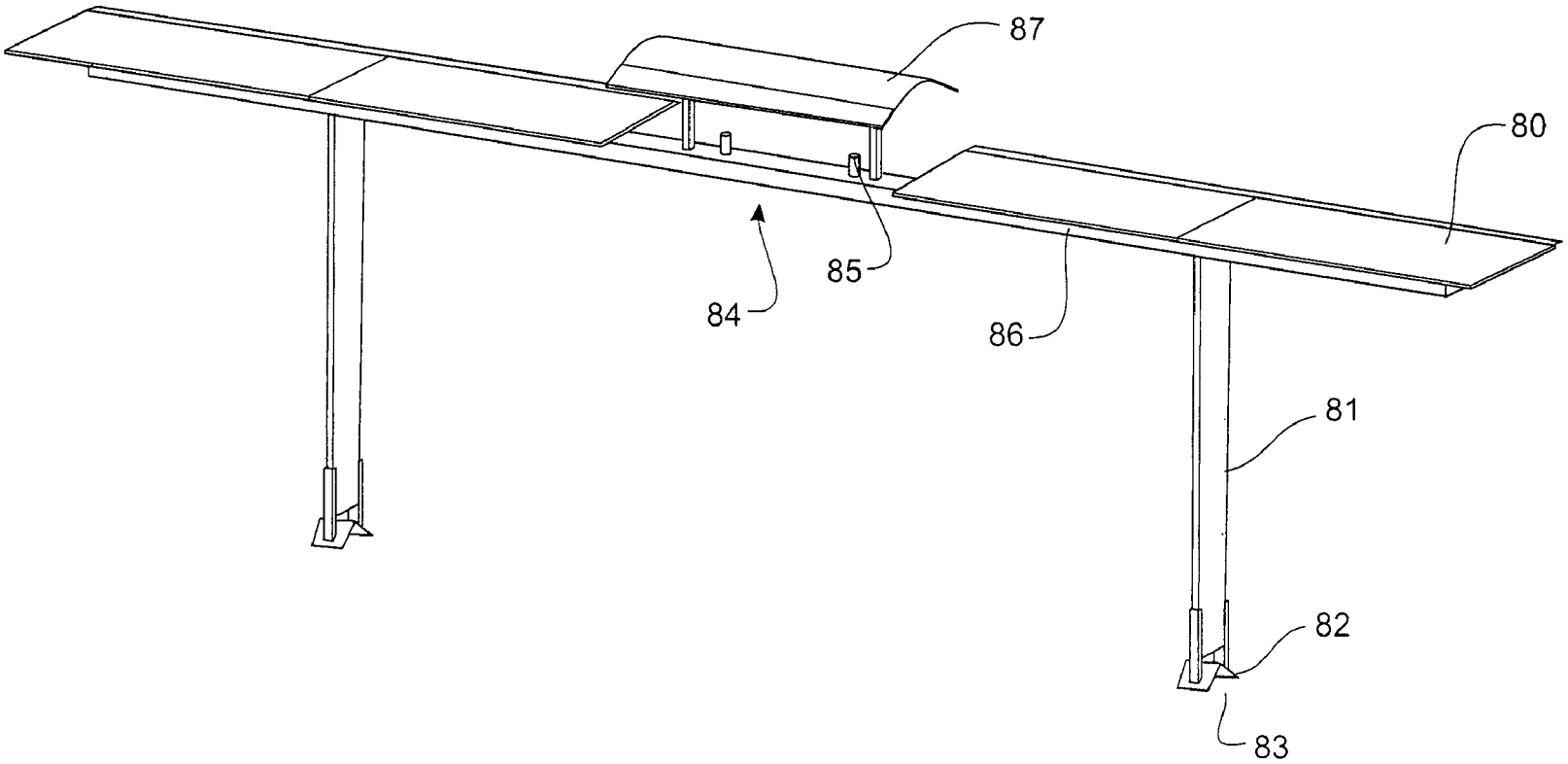
FIG. 8 shows an overhead services beam adapted for attachment to a support structure workstation.
Figure 9C:
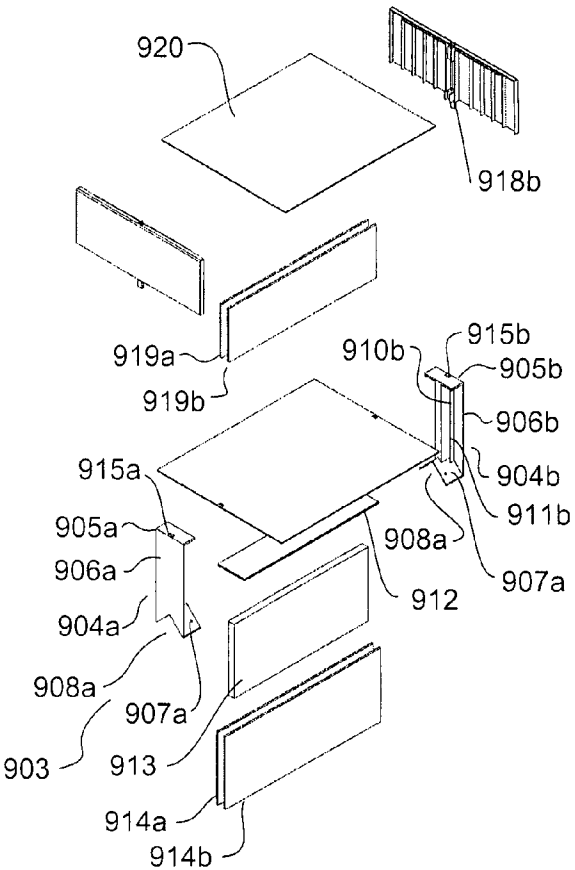
FIGS. 9*a*-9*e* show various views of the shelves for attachment to the workstation system
Figure 9B:
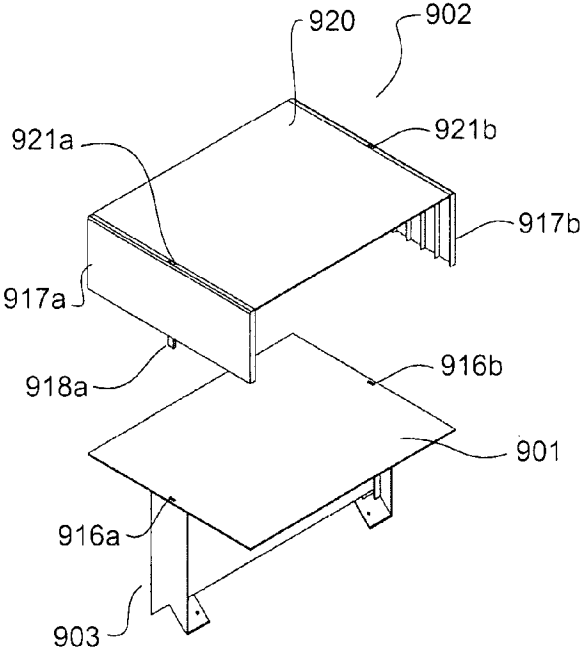
Figure 9A:
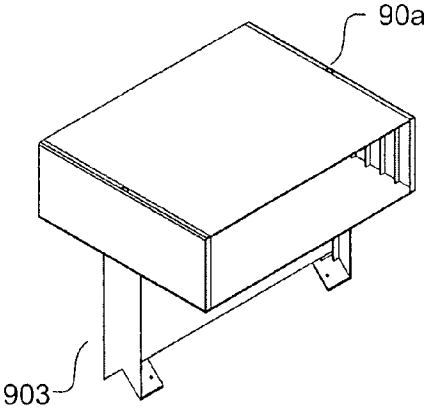
Figure 9D:
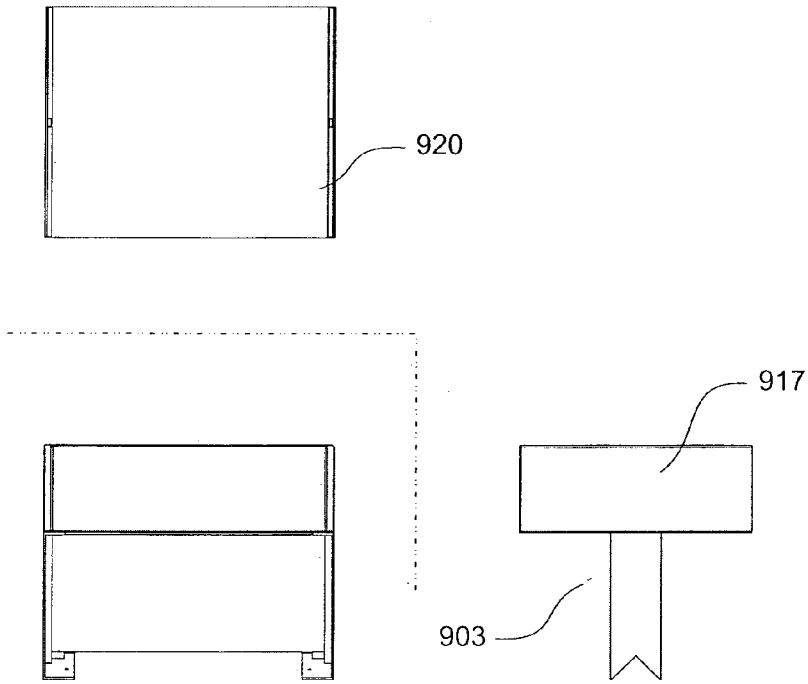
Figure 9E:
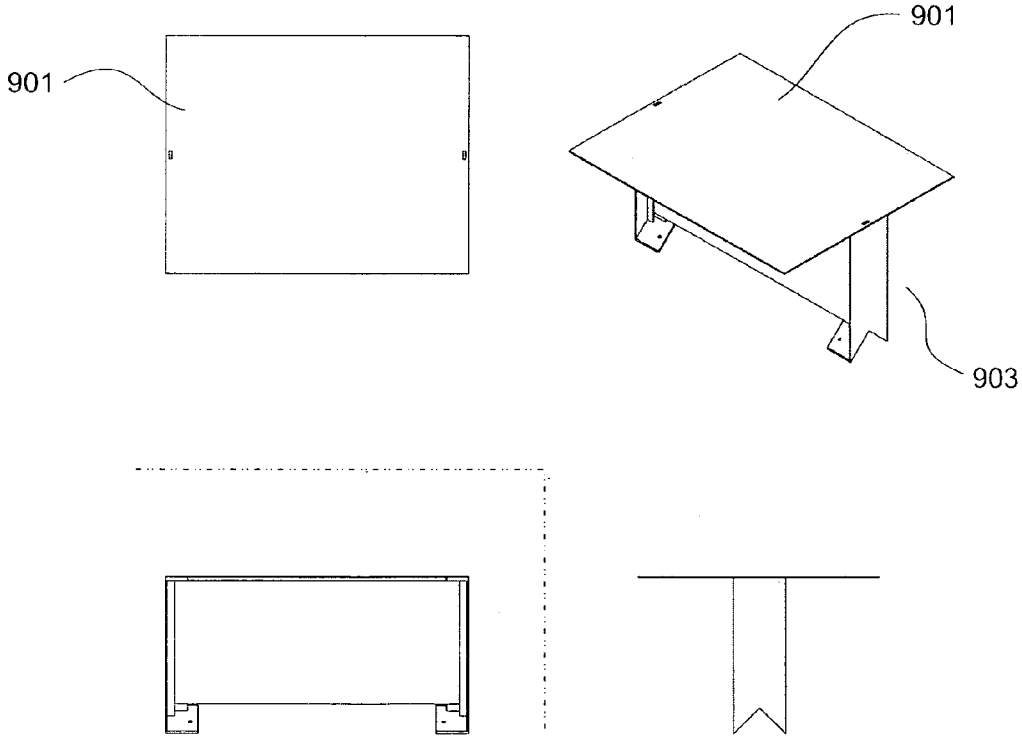

FIG. 8 shows the overhead services beam or support 80 for use in the workstation. The overhead services beam 80 is supported on two vertical uprights 81 that are preferably aluminium extrusions. Each vertical upright comprises an attached foot component 82 that includes a v section recess 83 corresponding to the shape of the tilted support beam 70*a*. The foot section 82 with the recess 83 is adapted to rest on and be attached to the beam through bolts, rivets or other fasteners. Preferably each upright comprising vertical element 81 and the foot 82 is positioned centrally on the beam 70*a* between two leg supports. The overhead services beam 80 comprises a cross portion 84 that sits across and attaches to at least two upright portions 81. The cross portion 84 includes a number of upright protrusions for example 85 onto which shelving, cabinets or other storage modular accessories can be attached. In FIG. 8, a flat terrace or shelf 86 is shown. The modular accessory preferably is the same as those used and supported above the desktops such that the modular accessories can be interchanged between or used on the overhead services beam 80 and also supported above the desktop.

The overhead services beam can also include a lighting canopy 87 that is supported on protrusions 86 extending above the modular portions: The lighting canopy 87 contains LED integrated lighting or other light source for illumination of one or more workstations. Preferably the lighting canopy 87 is curved to diffuse and direct the light in the appropriate manner. Power for the lighting in the canopy can be provided by way of cables running through the cable tray 72 up through the vertical supports 81 and along the horizontal support 84. As can then seen a number of modular accessories, such as shelves, and/or also the lighting canopies can be attached at various positions along the overhead services beam as required.

FIGS. 9*a*-9*e* show various views of one possible modular accessory that can be used in the workstation system T. In this case, the modular accessory is a storage cabinet or shelf, such as 90*a* shown in FIG. 1. Accessories 90*b*-90*d* have the same construction comprising a bottom surface shelf or terrace 901 and a top elevated terrace or shelf 902. The modular accessory 90*a* comprises a support portion 903 which is visible in exploded form in FIG. 9*c*. The support portion includes two upright supports 904*a*, 904*b*. Each support includes a top end 905*a*, 905*b* an upright portion 906*a*, 906*b* and a lower foot 907*a*, 907*b* that is fashioned as a angled recess 908*a*, 908*b* for engaging with the rotated main beam 70*a*, 70*b*. With reference to upright 904*b* the inner face of each upright portion comprises a central column (910*b* being visible) extending from the apex of the angled recessed 908*b* foot to the top end 905*b* to provide rigidity in the structure. Either side of the central column 910*b* is a retention flange (911*b* being visible) extending between the foot 907*b* and the top end 905*b* and extending some way from the upright portion. The support 903 also comprises a top cross member 912, a central panel 913 and two outside panels 914*a*, 914*b*. Each top end of 905*a*, 905*b* comprises an aperture 915*a*, 915*b* for connection to protrusions of upper components of the modular accessory. The support 903 is assembled by placing the central member 913 between the corresponding column supports eg. 910*b* of the uprights 906*a*, 906*b*. The twin outer panels 914*a*, 914*b* are slotted between their respective flanges, eg. 911*b* and the central column eg 910*b* and between the two uprights 904*a*, 904*b* to retain the centre panel 913 in position and provide a central panel assembly between the two uprights. The cross member 912 then sits on top of the central panel assembly between the top ends 905*a*, 905*b* in abutment. The support member components are retained in place by a friction fit or other suitable means.

By way of the angle recess foot members 908*a*, 908*b* the support is adapted to engage along the tilted main beam 70*a*, 70*b* and be attached thereto. This provides an upright support that extends from the main beam 70*a*, 70*b* between the back edges of two opposing arranged desktops to provide a support for modular accessories to be supported above the desktops.

A number of these supports portions 903 can be arranged along the length of the beam or beams 70*a*, 70*b* of the workstation system providing multiple installation points for modular accessories such as accessories 90*a*-90*d* shown in FIG. 1. In the preferred embodiment, the support members are provided all along the length of the beam thus filling in the space between the back edges of adjacently desktops arranged in an opposing manner. The apertures 915*a* and 915*b* and each upright support provide a mounting point for corresponding protrusions in components of modular accessories or modular accessories themselves. The protrusions and apertures in each case form a coupling. This allows a range of different modular accessories to be interchanged and installed in the workstation.

In one embodiment of a modular accessory 90*a*, a lower terrace 901 that comprises a flat panel and apertures 916*a*, 916*b* corresponding to the apertures 915*a*, 915*b* in the uprights 906*a*, 906*b* is arranged in alignment with the apertures on the uprights. An elevated terrace 902 is then attached to the lower terrace 902 and the support. The elevated terrace comprises two side panels 917*a*, 917*b* each comprising a protrusion 918*a*, 918*b* adapted to be received in the apertures 915*a*, 915*b*, 916*a*, 916*b*. A back panel 919*a*, 919*b* is attached between the side panels 917*a*, 917*b* and a top panel 920 attached to all three components. The elevated terrace 902 can then be assembled by inserting the protrusions 918*a*, 918*b* into the apertures 915*a*, 915*b*, 916*a*, 916*b* thus attaching the top terrace 902 to and through the lower terrace 901 and to the support 903. The components clip into place to provide a storage cabinet or area. The terraces 902, 903 can be attached to the support 903 after it has been installed on the beam 70*a*, 70*b* in the workstation system. Alternatively, it can be installed as one unit. It will be appreciated that various configurations of the unit 90*a* is possible. The bottom terrace 901 could be omitted, and likewise the top terrace 902 omitted so that only a flat panel shelf is provided. Yet other modular accessories are also possible such as shelves, cabinets and cupboards.

The top panel 920 comprises additional apertures 921*a*, 921*b* for receiving additional modular assembly protrusions. In this manner multiple levels of the modular assemblies eg. 90*a* can be attached and stacked up on the support 903.

In general, each modular accessory includes protrusions on the bottom portion to engage with corresponding apertures in a support eg. 903 or apertures in the top surface of another modular assembly or component of a modular assembly. Likewise the top of each modular accessory includes apertures that correspond to and can engage with corresponding protrusions with other modular accessories. Modular accessories can also include shelves, cupboards, cabinets, screens and the like.

Figure 10A:
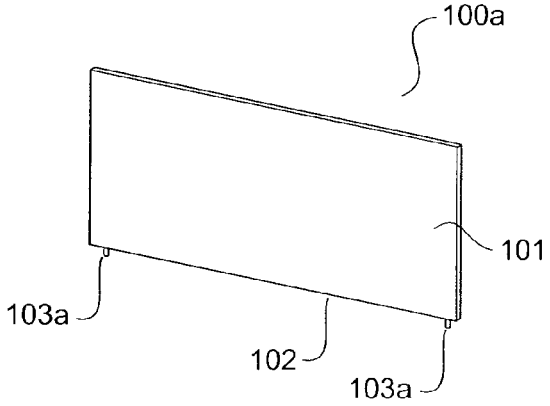
FIGS. 10*a* and 10*b* show two possible screens for use with the work system

The workstation system 1 preferably comprises one or more screens 100*a*, 100*b* that are adapted to provide a degree of privacy between workstations. FIG. 10*a* shows one possible embodiment of such a screen which provides complete visual blocking. The screen comprises a flat panel 101 which is opaque and produced from a suitable material such as plastics, wood product, pressed sheet metal or the like. The panel includes a lower edge 102 with two protrusions 103*a*, 103*b* that are adapted to be received in the apertures 915*a*, 915*b* of a support 903 as described in relation to FIGS. 9*a*-9*e*, or alternatively into the corresponding apertures 921*a*, 921*b* of a modular accessory, such as the elevated terrace 920 shown in FIGS. 9*a*-9*e* which are attached to a support 903. In this manner a number of the screens 100*a*, 100*b* can be assembled along and between the back edges of desktops 3*a*-3*d* that are arranged in an opposing relationship. This provides some degree of privacy for the users of those desktops from the person sitting opposite. The screen can be provided of any suitable height, width and length to provide the required degree of privacy.

Figure 10B:
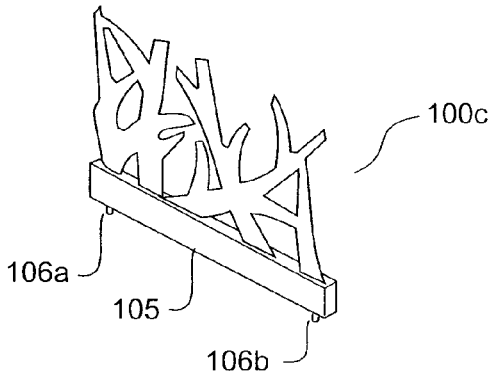

FIG. 10*b* shows an alternative embodiment, which is a selective or variable visibility screen 100*c*, 100*d*. Depending on the focal point of the person, the degree to which vision extends through the screen can be altered. This provides the ability to partially provide privacy, but also provide the opportunity to communicate with someone sitting the other side of the screen 100*c*, 100*d*. The full details of the variable visibility screen are described in relation to the US patent application "A Screen" filed on 6 Oct. 2006 with the same assignee. The specification of this US application is incorporated herein by reference in its entirety. The variable visibility screen 100*c*, 100*d* comprises a base portion 105 with protrusions 100*a*, 100*b* for installation in the apertures of a support, or the apertures of the top surface of another modular accessory as described previously. It would be appreciated that yet other types of full screen and variable visibility screens could be used, and any combination of them could be used along the math axis of the workstation.

In one possibility, the interactive worktops 40 between desktops could be replaced with opaque or variable visibility screens as described above. In this case, the screens would be adapted with rods the same as those described for the worktops 40, 41. These could insert in the end caps in the leg supports to support the screen at a suitable height to provide privacy between co-workers working at adjacent desktops.

Second Embodiment

FIGS. 11-15 show a second embodiment of a workstation according to the invention. The first embodiment relates to a workstation system with desktops that comprise a straight back edge and can be arranged in a back-to-back and/or side-to-side relationship.

The second embodiment relates to a workstation system 110 in which up to three workstations can be arranged in the manner shown. The second embodiment comprises more workstations each comprising a desktop 130*a*-130*c* arranged adjacently and supported on a support structure 120. The support structure comprises a plurality of leg supports 50*a*-50*c* which are identical to the leg supports 50*a*-50*c* described in relation to the first embodiment and need not be described further here. The leg supports are arranged so they are not positioned in the area underneath the primary and auxiliary work areas. This allows a person to sit and work at each of the primary and auxiliary work areas on a chair or the like, and allows the legs of the user to be positioned underneath the primary and auxiliary work areas without obstruction. To support three desktops 130*a*-130*c* the leg supports are arranged in a triangular formation and a first end of a tilted squared sectioned beams 121*a*-121*c* extends from each respective leg support 50*a*-50*c* to a central point of the workstation. The other ends of the section beams 121*a*-121*c* are supported by a stand alone leg 122 comprising three angled recesses for receiving and supporting the other ends of the beams members 121*a*-121*c*. Cable trays eg 122 can be assembled on the beam members 121*a*-121*c* as described in relation to the first embodiment. In addition modular accessories eg. 90*a*, 90*b* can be supported above the desktops 130*a*-130*c* on supports eg 903 along with full 100*a* or variable visibility screens 100*c* as described in relation to the first embodiment.

When attached to respective desktops, each leg support is attached so that it is positioned well clear of the respective primary and auxiliary work areas/work surfaces/working edges of the desktops to which it is attached. This enables a user to sit/stand at the primary and auxiliary work areas without any impediment to their legs. The legs are positioned in any suitable place to accommodate a user's legs under the primary/auxiliary work surfaces. For example, when sitting at a primary or auxiliary work area, the user can sit at the area and have their legs under the respective portion of the desktop. The leg supports might be positioned under the desktops to which they are connected in a suitable position to prevent impediments to users' legs. They might be fully or only partially under the respective desktops. That is, the legs might be positioned at least partially at a position not covered by the respective desktop. Alternatively, they might be positioned "remotely" so they are not covered at all by the desktops, for example by being slightly to the side or back of the respective desktops. In a preferred embodiment, the leg supports will be at least partially covered by the respective desktops to which they are coupled, as shown in the Figures. They will be connected to the desktops via couplings (to be described later) towards the back edge of the desktops, and towards the sides. A leg support might only be connected to one side of a respective desktop. Other arrangements will be possible also that provide free space under the primary and auxiliary work surfaces.

Figure 11:
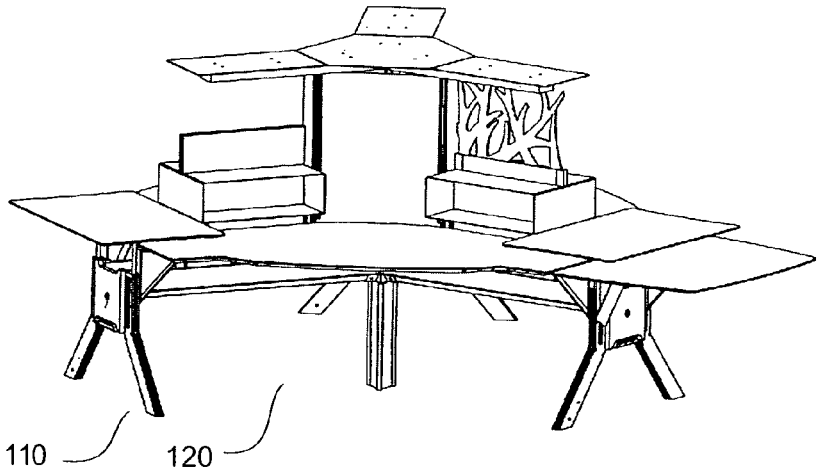
FIG. 11 shows a perspective view of a second embodiment of an assembled workstation comprising multiple workstations.
Figure 12:
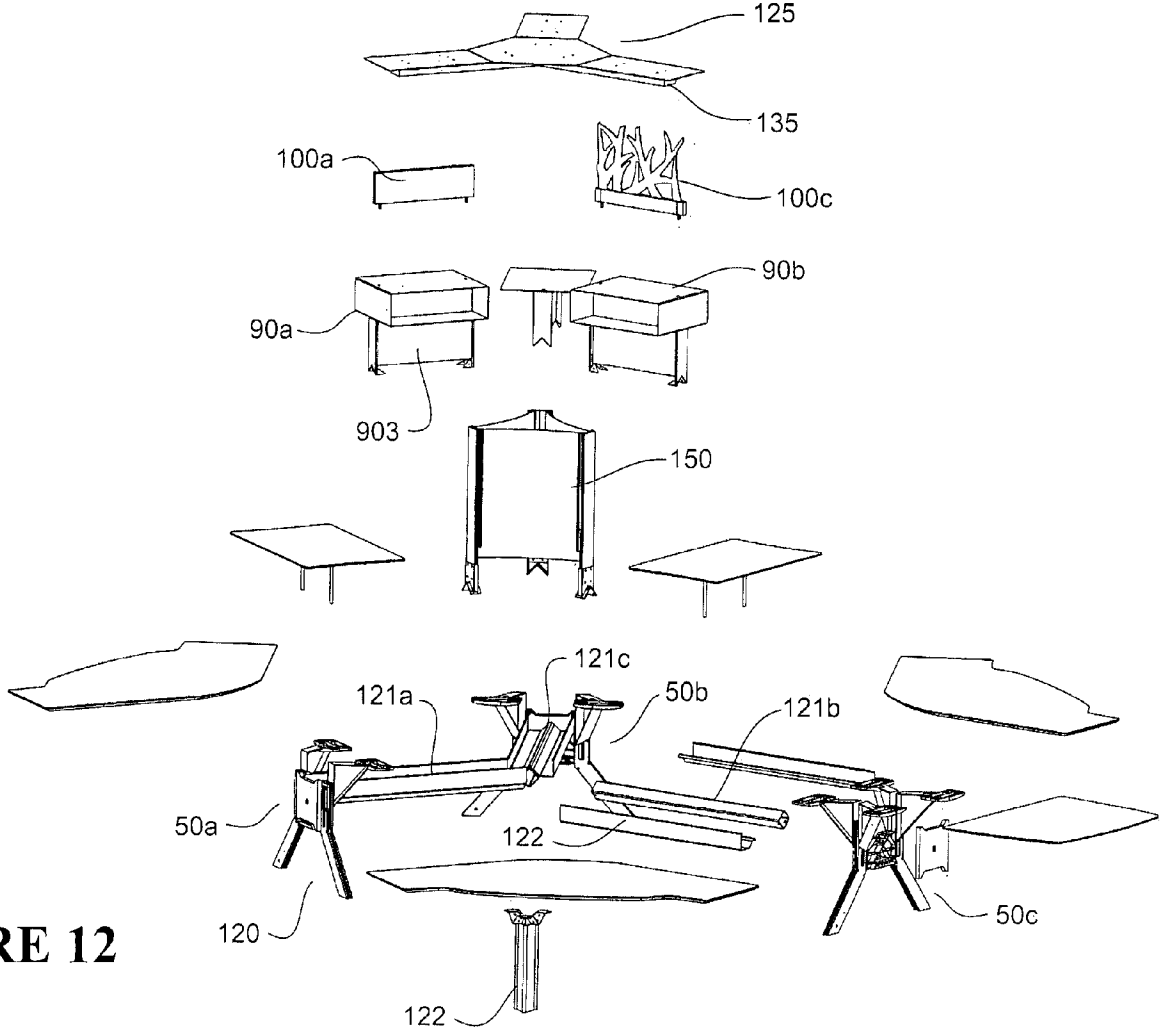
FIG. 12 shows an exploded perspective view of the second embodiment of the workstation system.
Figure 13:
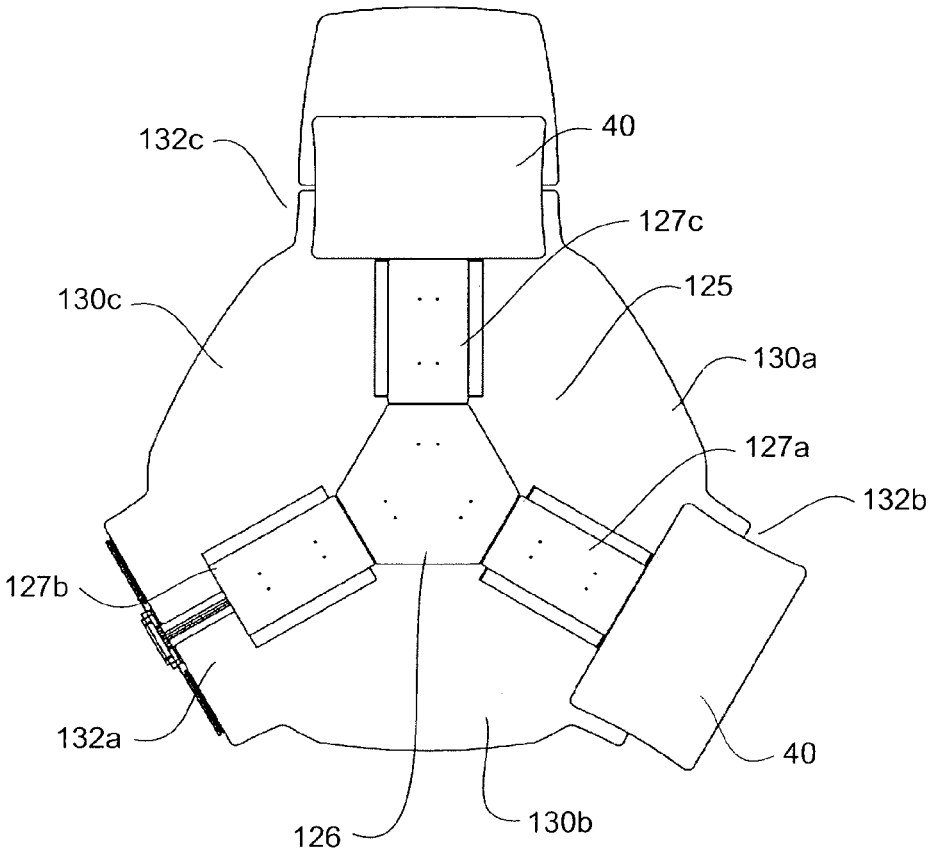
FIG. 13 shows plan, elevation and side views of the second embodiment of the workstation system.
Figure 13:
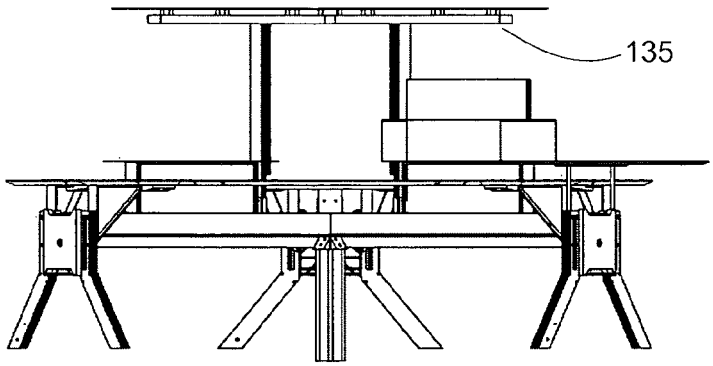
Figure 14A:
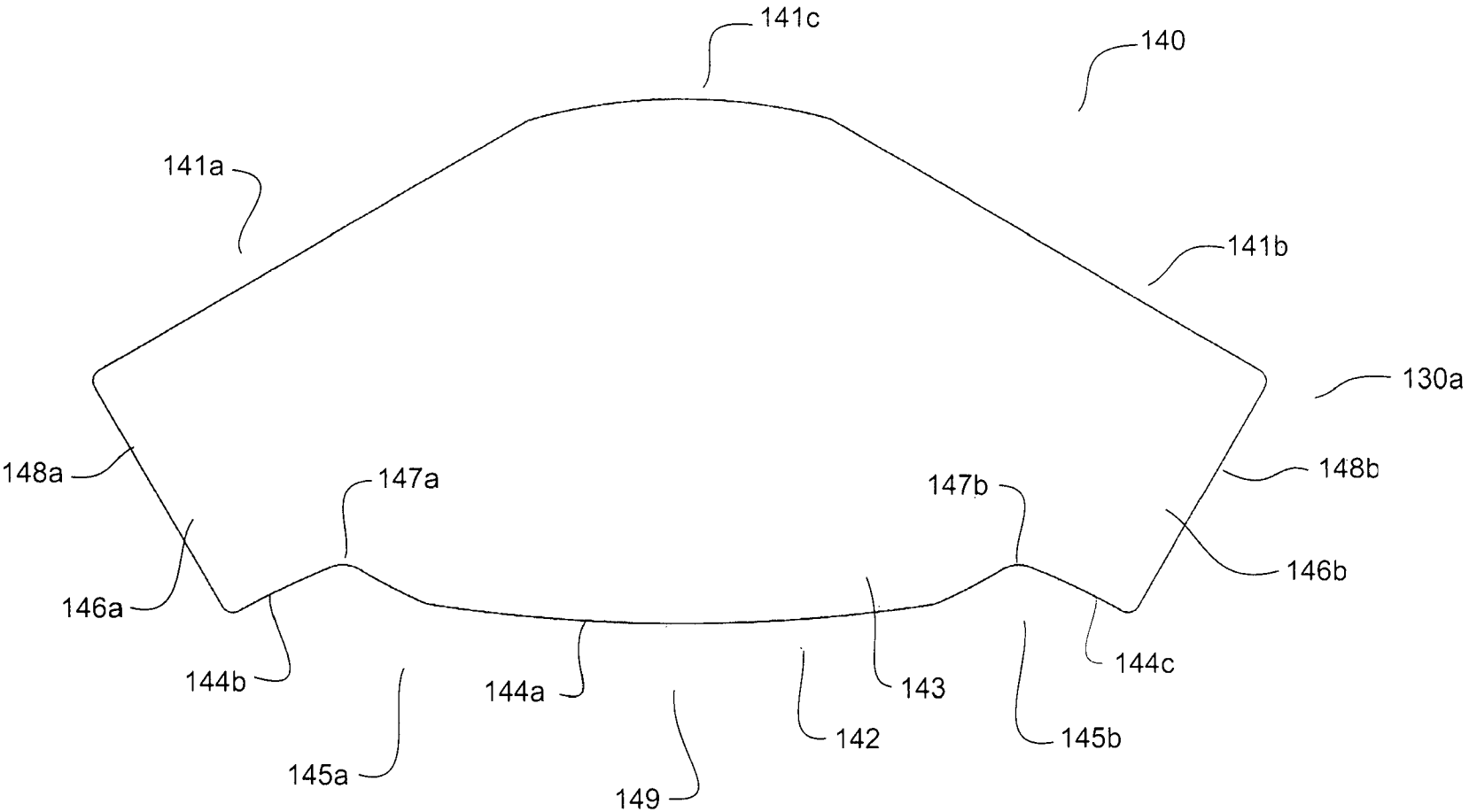
FIGS. 14*a*-14*c* show plan, elevation and perspective views of a possible embodiment of a desk top used in the second embodiment.
Figure 14B:
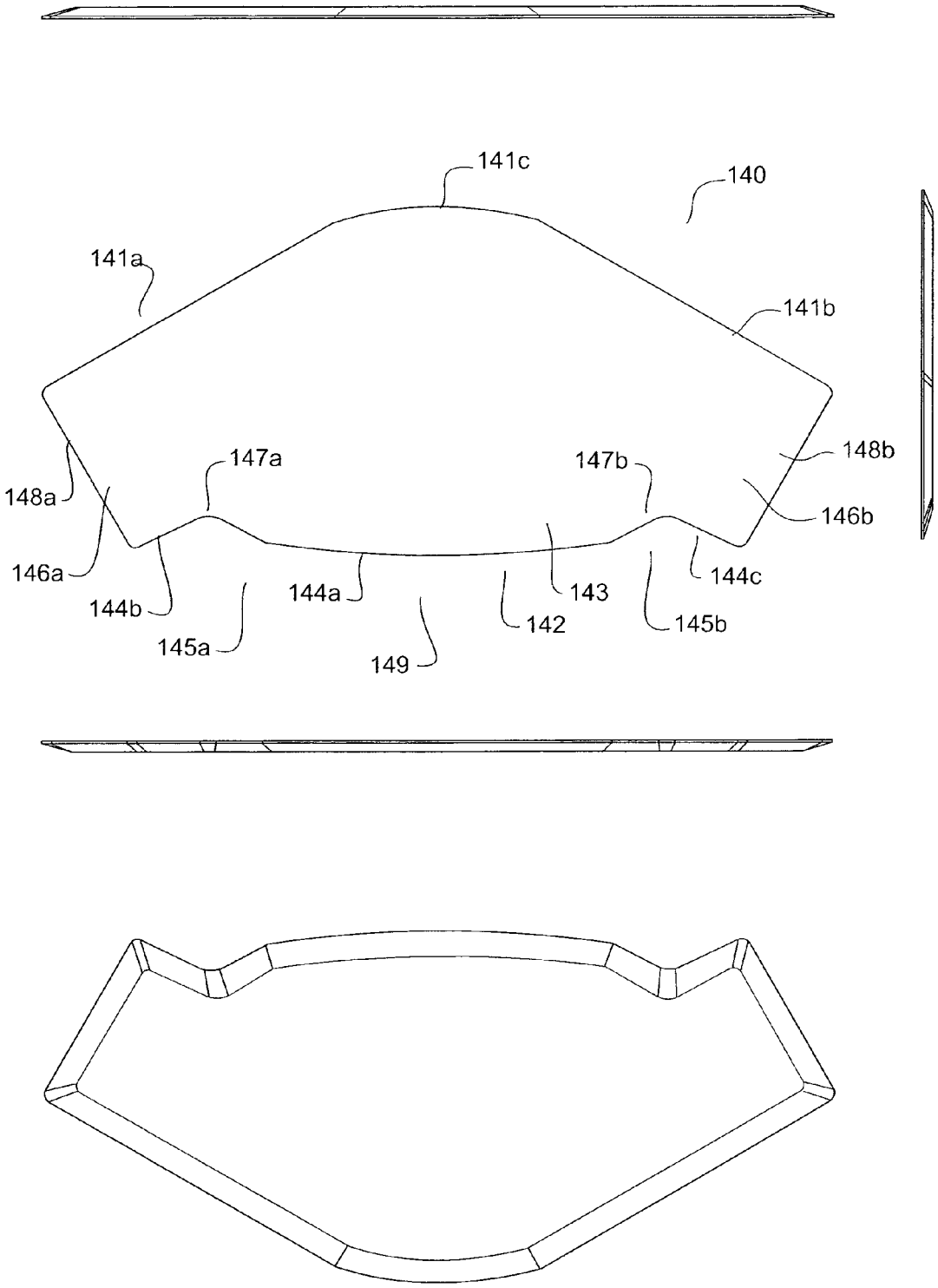
Figure 14C:
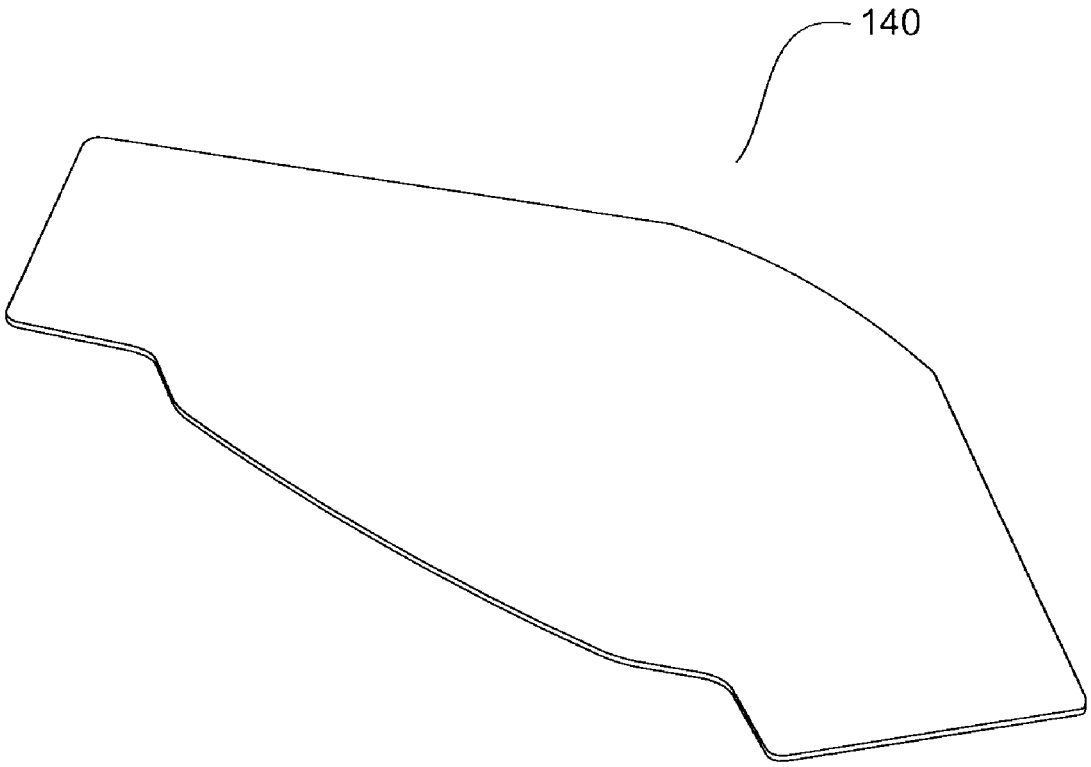

The differences of the second embodiment will be described with reference to FIGS. 11-15. Each workstation of the workstation system 110 comprises a desktop 130*a*-130*c* as shown in FIGS. 13 and 14. The desktop comprises a back edge 140 comprising two substantially flat sections 141*a*, 141*b* arranged at approximately 120 degrees. The intersection between the two substantially straight sections 141*a*, 141*b* is preferably a curved portion, 141*c* although could take any other suitable shape. The shape of the desktop 140 is profiled along the front edge 142 to include a protruding surface 143, preferably substantially arranged in the middle of the front edge 142. The protruding surface provides a first or primary work surface on the desktop 130*a* for supporting keyboard, other equipment, papers, books and the like on which a person can work. The protruding surface 143 is bounded by a first working edge 144, which forms a section of the front edge 142. This is an edge at which a person can sit when utilising the first working surface. The first working edge 144*a*, protruding work surface 143 and/or area in front of the working edge provide a first or primary work area 149 of the desktop alone or in combination. The desktop 140 also comprises two auxiliary work areas 145*a*, 145*b* either side of the first work area, that is, either side of the protruding work surface 143. Each auxiliary work area 145*a*, 145*b* comprises a working edge 144*b*, 144*c* that is not co-linear with the working edge 144*a* of the first work area or protruding surface.

In this embodiment, to achieve this shape the desktop is profiled along the front edge to include two lateral extensions 146*a*, 146*b* positioned either side of the protruding work surface 143. The angle between the working edges of the auxiliary work areas and the working edge 144*a* of the first work area provides a recess or indented portion 147*a*, 147*b* in the desktop where a person can sit. Referring to one of the auxiliary work areas 145*b*, the auxiliary work area comprises a working edge 144*c* set back from the working edge of the protruding surface 144*a* and bounded by a respective side edge 148*b*. The working edge 144*c* comprises one section of the entire front edge 142 of the desktop. Each auxiliary work area of the desktop is adapted to be arranged adjacent a corresponding or auxiliary work area of another corresponding desktop to provide an auxiliary work area pair to form an interactive work area that can accommodate at least two people. The auxiliary work area comprises the auxiliary working edge 144*b*, 144*c*, the area in front of the auxiliary working edge 145*a*, 145*b* and/or the desktop surface 146*a*, 146*b* adjacent near the auxiliary working edge alone or in combination. The desktop surface adjacent the auxiliary working edge provides an auxiliary working surface 146*a*, 146*b*. When the auxiliary working areas are arranged as a pair to form an interactive work area as described above, the corresponding auxiliary working surfaces provide an auxiliary working surface pair.

In a preferred embodiment, the protruding work surface 143 has at least a partially convex front edge 142 which blends into at least a partially convexed auxiliary working edge 144*b*, 144*c* at either side. The first working edge and auxiliary working edges may not be fully convexed and concaved but rather generally of that nature. Alternatively, the first working edge could be straight and comprise square straight sides that are adjacent the straight working auxiliary edges. Many other variations on the general shape are possible. The important feature is that the auxiliary working edges 144*b*, 144*c* are arranged and oriented in a manner such that when arranged adjacently a corresponding auxiliary working area of a corresponding desktop they provide an interactive work area that can accommodate at least two people for interactive work activity.

Referring to FIG. 13, which shows a plan view of the desktops 130*a*-130*b*, the arrangement of the desktops will be described in further detail along with the configuration of the interactive work areas. Each desktop 130*a*-130*c* can be arranged adjacent to at least one other corresponding desktop. Each desktop could be arranged adjacent up to two other corresponding workstation desktops, although this is not essential. In the full configuration shown in FIG. 13, each desktop is arranged on the support structure 120 such that one straight angled section of the back edge 141*a* or 141*b* is arranged adjacent and in an opposing relationship with a corresponding back edge section 141*a*, 141*b* of a corresponding desktop. For example, the left hand back edge 141*a* of desktop 130*b* would be arranged adjacent the right hand back edge section 141*b* of desktop 130*c*. The right hand back edge section 141*b* of desktop 130*b* would be arranged with the corresponding left hand back edge section 141*a* of desktop 130*a*. Finally the right hand back edge section 141*b* of desktop 130*a* would be arranged adjacent and opposing relationship to the left hand back edge section 141*a* of desktop 130*c*.

In this manner one or more collaborative or interactive work areas 132*a*-132*c* can be formed in the desktop arranged in an opposing relationship. The desktops arranged in this manner provide a narrow zone between auxiliary working edges to facilitate closer interaction. This is similar to the first embodiment. While the back edges of the desktops may actually abut, in the preferred embodiment there is a gap between them which provides for a support eg. 903 for modular accessories eg. 90*a* as described previously.

In this manner the desktops are arranged in an opposing relationship such that the auxiliary work areas formed either side of the protruding surface of each respective desktop are substantially or at least partially aligned. They are shown substantially aligned in FIG. 13. In this case the auxiliary work area 145*a* of desktop 130*b* is arranged and aligned in an opposing adjacent configuration with the corresponding auxiliary work area 145*b* of desktop 130*c*. This provides interactive work area 132*a*. Similarly, the auxiliary work area 145*b* of desktop 130*b* is arranged substantially aligned with the auxiliary work area 145*a* of desktop 130*a* to provide interactive work area 132*b*. Similarly, the corresponding auxiliary work areas of desktops 130*c* and 130*a* are substantially aligned to provide interactive work area 132*c*. The interactive work area comprises the lateral extension/recess portions 145*a*, 145*b*, the auxiliary work edges 144*b*, 144*c* and/or the surfaces 146*a*, 146*b* that abut. It might also comprise any interactive work top eg. 40 that is adjacent.

The opposing and aligned work areas, for example, 145*a* of desktop 130*b* with 145*b* of 130*c* provide an interactive work area 132*a* comprising the lateral extensions 146*a*, 146*b* and the seating area arranged by the corresponding auxiliary working edges. This provides an interactive work area 132*a* that can accommodate two people in a face-to-face relationship. The nature of the positioning of the auxiliary work area that is set back from the first working edge 142 enables workers sitting opposite each other to come closer together when working in an interactive relationship. For example, ordinarily office workers would be working at their respective protruding work surfaces, for example 143, on desktop 140. When the workers wish to conduct interactive work they can both move to their respective auxiliary work areas for example 132*a* of desktop and be in a closer arrangement that facilitates interactive work. If a worker sitting at the first working surface 143 on desktop 130*b* wants to work interactively with someone using desktop 130*a*, they can use the interactive work area 132*b* on the other side of the desk to bring themselves into a closer relationship with the other worker.

As described in relation to the first embodiment each of the desktops are independently height adjustable on their respective desktop couplings. This means that two desktops that form a part of an interactive work area might be at different height levels. Therefore as in the first embodiment, a fixed level worktop eg. 40 is provided in the vicinity of the interactive work area eg. 132*b*, 132*c* to provide an interactive work top. An interactive work top 40 such as that shown in FIG. 4*a* can be used. A meeting table end 60 such as that shown in FIG. 6 can also be arranged adjacent the spare end of two adjacent desktops. Further, it would be appreciated that another workstation desk system 110 comprising three workstations can be positioned adjacent the first set of three workstations to provide a workstation system comprising up to six workstations. Yet further additional workstation systems could be positioned or arranged in this manner.

A centre screen 150 can be provided to provide a degree of privacy between workstations. The central screen 150 is shown in FIG. 12 with one panel 151 being shown in FIG. 15. The central screen comprises three upright portions the same as that for the overhead beam support 81. The upright portions 81 are placed in a triangular shape and include three screens 151 which join the upright portions to provide the central screen 150. The uprights are oriented such that the angular recessed portions 83 lie a direction to engage with the respective tilted beam 121*a*-121*c* from each arm of the workstation system 110. When in place the centre screen provides privacy to a certain degree, which can be augmented by additional modular screens eg. 100*a*, 100*c* such as shown in FIG. 11.

In one possibility, the interactive worktops 40 between desktops could be replaced with opaque or variable visibility screens as described above. In this case, the screens would be adapted with rods the same as those described for the worktops 40, 41. These could insert in the end caps in the leg supports to support the screen at a suitable height to provide privacy between co-workers working at adjacent desktops.

An overhead services shelf 125 can be provided comprising a hexagonal or other six sided polygon panel 126 from which extend modular shelf portions 127*a*-127*c*. The shelves and panel may be installed onto a three armed beam 135 which comprises protrusions (not visible) on which the apertures in the panels and shelves can be installed. The apertures and protrusions are the same as those for the modular assembly. The three armed beam can then install on the uprights 81 of the central screen 150.

Third Embodiment

Figure 16:
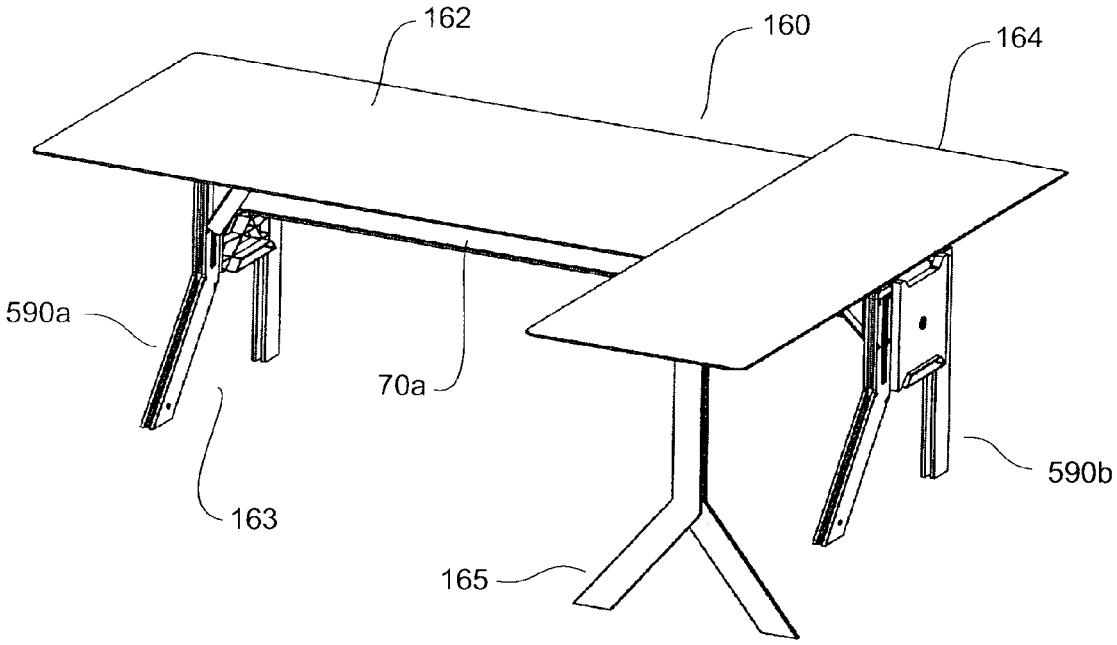
FIG. 16 shows a perspective view of a third embodiment of an assembled workstation comprising a single workstation.

A third embodiment of the invention is shown in FIG. 16. This shows a stand alone workstation system 160 comprising a single workstation comprising a desktop supported on a support structure 163 the same or similar to that described in FIG. 1*c*. Namely the support structure 163 comprises two leg supports 590*a*, 590*b* disposed at either end of the desktop 162 and preferably towards the back edge. The leg supports are the same as those described in relation to FIG. 5*e*. A sectioned beam 70*a* can extend between the two leg supports and can be tilted to provide rigidity as described previously. The workstation 160 can be placed against the wall. The workstation also includes an interactive work top or return 164 that is supported on one end by a leg structure 165 and is supported at the other end by the leg support 590*b*. The interactive work table 164 includes a rod similar for that described in relation to the interactive work tables 40, 41. The rod inserts through an aperture in the end cap of the leg support assembly 590*b* and rests on a cross brace 525 internal to the leg support as described in relation to FIG. 5*c*. This retains the interactive work top 164 at a desired fixed height irrespective of the setting of the height of the desktop 162.

The desk top 162 can be adjusted to the desired height using the adjustment means in the leg support 590*b*, 590*a* as described previously in relation to other embodiments. The interactive work top 164 provides an auxiliary work surface for a user of the workstation 160. It also provides a surface via which others can collaborate with a user of the workstation 160 either by sitting at or standing by the interactive work top 164. In this situation the user will move from working on the desk top 162 and orient themselves to work off the interactive work surface 164.

It will be appreciated that a number of the work stations 160 could be arranged together, either side-by-side or in an opposing back-to-back relationship in a similar manner as described for previous embodiments, such as that shown in FIG. 1*a*. Where a similar workstation 160 is placed in a side-by-side relationship users of each workstation can work collaboratively at the interactive work top 164.

Fourth Embodiment

Figure 17:
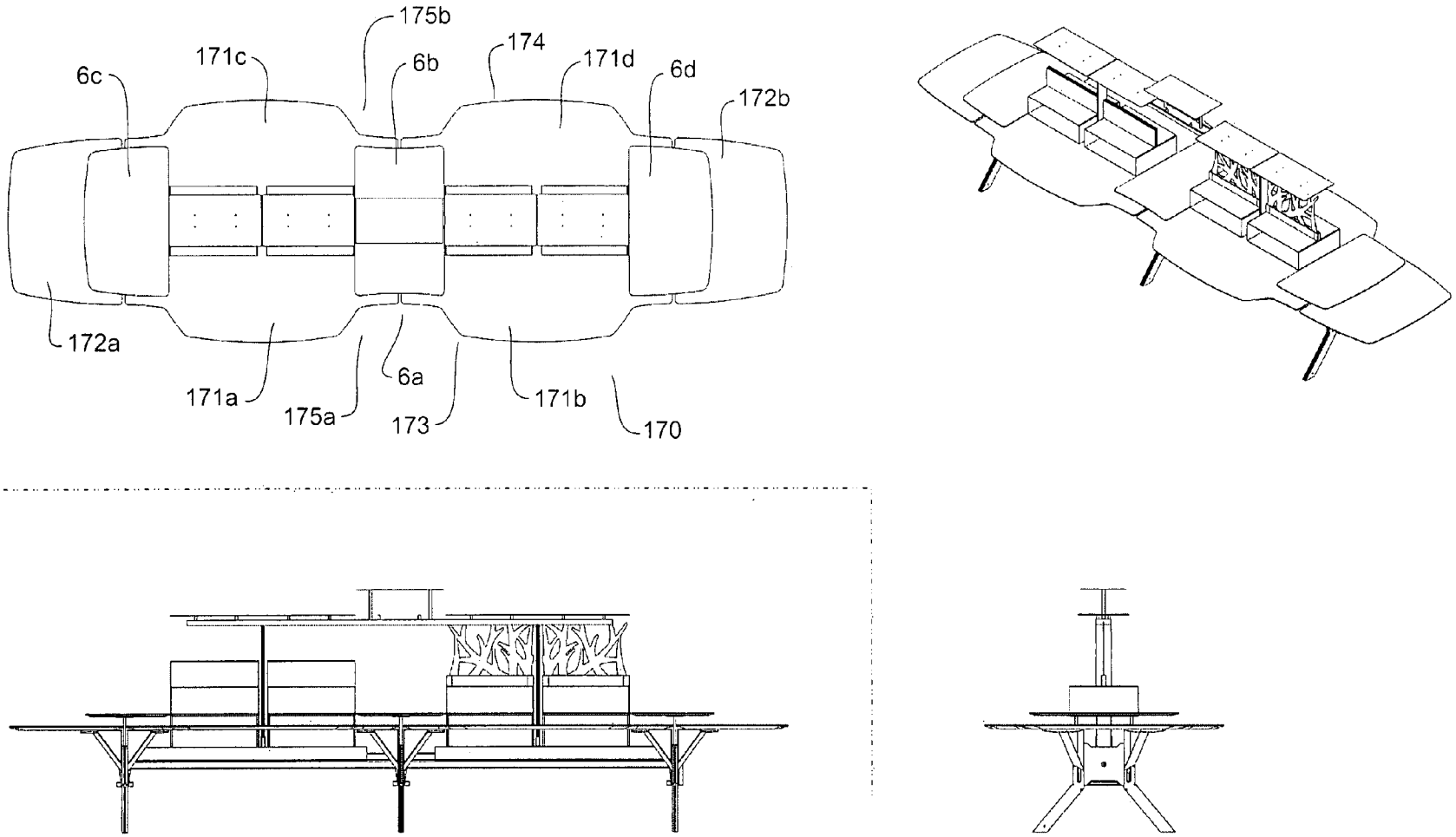
FIG. 17 shows plan, elevation and perspective views of a fourth embodiment of an assembled workstation comprising a single desktop forming four workstations.
Figure 18A:
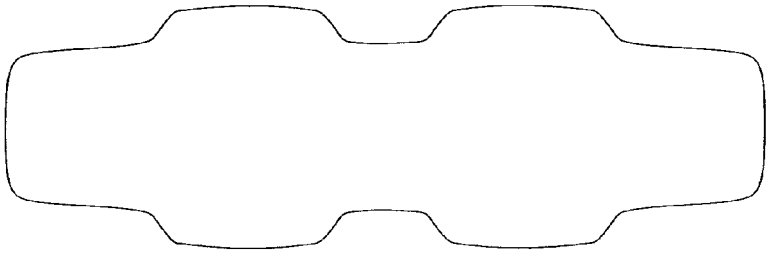
FIG. 18*a*-18*f* show plan views of possible desktops.
Figure 18B:
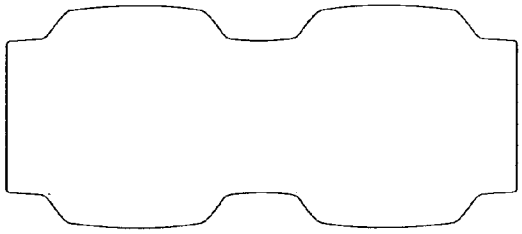
Figure 18C:
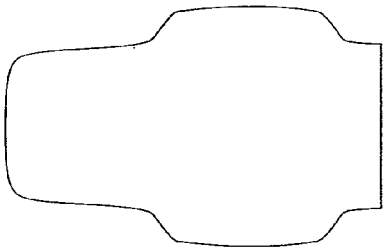
Figure 18D:
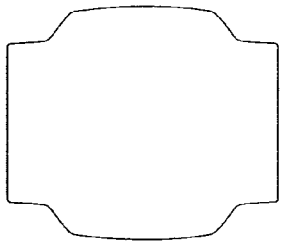
Figure 18E:
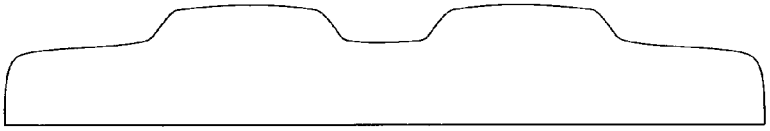
Figure 18F:
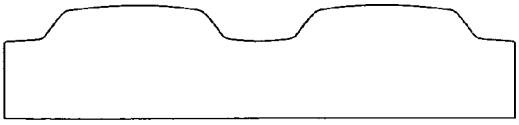

FIGS. 17 and 18*a* show a fourth embodiment of the invention. This is essentially the same as the first invention shown in FIGS. 1*a*-1*b* and 3*a*-3*i* except that the desktops forming the workstations are formed as a single desktop 170. The single desktop has the same configuration and shape as the four desktops 3*a*-3*d* arranged as shown in FIG. 1*b*. Each portion 171*a*-171*d* of the desktop 170 is the same shape as a single desktop such as 3*a*-3*d* described previously and has the same features. The single desktop has the same edge configurations and recesses and interactive areas as described for the first embodiment. It should be noted that the portions forming the end tables could be omitted as shown in FIG. 18*b*. Further, while FIGS. 17 and 18*a* show a single monolithic desktop for a workstation to accommodate up to four people and four workstations, as described earlier any suitable number of workstations could be formed by a single desktop. For example, referring FIGS. 18*c*-18*f*, the single monolithic desktop could provide two workstations, in a back-to-back (FIGS. 18*c*, 18*d*) or side-by-side relationship (FIGS. 18*e*, 18*f*). Alternatively, a single monolithic desktop could provide more that four workstations. The four workstation single desktop 170 is shown by way of example only. It will also be appreciated that the desktop might not include all the modular accessories and overhead beams and the like. Rather it might simply be a flat work surface for multiple people. For example, this could be in a meeting room or board room type arrangement where multiple people will go to meet, along with having interactive areas 6*a*-6*d* to assist interaction between people on opposite sides of the table.

In the case of a single monolithic desktop, the desktop 170 will comprise a first longitudal edge 173 and a second longitudal edge 174 comprising one or more recesses 175*a*, 175*b* on each side or each edge. The recesses will be substantially aligned in an opposite arrangement to provide the interactive area eg 6*b*. Protrusions to form the main work areas will also be included. In summary, any other arrangement of the separate desktops described herein, could be made from a single monolithic desktop formed to the same shape.

Fifth Embodiment

Figure 19:
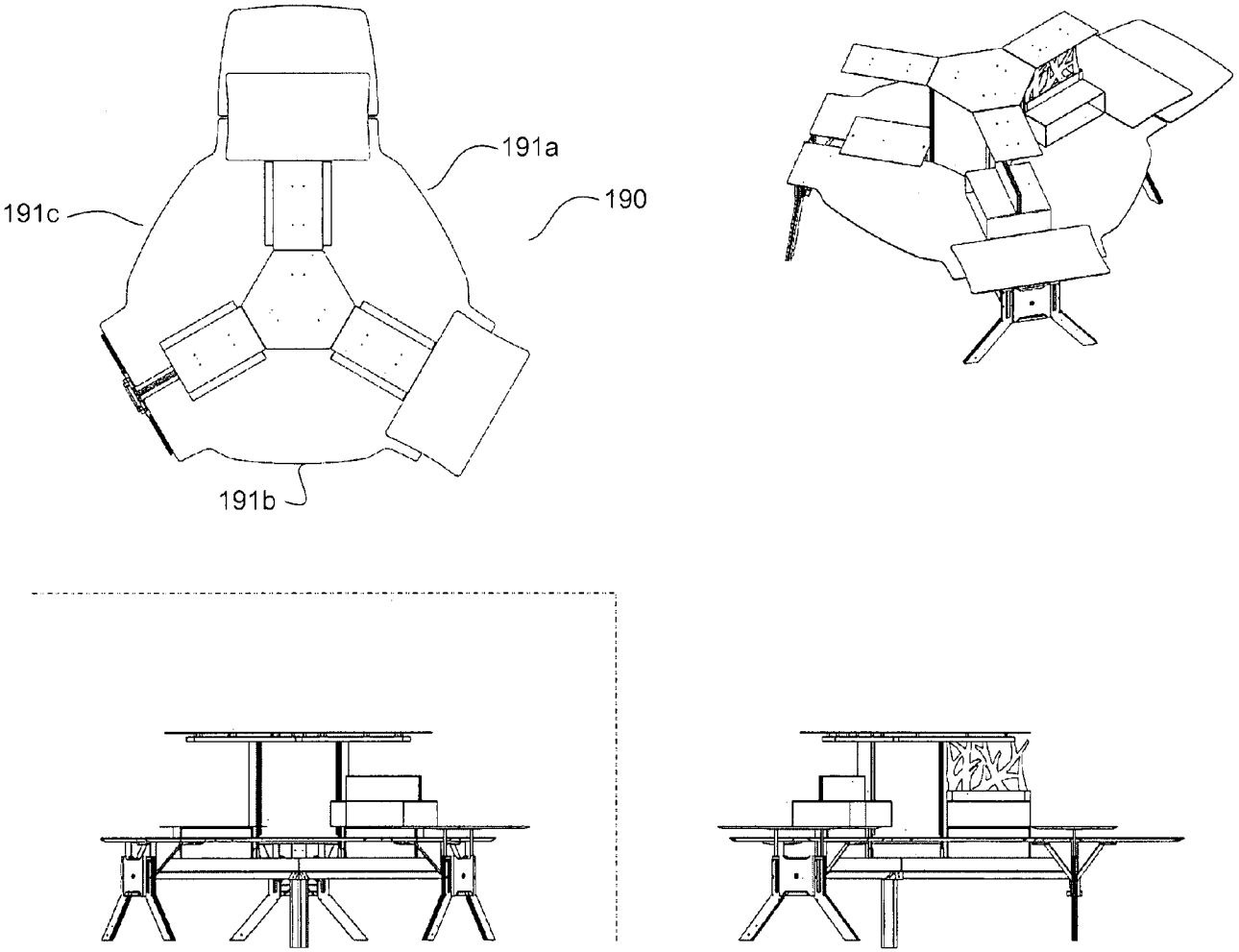
FIG. 19 shows plan, elevation and perspective views of a fifth embodiment of an assembled workstation comprising a single desktop forming three workstations, FIG. 20 show plan view of a desktop of the fifth embodiment.
Figure 20:
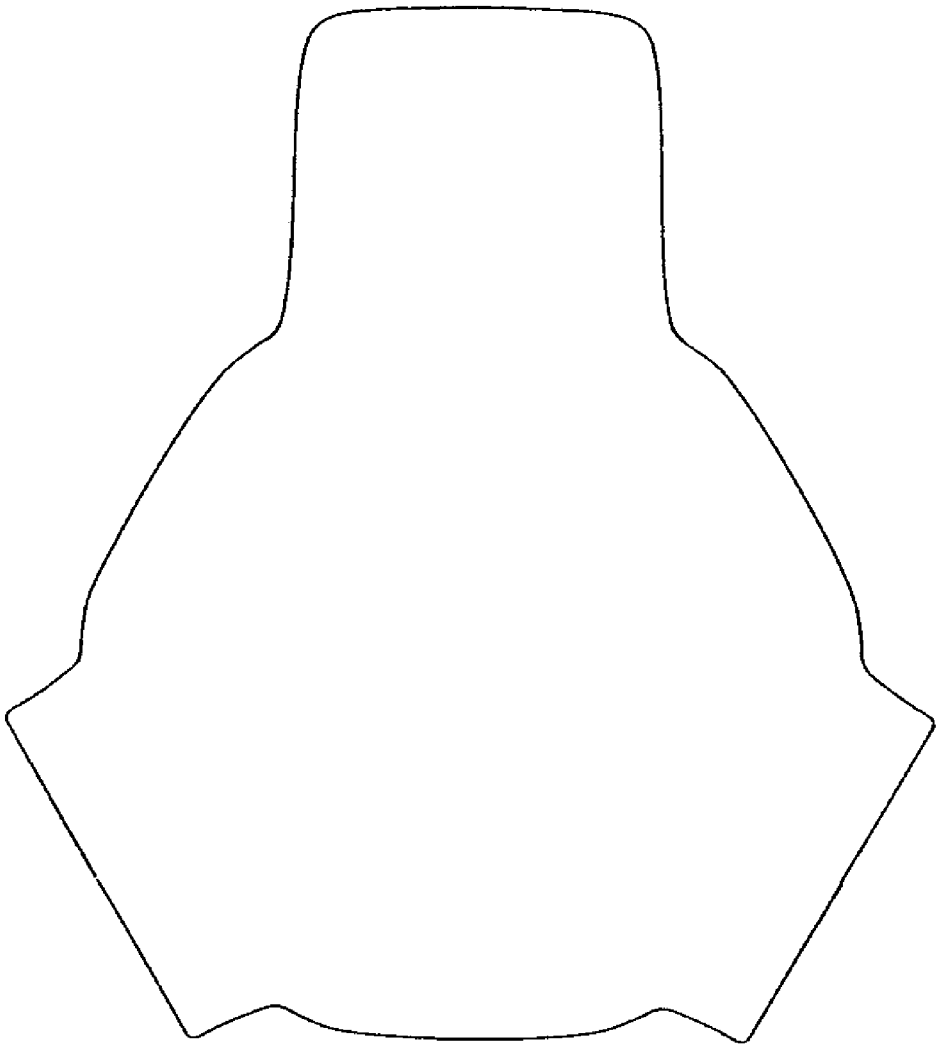

As shown in FIGS. 19 and 20, this embodiment is the same as the second embodiment shown in FIGS. 13 and 14*a*-14*c* except that the desktops forming the three workstations are formed as a single desktop 190. The desktop has all the features of the embodiment described in relation to FIG. 11-14*c* including the working edges and recess, profile portions or lateral edges to provide interactive regions. The single desktop 190 for this workstation comprises three edges 191*a*-191*c* which are profiled to provide these features.

It will be appreciated that in light of embodiments 3 and 4 that where a workstation is described in this specification as comprising a desktop this could also refer to one portion providing one workstation of a monolithic desktop that provides several workstation areas. Therefore, in the specification the term desktop might refer to a single desktop adapted to be arranged adjacent to other desktops to form a workstation, or a portion of an overall desktop for providing several workstation areas, said portion providing one of those workstation areas. In summary, any arrangement of the separate desktops described herein, could be made from a single monolithic desktop formed to the same shape.

Sixth Embodiment

FIGS. 21 to 34 show a sixth embodiment of the invention. This embodiment has similarities to the general shape and function of the first embodiment, although comprises differences in various components, and in the various aspects of its assembly. The differences to the first embodiment will be described here. All other features not described here are the same as those in the first embodiment.

Figure 21:
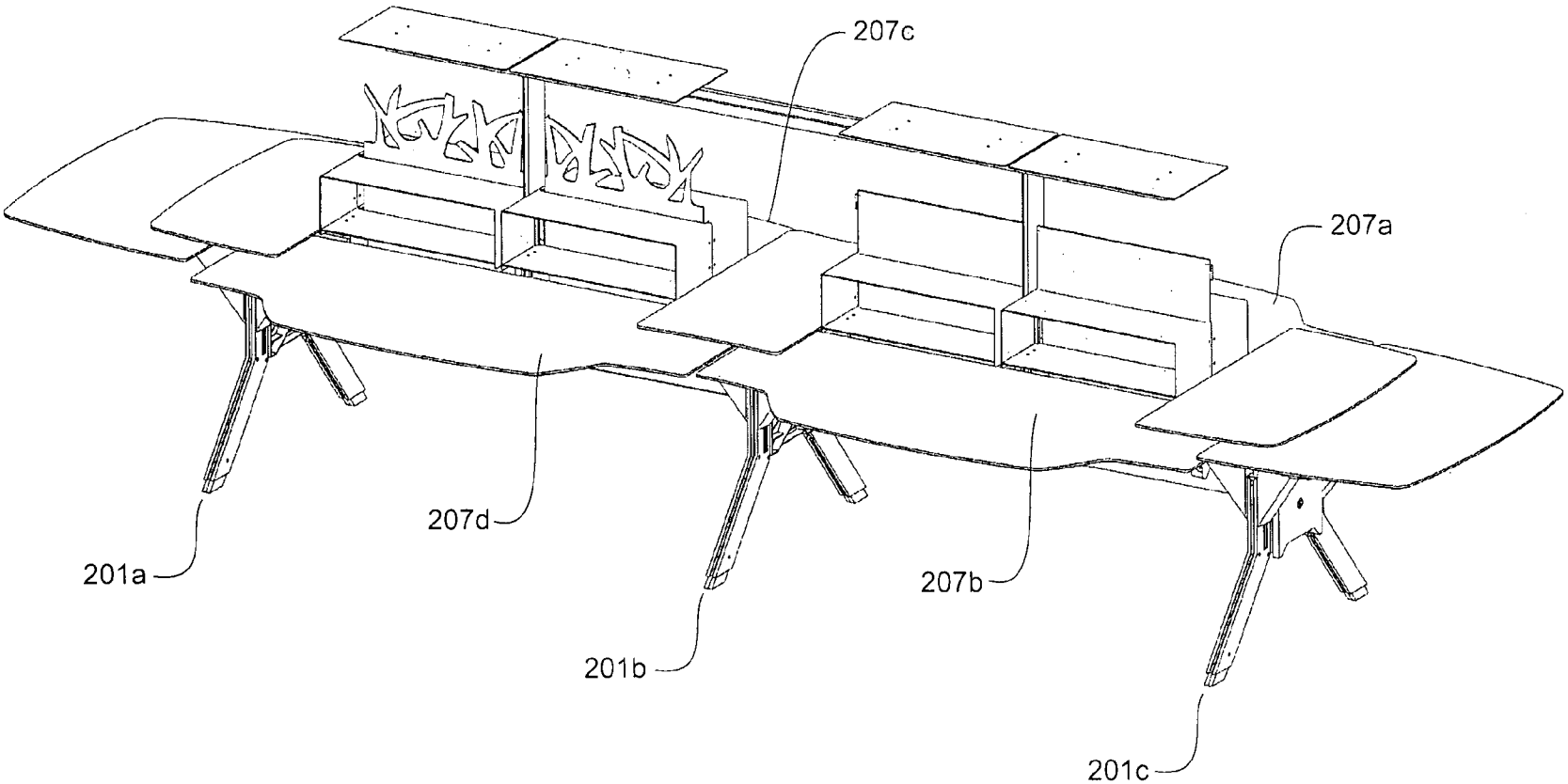
FIG. 21 shows a perspective view of a sixth embodiment of an assembled workstation system comprising four workstations.
Figure 22:
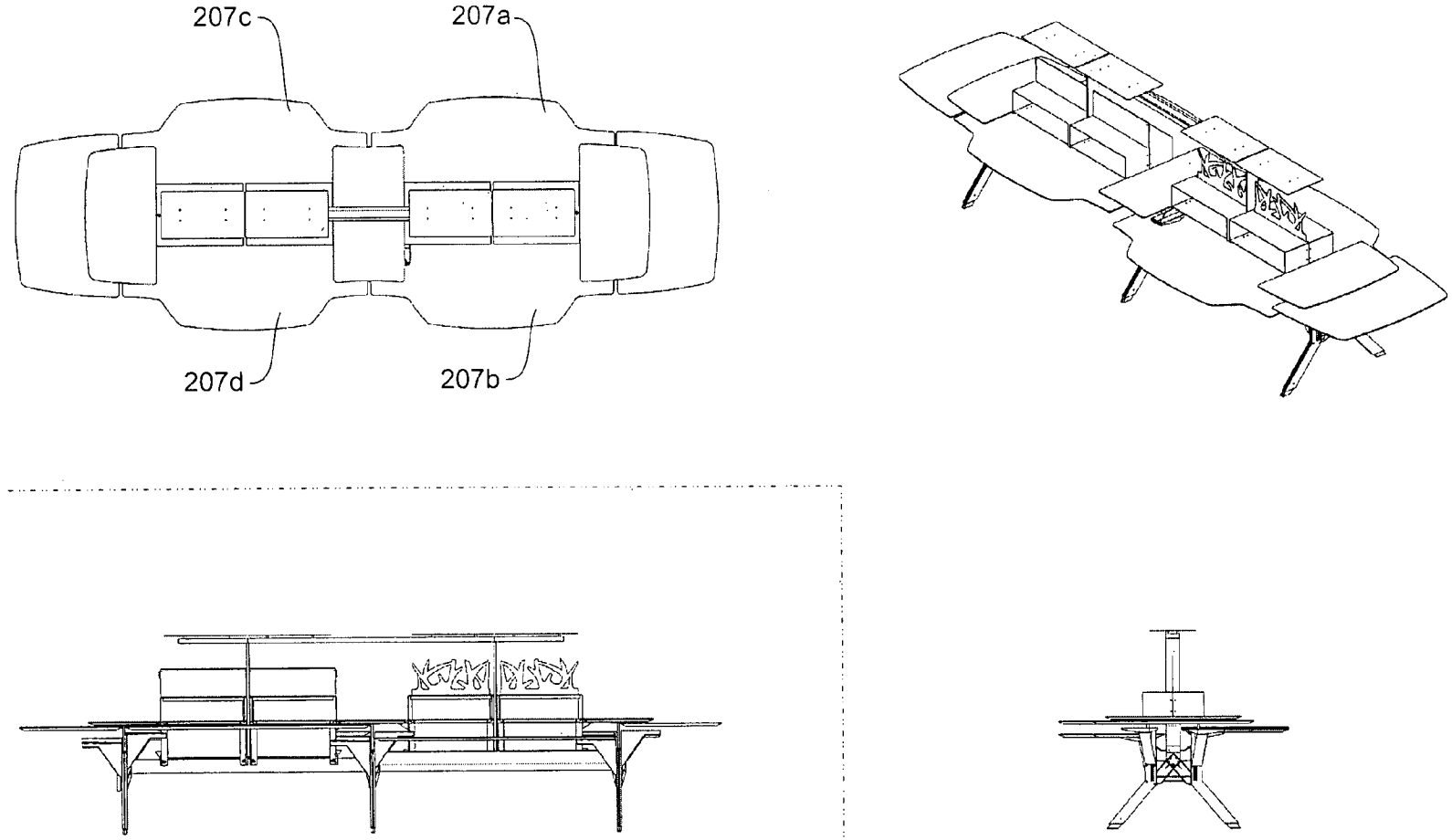
FIG. 22 shows perspective, plan and elevation views of the workstation system according to the sixth embodiment.
Figure 23:
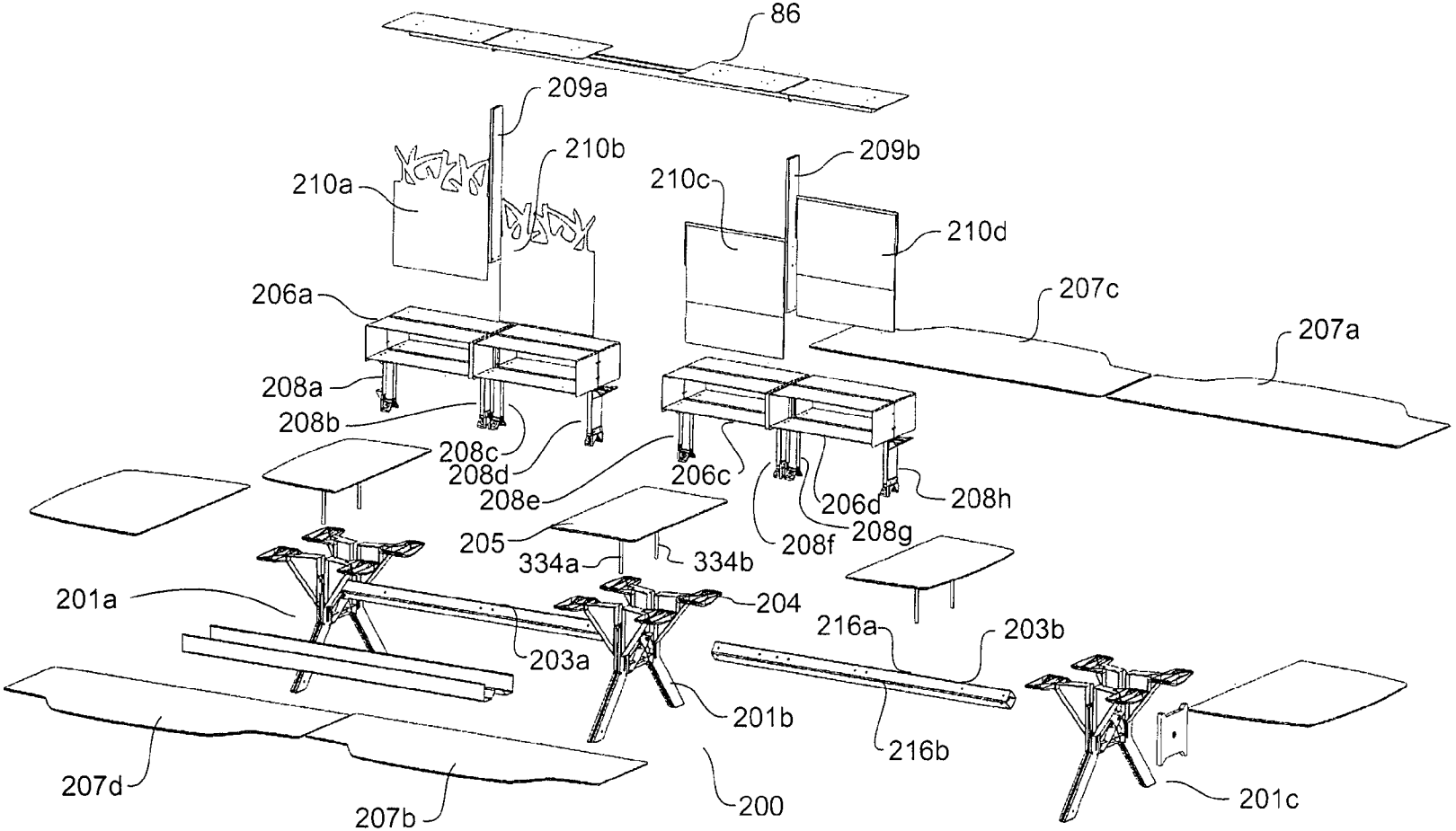
FIG. 23 shows an exploded perspective view of the workstation system according to the sixth embodiment.

Referring to FIGS. 21 to 23, and in particular FIG. 23, which shows an exploded view, the sixth embodiment comprises a partially modified support structure. The support structure 200 comprises three leg supports 201*a*-201*c* arranged in a spaced apart relationship. The leg supports are described in further detail with respect to FIGS. 31 to 34. The leg supports 201*a*-201*c* are spaced apart substantially at the same distance of the width of a desktop e.g. 207*d*. The leg supports are retained in their upright position by way of one or more support beams 203*a*, 203*b* extending between the leg supports. The support beams have a number of apertures e.g. 216*a*, 216*b*, each at different widths to accommodate the upright supports of modular accessories with different widths. The leg supports 201*a*-201*c* have desktop supports (e.g. 204) that support the desktops. The support structure 200 is similar in function to that of the first embodiment, and the desktops are supported in the same manner as in the first embodiment. Further, the interactive worktops (eg 205) are also attached to the leg supports in a similar manner as the first embodiment. However, there are differences in some components forming the support structure, which will be described later.

Referring to FIG. 23 each workstation system preferably has one or more modular accessories in the form of a cabinet e.g. 206*a*-206*d*. Each cabinet e.g. 206*d* is arranged or installed in a manner to sit above the respective opposed desktops e.g. 207*a*, 207*b* to provide a storage space for work items of users of the opposing desktops. Each cabinet is supported by two upright support or brackets 208*a*-208*h* at each end. The upright support e.g. 208*h* is shown in further detail in FIGS. 24 and 25. Each upright support is shaped or configured to nest on the support beam eg 203*a*, 203*b* and is adapted to attach thereto to enable each corresponding cabinet 206*a*-206*d* to be supported above a corresponding set of opposing desktops 207*a*-207*d*. Each set of upright supports along with the corresponding cabinet form the modular accessory assembly. Preferably, there are multiple modular accessory assemblies installed for each pair of opposing desktops. As shown in FIG. 23, there are two adjacent modular accessory assemblies for each opposing set of desktops. Each set of two modular accessory assemblies therefore have four upright supports comprising two end support brackets at each opposing side of each cabinet, and a pair of adjacent support brackets disposed at the adjacent ends of the cabinets. A gap or recess is allowed between the set of adjacent upright supports eg. 208*b*, 208*c* and 208*f*, 208*g*. This gap provides a space for a vertical support 209*a*, 209*b*, for supporting the overhead services beam 86 can be disposed. The upright support pairs retain the vertical supports in place to form a support assembly. This will be described in more detail with respect to FIG. 24. The embodiment shown in FIG. 23 also comprises screens 210*a*-210*d* that can be arranged between opposing desktop pairs in the vicinity of the modular accessories to provide at least some degree of visual separation or privacy between opposing desktop pairs. Each screen can be of a complete blocking type e.g. 210*c*, 210*d* or a variable visibility type e.g. 210*a*, 210*b* as described previously. The screens 210*a*-210*d* comprise a low divider portion that is adapted to slide between slots in the upper and lower terraces of the cabinets 206*a*-206*d*. By doing so, each screen is secured in place between opposing desktops, and the divider portion also divides each cabinet into two separate compartments with openings in opposing directions. Each compartment can be used by a user of a respective desktop. The cabinets will be described in further detail with respect to FIGS. 26 to 28.

Figure 24:
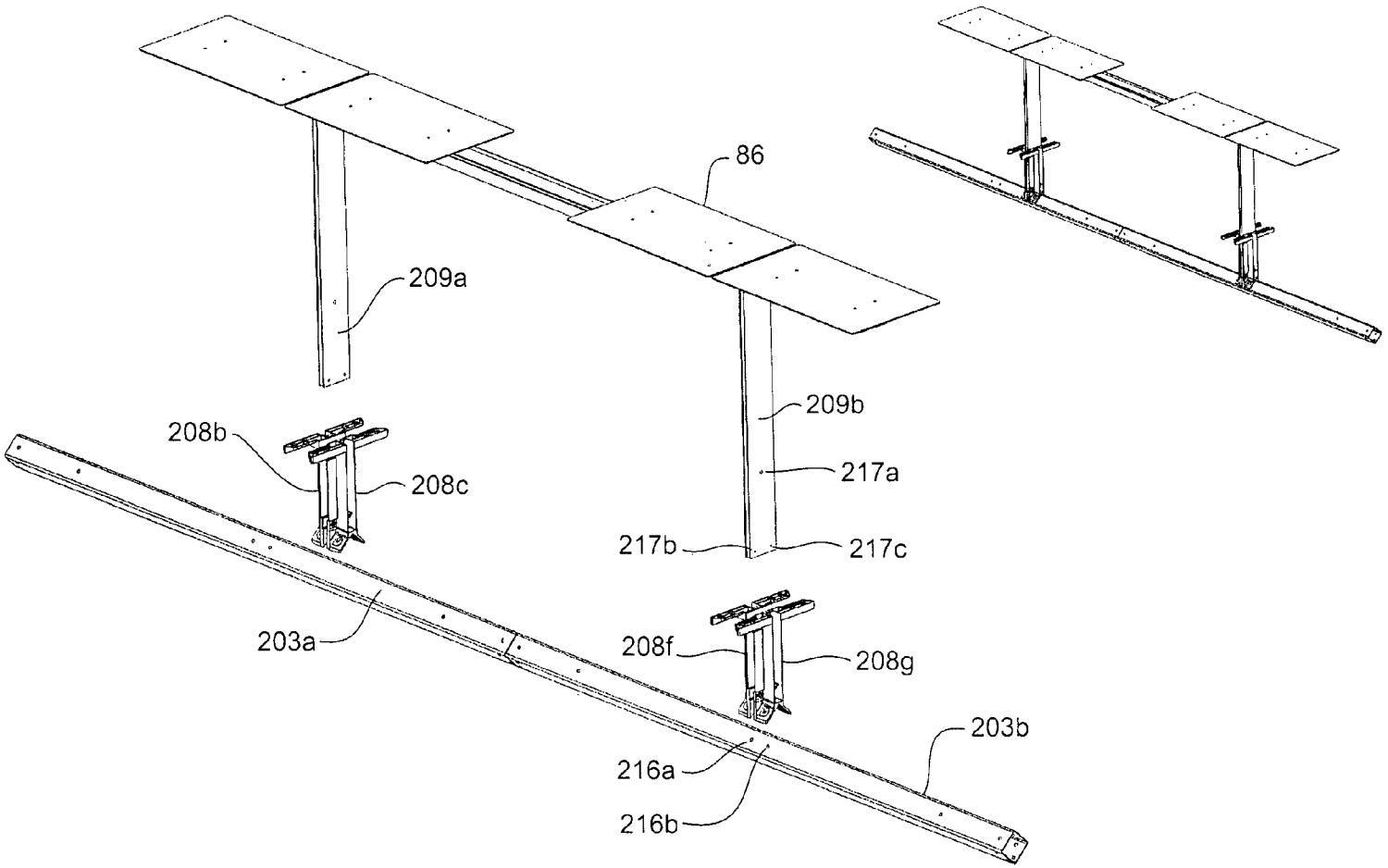
FIG. 24 shows exploded and assembled views of the support assembly comprising upright supports for modular accessories and vertical supports for the overhead services beam.
Figure 25:
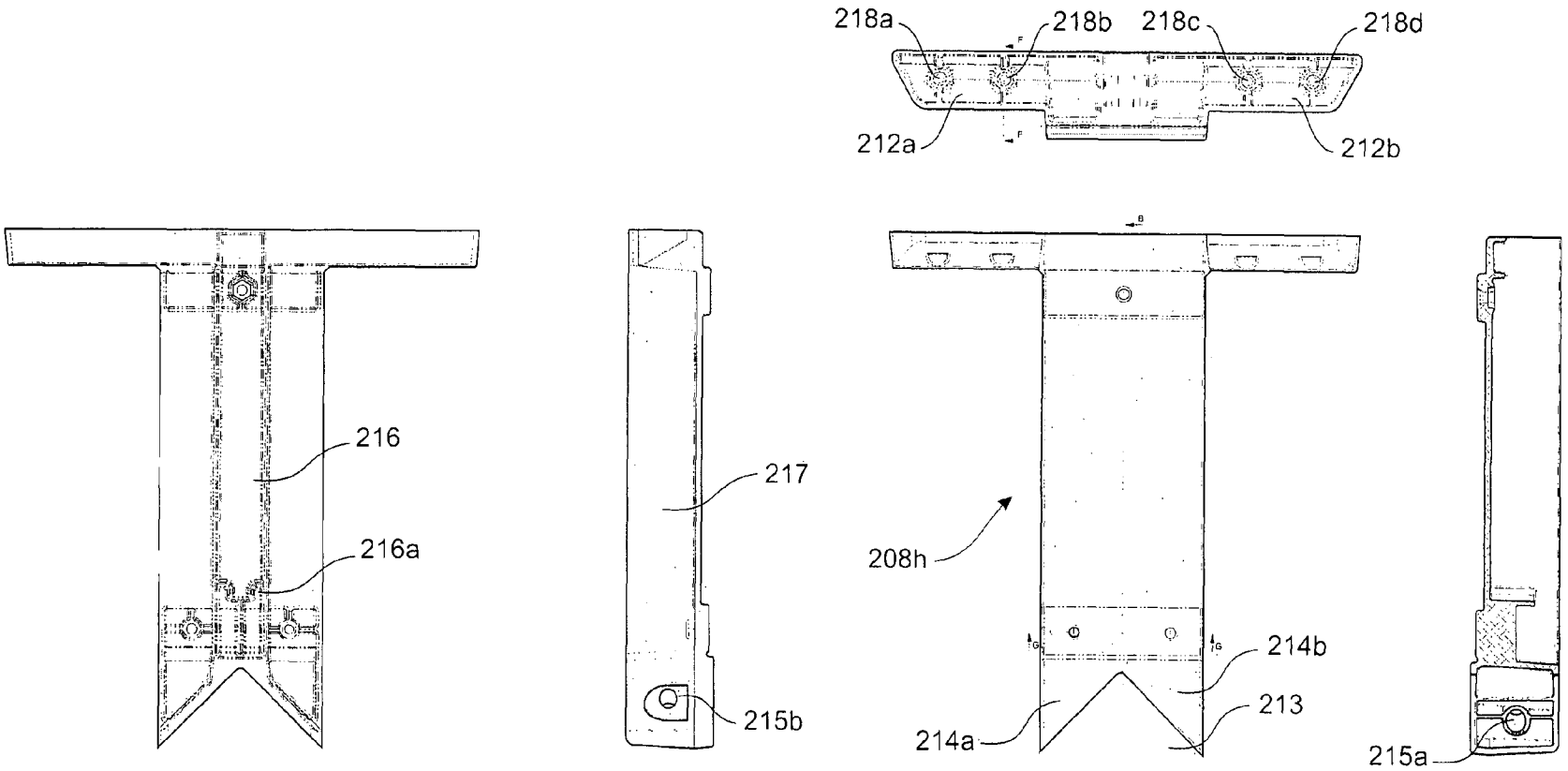
FIG. 25 shows an upright support according to another embodiment in further detail.

Referring to FIGS. 24 and 25, the manner in which the upright brackets and vertical supports are assembled and attached to the support beam will be described in further detail. Each upright support comprises an upright stem 211 at the top end of which extends two lateral support members eg 212*a*, 212*b*. The stems comprise channels or elongated recess portions for receiving divider portions of a screen 216. Alternatively, stem inserts e.g. 290 (FIG. 26*c*) could be provided in the channels 216 of the stem 211 for receiving divider portions of a screen. At the bottom end of the stem, a v-shaped bracket 213 extends, which is adapted to nest on the rotated square section support beam 203*a*, 203*b*. Each flange 214*a*, 214*b* of the v-bracket 213 has a respective aperture 215*a*, 215*b* and there is a corresponding aperture eg 216*a*, 216*b* in the support beam. The upright support 208*h* is attached to the support beam 203*a*, 203*b* by placing the v-bracket 213 over the support beam to nest it in place and then aligning the flange apertures 215*a*, 215*b* and the beam apertures 216*a*, 216*b*. Each upright support is then secured in place by way of bolts, screws, rivets or the like. The two extending lateral supports 212*a*, 212*b* each comprise two apertures 218*a*-218*d* for receiving bolts, screws, rivets or other retaining means for attaching a respective modular cabinet to the upright support. This retains the modular cabinet in a supported manner above the support beam 203*a*, 203*b*.

Each vertical support comprises an aluminium extrusion or is made of a another material of suitable stiffness to support the overhead services beam.

FIG. 24 shows the services beam 86, vertical supports 209*a*, 209*b* and upright supports 208*b*, 208*c*, 208*f*, 208*g* installed on the services beam by way of example. The other components of the work station system have been removed for clarity. Two upright supports 208*b*, 208*c*, and 208*f*, 208*g* are arranged in opposing relationship and retained or secured on the beam to provide a gap there between. Each vertical support 209*a*, 209*b* is slid between the opposing faces of respective spaced apart upright supports 208*b*, 208*c* and 208*f*, 208*g*. Each vertical support 209*a*, 209*b* has three, or any other suitable number, of apertures 217*a*, 217*b*, 217*c* arranged to correspond to similar apertures in the stem of each support bracket. Each vertical support is retained in place between a respective pair of opposing upright supports by bolts, screws or other securing means inserted through the respective apertures in the vertical support and corresponding upright supports. The combination of a vertical support sandwiched and attached between two corresponding upright supports forms a support assembly. Multiple support assemblies can be utilised in a workstation system to support and overhead services beam and multiple modular accessories.

The services beam 86 can then be secured to the top of the vertical supports 209*a*, 209*b*. The services beam can be the same as that described in relation to previous embodiments and provide the same function.

This embodiment enables a closer arrangement of adjacent modular cabinets for aesthetic purposes. It also obviates the need for a v shaped bracket for the vertical support to nest on the support beam, thus reducing components and cost.

A cabinet eg 206*a* and the manner in which it is assembled with the upright supports will be described in further detail with reference to FIGS. 26*a*, 26*b*, 26*c* and 27. Each cabinet e.g. 206*a* comprises two lower terrace plates 220*a*, 220*b*. Each lower terrace plate 220*a*, 220*b* is attached at each lateral side to a corresponding lateral support 212*a*, 212*b* of an upright support 208*a* via bolts, screws, rivets or the like. Therefore, each pair of upright supports comprising four lateral supports in total will support two separate plates 220*a*, 220*b* extending in a horizontal manner. Each terraced plate includes a recess 240*a*, 240*b* on its back surface that extends almost entirely along the length of the plate. At each end extends a small protrusion 241*a*-241*d* defining the edge of the recess. When two terraced plates 220*a*, 220*b* are arranged back-to-back and secured to the respective upright supports 208*a*, 208*b*, the opposing protrusions will abut and the two corresponding recesses on the corresponding plates will together define a slot 224 (see FIG. 26*b*) between the two plates extending almost the entire length of the plates.

Note, in an alternative embodiment there is no need for a protrusion and instead the terrace plates could have a flat edge and be arranged in a back-to-back relationship such that a gap exists between the flat edges to provide the equivalent of a slot. In another embodiment, the lower terrace could be one plate with a slot.

The cabinet also comprises a top or elevated terrace. The elevated terraced comprises two u-section components 225*a*, 225*b* that are affixed to the respective lower terrace plates 220*a*, 220*b*. Each elevated terrace u-section could be formed from a single piece of sheet steel or other suitable material that is bent to form the u-shape. Alternatively, the elevated terrace could be constructed from a number of pieces that are joined together to form the u-section.

Similar to the lower terrace, the back edge of each top surface of the elevated terrace u-section comprises a recess 226*a*, 226*b* along its length protrusions similar in nature to that on the lower terraced plates that define the recess. When the two upper u-section terraces are arranged back-to-back and are fixed to the corresponding lower terrace plates, the two sets of protrusions will abut and a slot 227 will be formed by the two opposing adjacent recess portions. The slots formed on the upper surface of the elevated terrace and the lower terraces are aligned.

The screen e.g. 210*d* comprises a visibility blocking portion 228*a* and a divider portion 228*b*. It will be appreciated that the screen comprising the upper visibility blocking portion and the lower divider portion can be considered a dividing panel. This is because both the divider portion and visibility blocking portion act as dividers between two parts of the cabinet when installed. Both portions also provide visibility blocking, although the primary purpose of the bottom portion 228*b* is to act as a divider, whereas the primary purpose of the upper portion 228*a* is to reduce visibility between two workers. The visibility blocking portion can be a variable visibility screen, or a full blocking screen. As shown in FIGS. 26 and 27, preferably the screen portion is thicker than the divider portion, such that the divider portion is thin enough to be received in the slots formed in the upper and lower terrace, while the thicker portion dimensions are too big to be received in the slot. The screen is installed by pushing or inserting the divider portion through the top terrace and bottom terrace slots. The divider portion 228*b* is received at its two opposing edges and retained in place by the elongated recess channels 216 in the upright stems of the upright supports, or in the inserts disposed in the channels. The bottom corner edges of the divider portion rest on the bottom 216 of the terrace slots to retain the screen in place. The divider portion 228*b* thereby splits the cabinet 206*a* into two separate compartments. These compartments can be accessed separately by opposing users when the cabinet is installed between opposing workstations. Further, preferably the divided portion extends beyond the lower terrace of the cabinet to provide blocking between the opposing workstations underneath the lower terrace but above the workstations when the cabinets are installed.

It will be appreciated that while the modular accessory shown in FIGS. 26 and 27 is termed a "cabinet", it comprises two separate portions which may operate as two separate cabinets when the divider is in place.

Further, it will be appreciated that a cabinet is not the only modular accessory that could be supported by the support brackets. Other modular accessories could be provided, such as those described previously.

Figure 27:
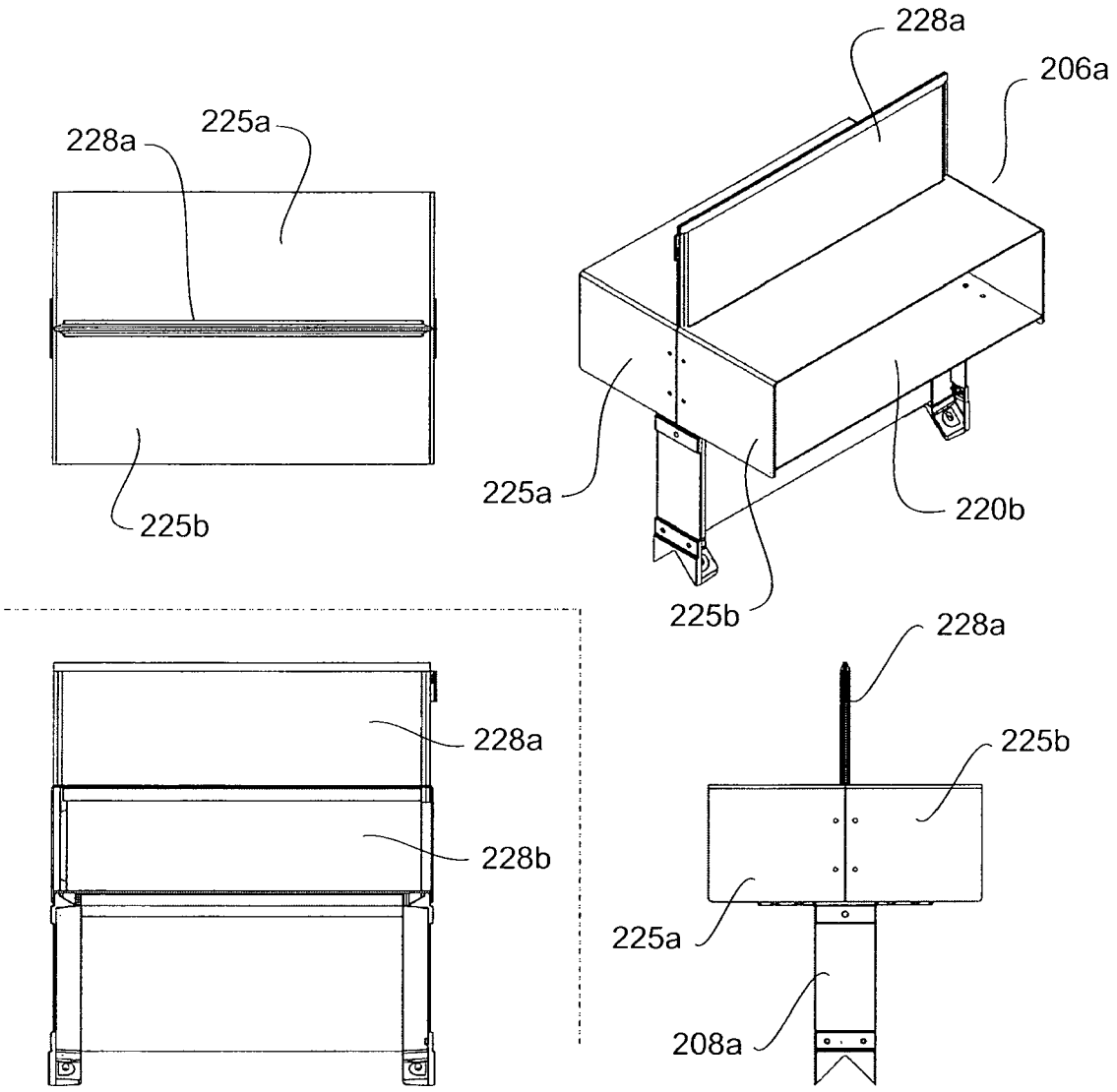
Figure 28:
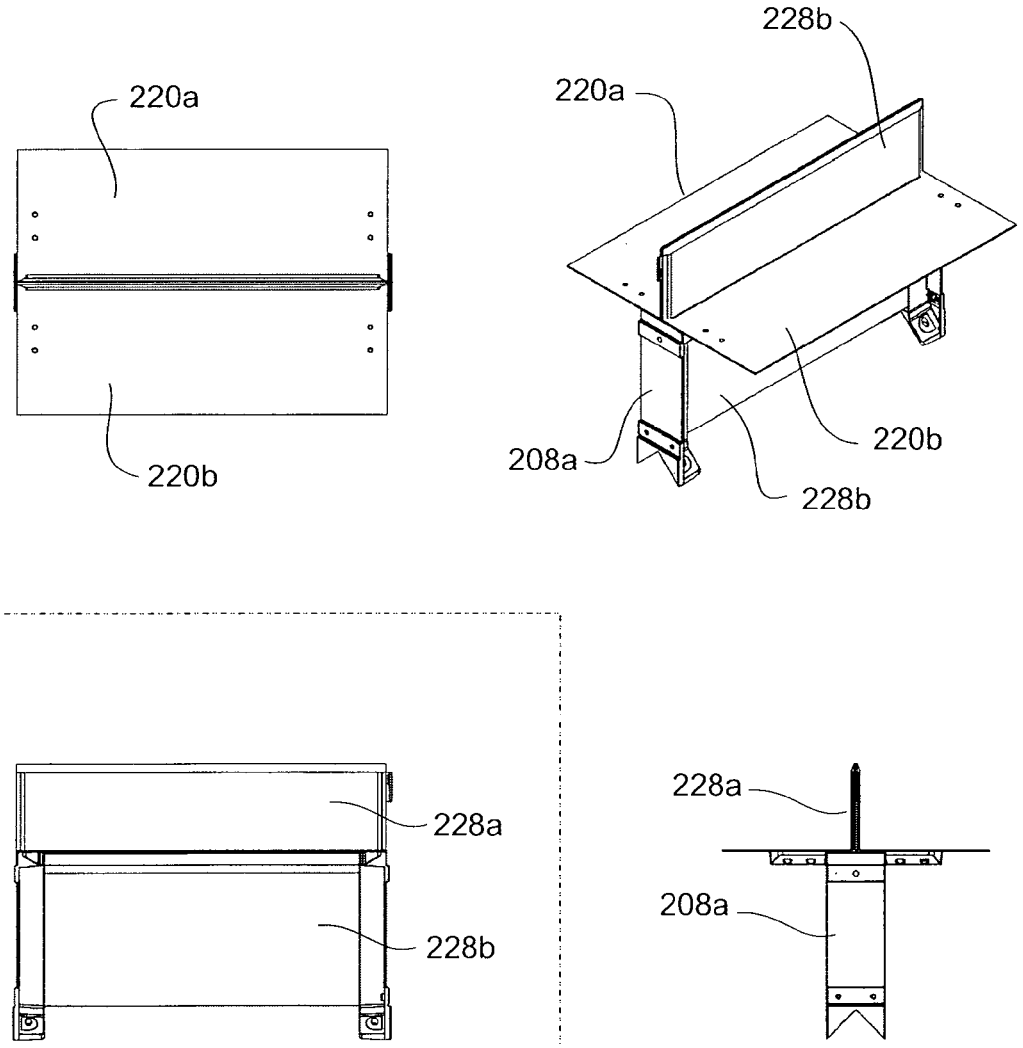
FIG. 28 shows another embodiment of terraces for the workstation system.

One example of another modular accessory is shown in FIG. 28. In this case, the modular accessory is a single level terrace, similar to that shown in and described with reference to FIG. 9*e*. In this case the single lower terrace provides a single surface that can be used for storing items by users of opposing workstations. The lower terrace may simply be constructed as per the lower terrace described with reference to FIGS. 26 and 27, but without the elevated terrace portion attached. The visibility blocking screen maybe inserted in a similar manner as described for FIGS. 26 and 27.

The modular cabinet or single terrace may alternatively comprise single piece rectangular section components with a slot machine therein, as opposed to being formed from separate sections with recesses on the back edge.

Figure 26C:
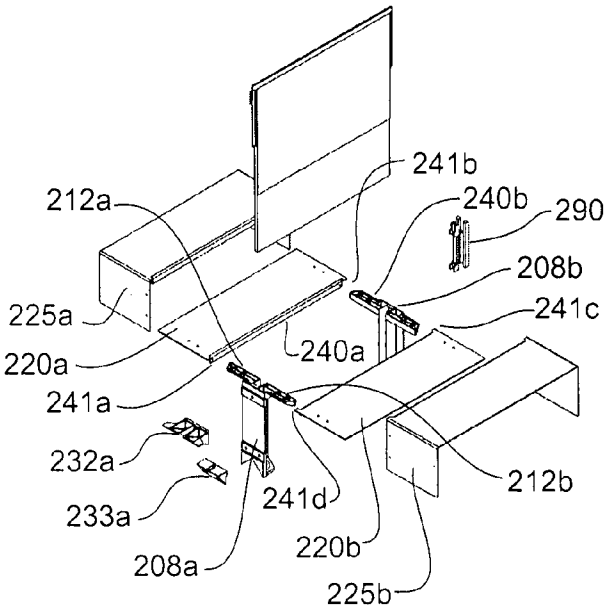
FIGS. 26*a*-26*c* and 27 show one embodiment of terraces for the workstation system.
Figure 26B:
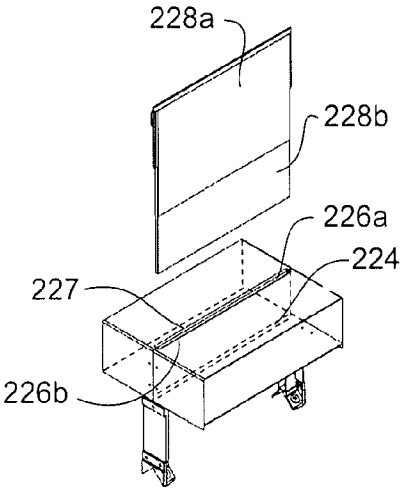
Figure 26A:
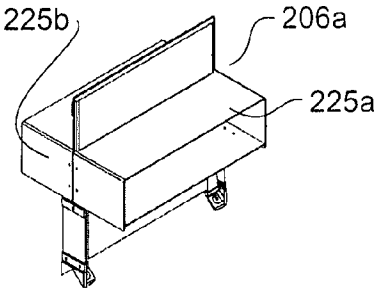
Figure 29:
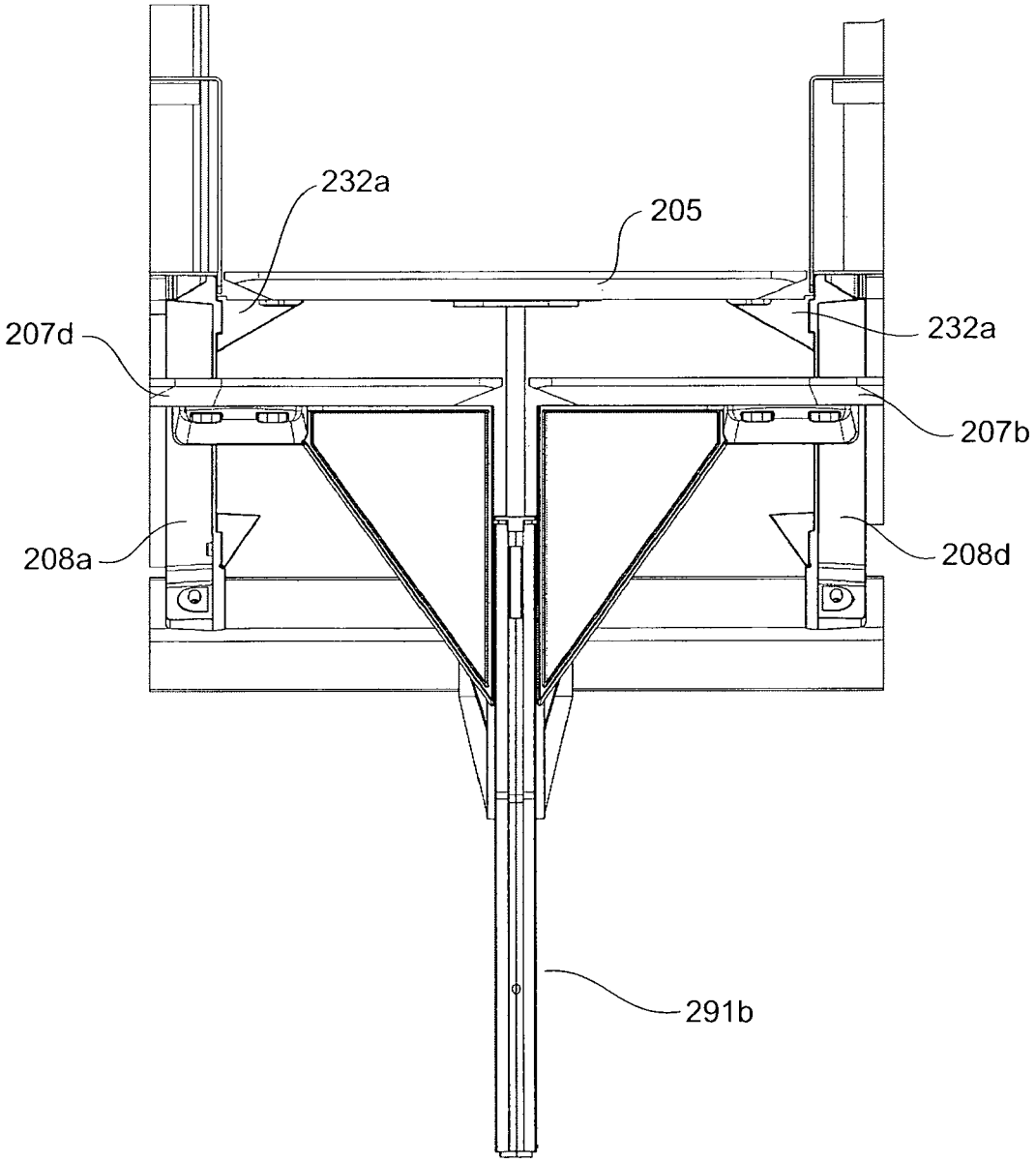
FIG. 29 shows a longitudinal cross-section of a central portion of the workstation system according to the sixth embodiment.

As shown in FIGS. 25 and 26*c*, each upright support comprises a detachable worktop support bracket e.g. 232*a*. This bracket is preferably attached to the stem of the vertical bracket by way of a screw, bolt, rivet or the like. The worktop support bracket 232*a* comprises an upper surface upon which an interactive table or other worktop surface e.g. 205 can rest. Further, the support bracket 232*a* comprises one or more apertures or bores. Referring to FIGS. 23 and 29 the supports are for providing support and rigidity for the interactive worktops 205 that are supported above the workstations in the workstation system. For example, the worktop 205 that is supported in the middle of the workstation system between the cabinets 206*b*, 206*c* can rest on the support brackets 232*a* extending from the two spaced apart and adjacent upright supports 208*d*, 208*e* of the modular cabinets 206*b*, 206*c*. This can be seen more readily in FIG. 29 that shows a cross sectional view down the longitudinal axis of a central section of the workstation system. As can be seen, the interactive worktop 205 sits on top of the brackets 232*a* that are connected to the upright supports 208*d*, 208*e*. Further, the interactive worktop may be bolted, screwed or otherwise connected to the supports via the bores. Similarly, where there is a interactive workstation at one end of the modular cabinets, one edge of the workstation may be supported on the interactive worktops support. Again, the edge might be physically connected to the support via a bolt, screw or the like.

As shown in FIG. 26*c*, each support bracket e.g. 208*a* comprises a detachable lower support bracket 233*a*. This can be used to support the divider portion 228*b* of a screen that is not inserted into the slots of a cabinet, but rather is supported on the outside of a cabinet. This might occur in some configurations of a workstation. For example, it might occur if a screen is required between two cabinets (or other modular accessories) arranged side-by-side. Lower brackets 233*a* can be attached to each adjacent upright support, and the divider portion of a screen supported and retained in place by the lower brackets. It might also occur where there is a single modular accessory arranged, and a screen can be support adjacent at one side of the modular accessory.

Figure 30:
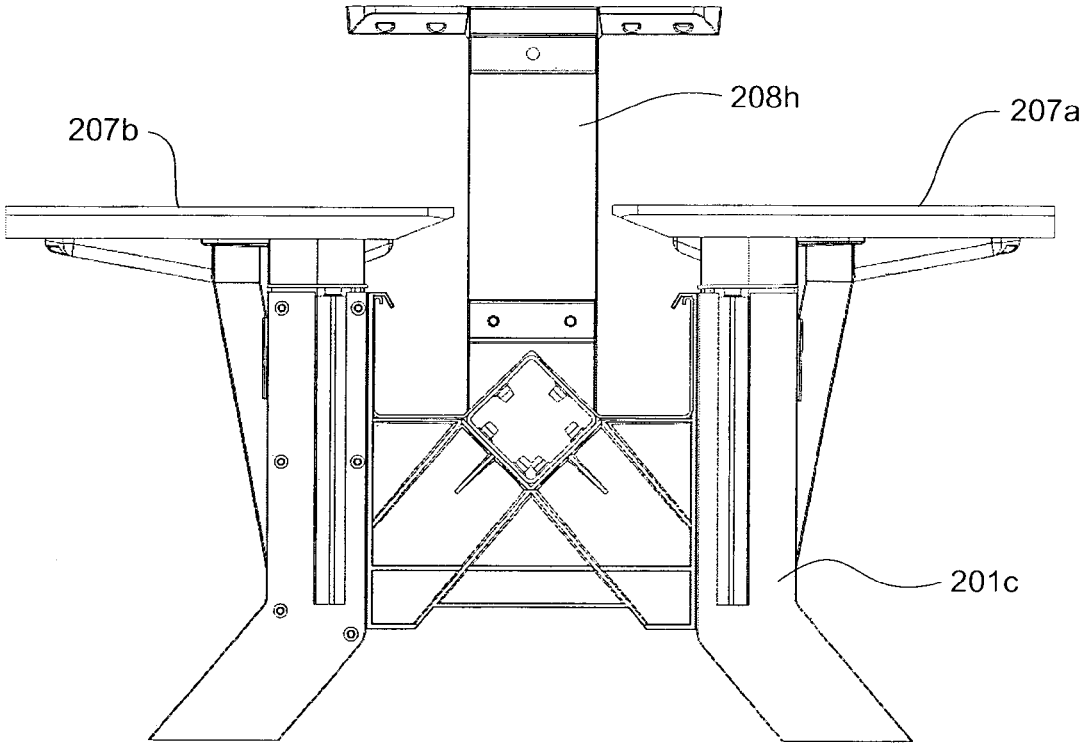
FIG. 30 shows an end view of the workstation system according to the sixth embodiment.

FIG. 30 shows an end view of the workstation assembly for the sixth embodiment with an end cap removed from the leg support assembly. This is similar to the view shown in FIG. 7 for the first embodiment, but with some differences as previously described with reference to FIGS. 21 to 29.

Figure 32:
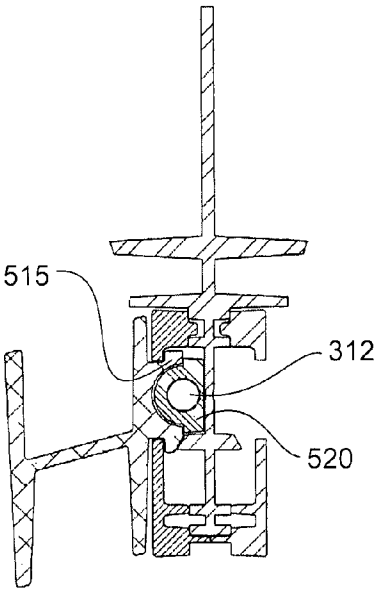
FIGS. 31-33 show an alternative embodiment of the leg supports.
Figure 31:
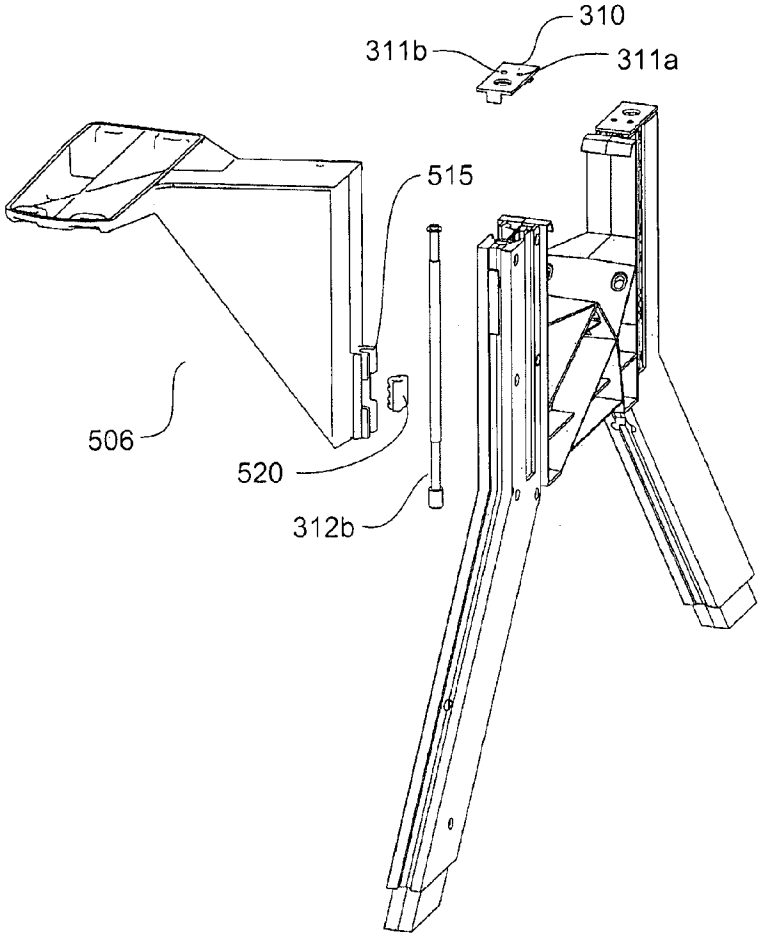
Figure 33:
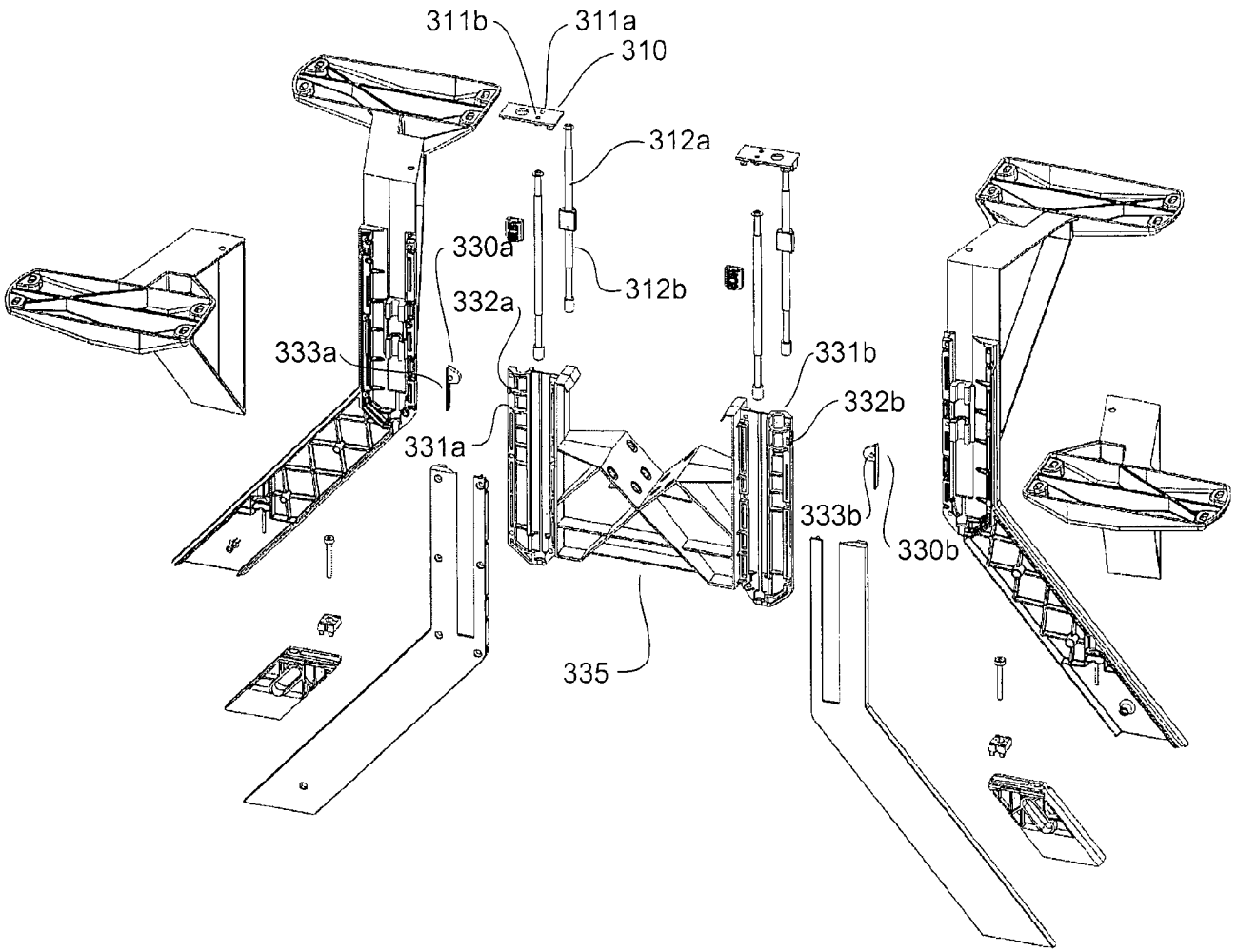

FIGS. 31, 32 and 33 show the leg support for this embodiment of the invention. The leg supports are similar in nature to the leg supports described in relation to FIG. 5*a*, 5*b* and 5*c*, although there are some constructional differences. For example, each leg support end cap 310 comprises two apertures 311*a*, 311*b* for accessing the end of the top end of the threaded rods e.g. 312*b*. The top of the threaded rods comprise couplings, such as that shown in FIG. 5*f*. This arrangement allows for rotation of the threaded rods (and therefore height adjustment of the leg support) via the apertures in the end cap, as well as from the underneath of the leg support as described previously in relation to FIG. 5*b*, 5*c*.

The leg support shown in FIG. 33 also comprises a cam lever 330*a*, 330*b* on each leg that is disposed in the leg assembly. This enables locking in place of an interactive worktop when installed. The cam lever 330*a*, 330*b* has a stub pivot on each side (pivots 333*a*, 333*b* are visible). These pivots engage in respective slots 332*a*, 332*b* in the leg beam support 335. In the open position, the cam levers 330*a*, 330*b* are rotated outwards from the leg assembly so that the handle of the cam lever extends at least partially outwards from the leg assembly. This moves the cam of the cam lever to prevent it obstructing the respective cage retaining portions or receptacles 332*a*, 332*b*. The supports (such as rods e.g. 334*a*, 334*b*) extending from an interactive work top, e.g. 205 are adapted to insert into the respective cage retaining portions 332*a*, 332*b* of the leg beam support 335. The bottom of each rod 334*a*, 334*b* rest on a ledge in each cage portion 332*a*, 332*b*. Each cam lever can then be manipulated unto a lock position such that the cam abuts against the respective rod 334*a*, 334*b* of the interactive workstop, securing it in place in the cage retaining portions 332*a*, 332*b* to provide resistance against the interactive worktop being removed.

Figure 34:
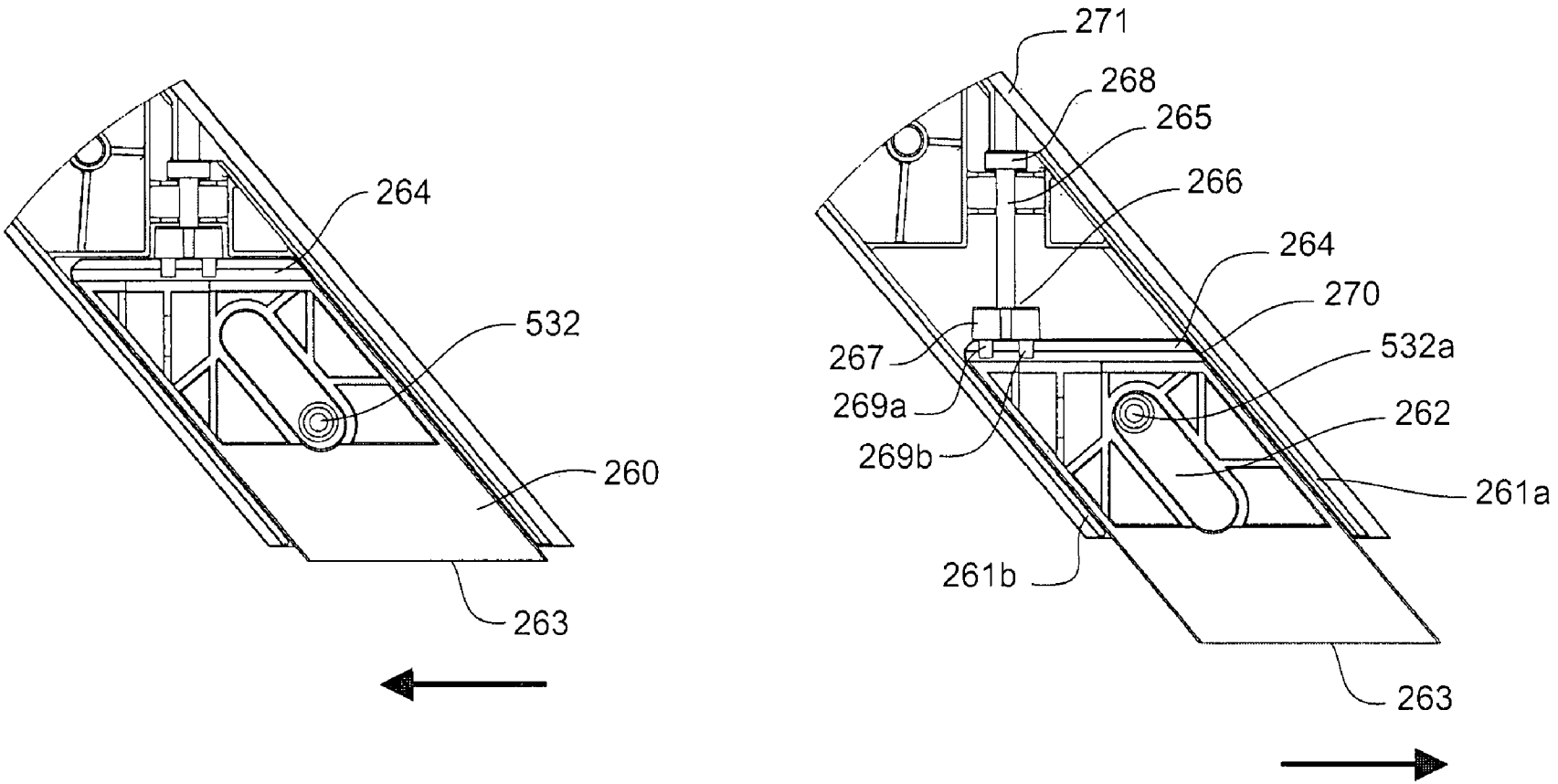
FIG. 34 shows an alternative embodiment of the foot in extended and retracted positions.

With reference to FIG. 34, the leg support means includes an alternative levelling foot 260 to that shown in FIG. 5*d*. This foot can be used in the present embodiment, or in any other embodiment as a substitute for the foot shown in FIG. 5*d*. It can be used in both leg support assemblies shown in FIGS. 5*b*, 5*c* and 31-33. The foot comprises two halves which are drawn together as shown in FIG. 34. The levelling foot 260 is adapted to slide to retract into and extend from the inner portion of the leg support plates to provide some levelling adjustment means for a workstation system comprising the leg supports. As can be seen in FIG. 34, the foot levelling portion 260 has a generally parallelogram shape with a first surface and a second surface 261*a*, 261*b* adapted to slide on inside surfaces of the leg support plates. One leg support plate of a leg support comprises a bearing 532*a* adapted to protrude through an elongated aperture 262 in the foot 260. The combination of the bearing 532*a* and elongated aperture 262 provide a limit to the extent to which the foot can retract and extend or slide within the plates of a leg support. The foot 260 also comprises a bottom surface 263 for resting on the ground and a top surface 264 for coupling to an adjustment means housed in or assembled in the leg support. The adjustment means comprises a levelling adjuster screw 265 comprising a threaded rod which extends into a levelling block nut 266 that sits within a foot levelling block 267. The adjuster screw 265 is also threaded through a threaded nut 268 attached to the leg plate. The levelling block nut comprises one or more (preferably two as shown) rail clips 269*a*, 269*b*, that slideably engage onto an elongated rail 270, channel or recess that extends along the top edge of the foot. The foot is assembled in the leg support as described previously.

As shown in FIG. 34, the extent to which the foot 260 extends or retracts into or out of the inner portion of the leg support can be set by the adjuster screw 268. Again, the adjuster screw 268 comprises a suitable coupling, such as one of those shown in FIG. 5*f*, in the end that allows rotation of the adjuster screw 268 with a suitable tool. As the threaded adjuster screw 536 is engaged in the threaded nut 538 which is affixed to the leg support, any rotation of the threaded adjuster screw will provide an upwards or downwards force on the foot levelling block 267. Rotation in one direction will provide a downward force which will cause the levelling block 267 to push down on the top surface 264 of the foot 260 which will coerce the foot to slide downwards and extend out of the leg support. The rail clips 269*a*, 269*b* prevent the twisting and therefore it coerces into linear movement upon rotation of the adjuster screw 260. As the foot extends out of the leg support, the foot will move laterally as shown by arrow to the right. In doing so, the rails 270 or channels in the top edge 264 of the foot 260 will slide relative to the clips in the levelly block nut, allowing for relative lateral movement between the levelling block 267 and the foot 260 as the foot extends. It will do this to a maximum extent as determined by the bearing 532*a* within the extended slot 262. The clips 269*a*, 269*b* keep the foot level abutted against the levelling block 267 to prevent the foot level slipping out of the leg support to an undesired degree.

Similarly by rotating the adjuster screw 268 in the opposite direction the levelling block 267 will retract upwards towards the top of the leg support. The clips 269*a*, 269*b* hold the levelling block 538 to prevent it twisting and therefore coerce it into linear movement upon rotation of the adjuster screw 268. As the levelling block retracts upwards the clips will retain the foot 260 in abutment with the levelling block and in doing so retract the foot 260 into the leg support. As the foot extends out of the leg support, the foot will move laterally as shown by arrow to the left. In doing so, the rails or channels in the top edge of the foot will slide relative to the clips to the left in the levelly block nut, allowing for relative lateral movement between the levelling block nut and the foot as the foot extends. The foot will be retracted to a maximum extent as determined by the bearing 532*a* that extends through the elongated aperture 262.

The leg support plate comprises an aperture 271 that allows access to the coupling on the end of the adjuster screw 268 to allow rotation of the adjuster screw as required. Rotation can take place by a manual tool such as a screwdriver or other winding implement, or preferably by an electric drill or electric screwdriver with an appropriate coupling or bit corresponding to that in the adjuster screw. This enables the foot levelling means to be adjusted with an electronic tool. Alternatively a manual wind handle might be provided, or alternatively an electric motor which can automatically adjust the foot 260 upon actuation of the motor to the desired degree.

Seventh Embodiment

Figure 35:
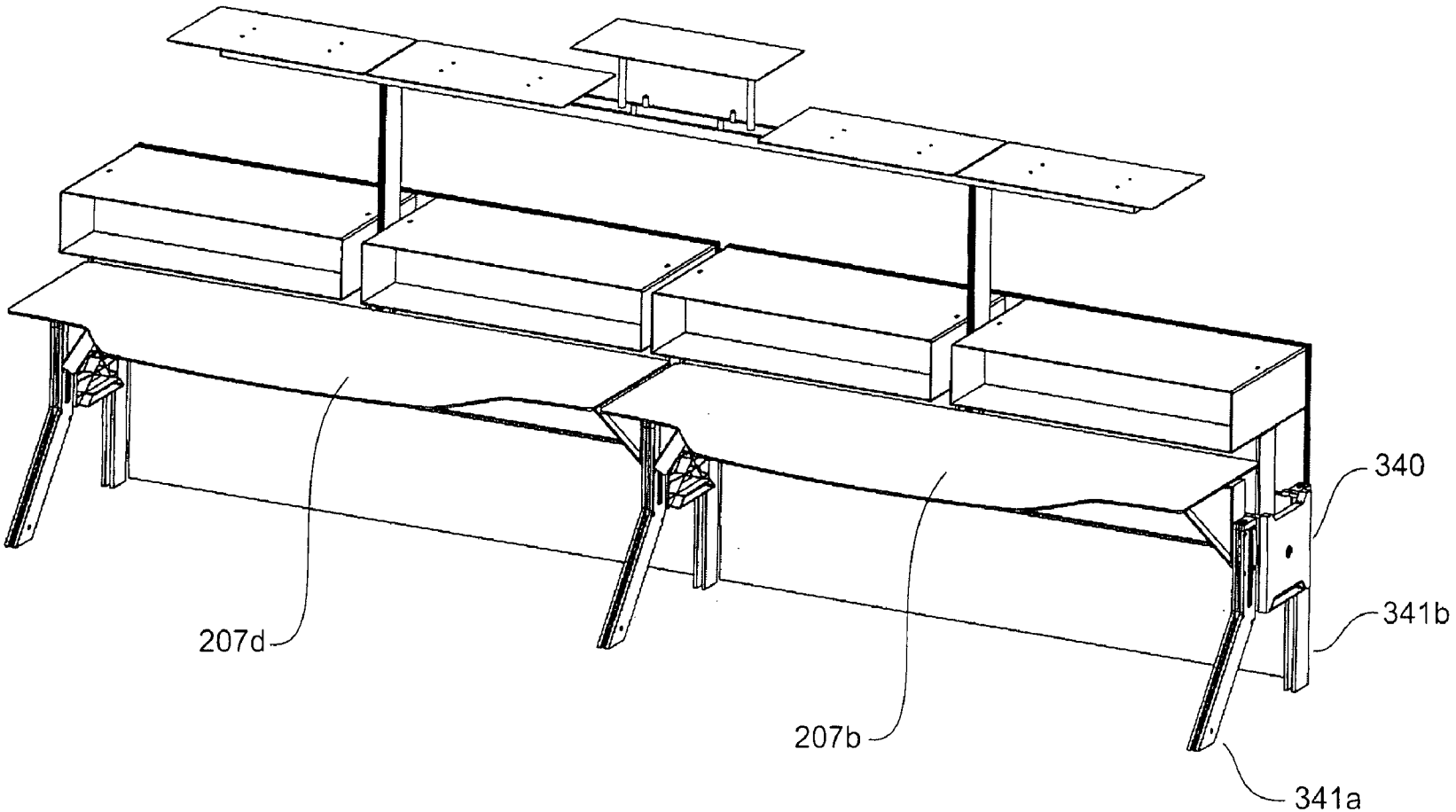
FIG. 35 shows a perspective view of a sixth embodiment of an assembled workstation system.

FIG. 35 shows a seventh embodiment of the invention. This is similar to the sixth embodiment, except that the workstation system is adapted to only have adjacent workstations e.g. 207*d*, 207*b* without opposing workstations. This makes the workstation system suitable for placement adjacent a wall. As noted earlier in respect of other embodiments, the workstation is not necessarily limited to just having two adjacent workstations with corresponding desktops. Rather, there could be one or more than two adjacent workstations.

As can be seen in FIG. 35, the leg support 340 is slightly different to that in relation to the sixth embodiment, wherein one of the legs is straight 341*b*, with the other 341*a* having an angled bend. The leg support could be assembled in a manner similar to FIG. 5*e*, or similar in nature to the legs shown in FIGS. 31 to 33, but adapted in a manner shown, for example, in FIG. 5*e*, to provide the straight upright leg portion. As can be seen, the cabinets are wider in the seventh embodiment as there are no interactive worktops for collaborative work with opposing workstations. However, in this embodiment the modular accessory upright supports and vertical supports are arranged in a similar manner as described in FIG. 24.

Eighth Embodiment

An eighth embodiment of the invention will be described with reference to FIGS. 36 to 38. This embodiment is similar to that of the second embodiment described in relation to FIGS. 11-15. That is, it comprises a three way desktop workstation system. However, it differs in several respects similar to that described in relation to the sixth embodiment. Only the differences will be described here.

In particular, the eighth embodiment comprises a leg assembly the same as that described in relation to FIGS. 31-33. Further, it comprises a vertical support and upright supports for modular cabinets 371*a*, 371*b* the same as described in relation to the sixth embodiment in FIGS. 22-28. By way of example, a single lower terrace modular accessory 371*c* is also shown. It also comprises three additional upright supports 370*a*-370*c* (see FIG. 37) disposed around the central meeting point of the three support beams. These upright supports 370*a*-370*c* support a polygon shaped panel 372, which forms a central terrace at the height of the modular accessory lower terraces 371*a*-371*c*. Further, it comprises cabinets or other modular accessories, for example as described in FIGS. 26-28. The upright supports are attached to a support beam in the same manner, although on support beams which are arranged at angle separations of 120 degrees.

Figure 36:
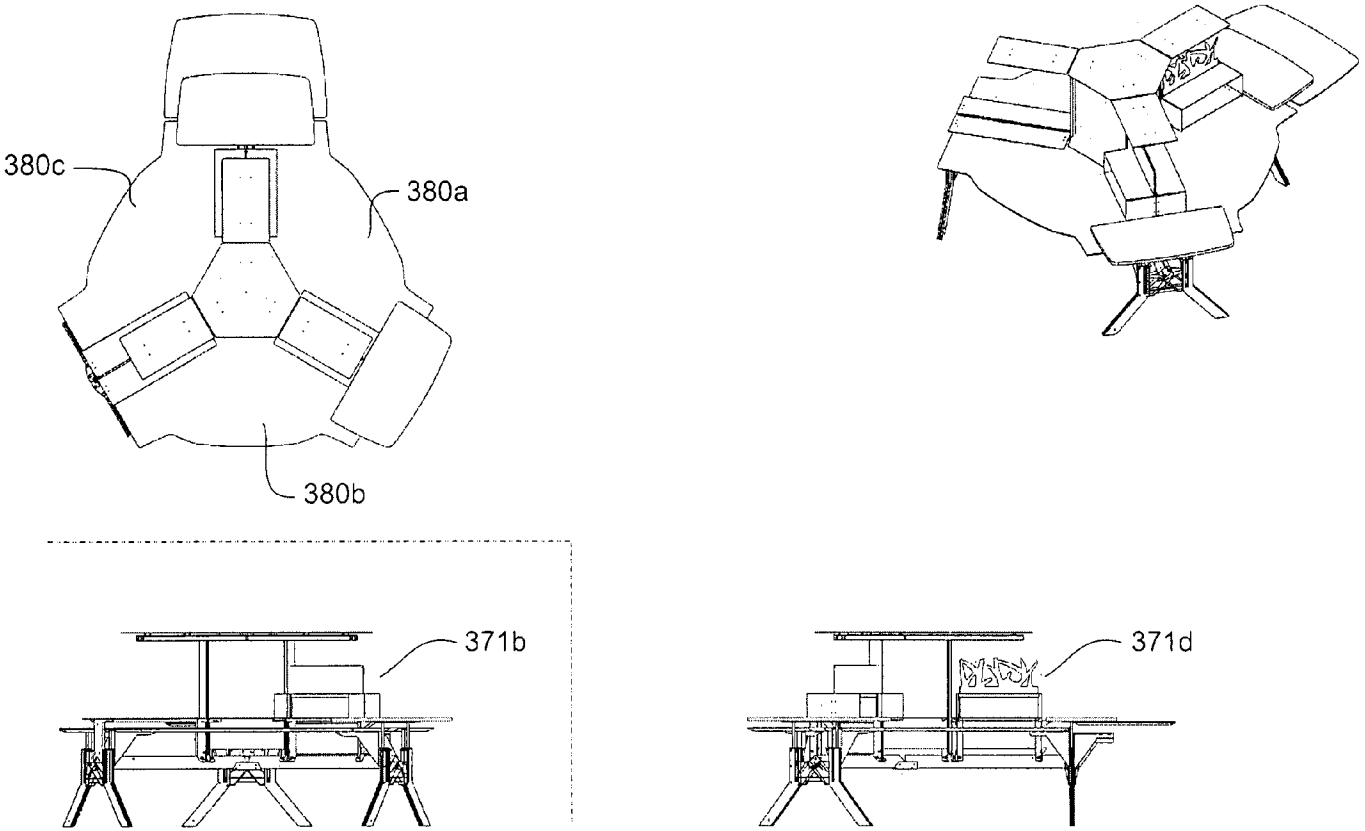
FIG. 36 shows perspective, plan and elevation views of an eight embodiment of an assembled workstation system.
Figure 37:
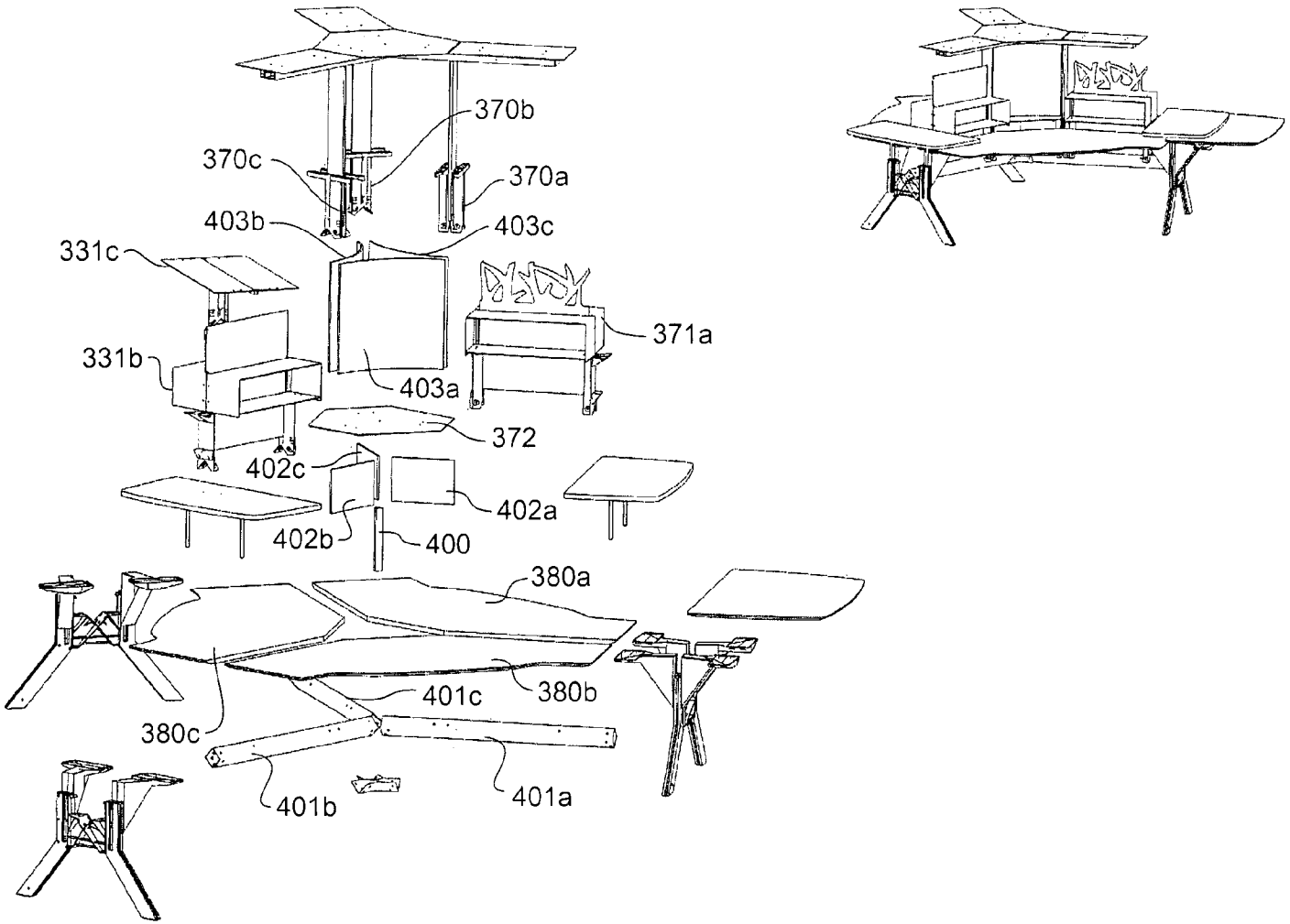
FIG. 37 shows an exploded and assembled perspective view of the workstation system according to the eighth embodiment.

The support structure of this embodiment might include a central post at the apex of the three support beams, although this is not shown in FIGS. 36 and 37 and this is not essential. This extends to the ground to act as an auxiliary leg support.

The eighth embodiment might further comprise a central post 400 extending upwards from the apex of the three support beams 401*a*-401*c* and one or more modesty panels 402*a*-402*c* which extend between the upward extending support post 400 and a corresponding upright support of a corresponding modular accessory. The modesty panel 402*a*-402*c* for each support beam will extend from the support beam up to the level of the hexagonal base 372 which sits at the bottom of the screens 403*a*-403*c*. These are the central screens described previously. Further, the modular cabinets can have screens, as described previously in relation to the sixth embodiment including divider portions that slide between the modular cabinets.

Figure 38:
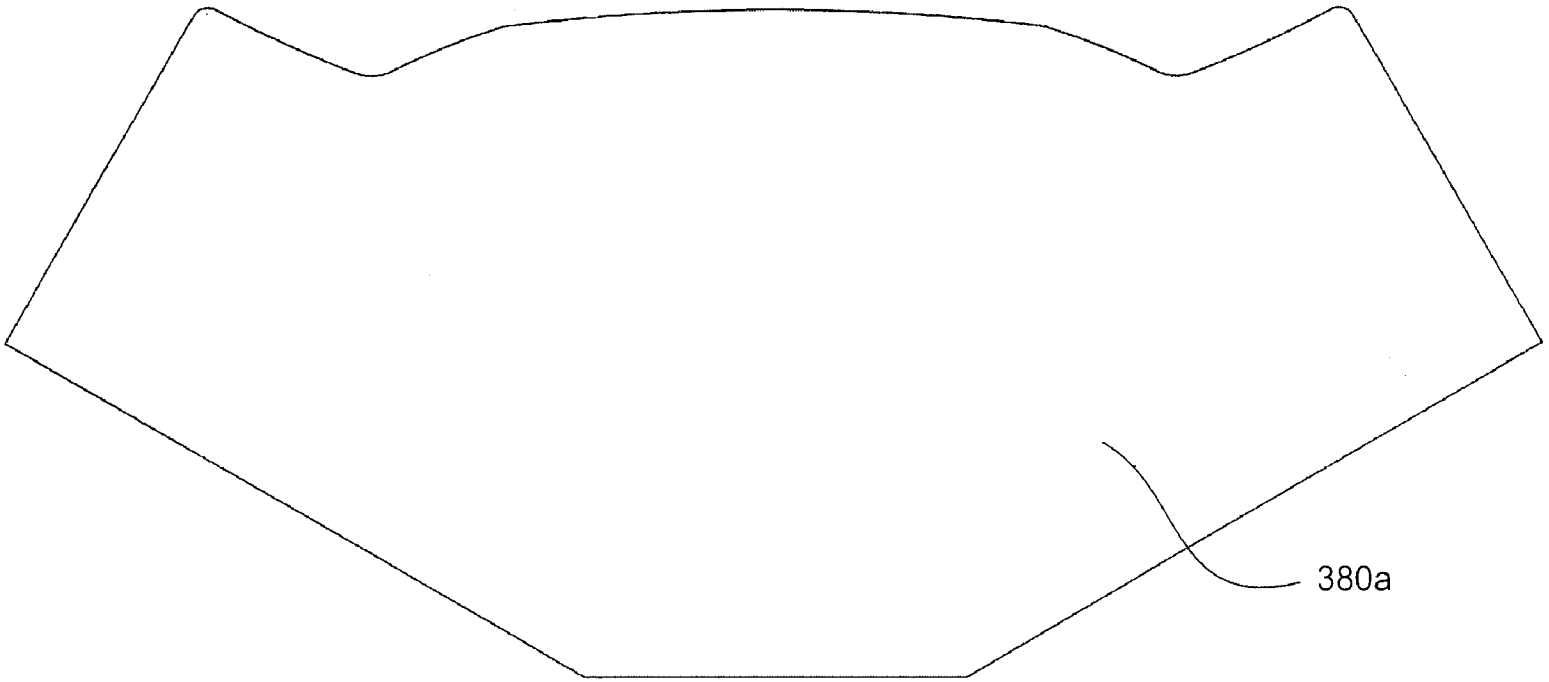
FIG. 38 shows a further embodiment of a desktop.

Further, the shape of the desktop 380*a* of this embodiment might differ, as shown in FIG. 38. Note, the dimensions shown in this figure are exemplary only, and should not be considered limiting. The desktop from the second embodiment could be used instead. Likewise, the desktop 380*a* shown in FIG. 38 could be used in other embodiments, where appropriate.

Ninth Embodiment

Figure 39:
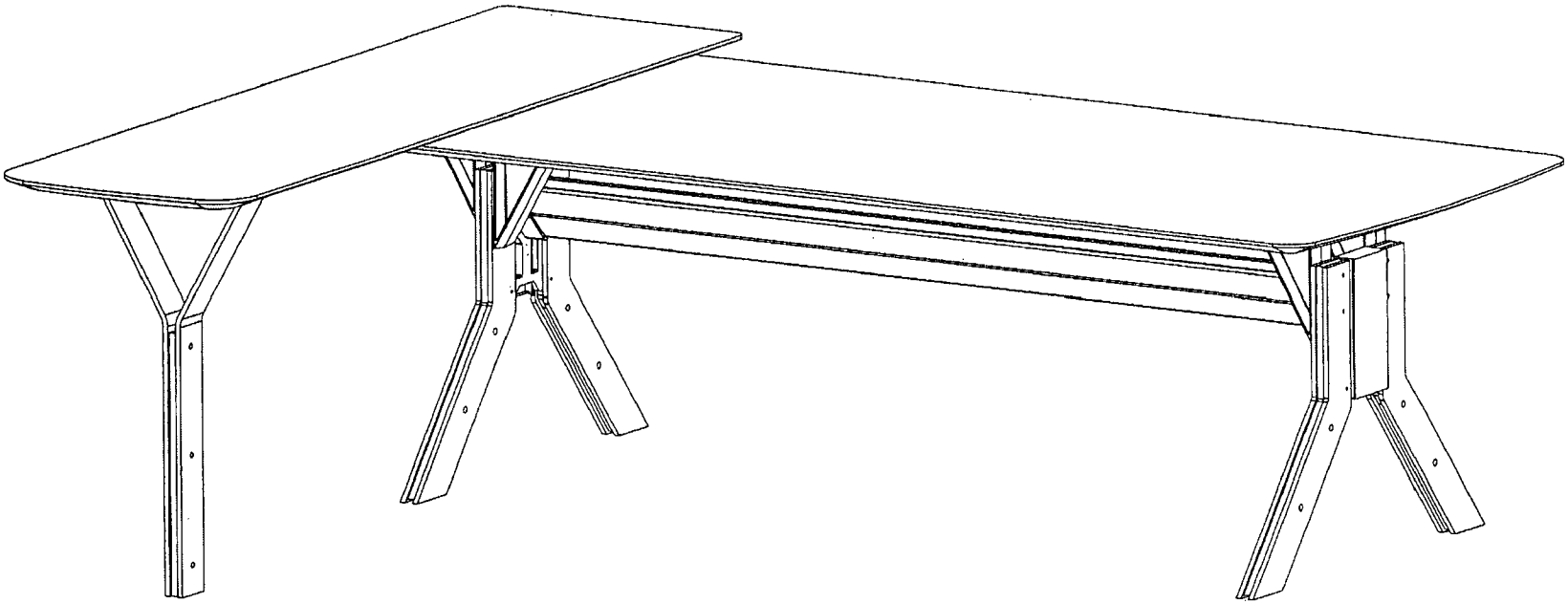
FIG. 39 shows a perspective view of a ninth embodiment of an assembled workstation system.

FIG. 39 shows the ninth embodiment of the invention. This is similar to the embodiment described with reference to FIG. 16, although there are variations in the leg construction and desktop shape and configuration.

Other Embodiments

Figure 41:
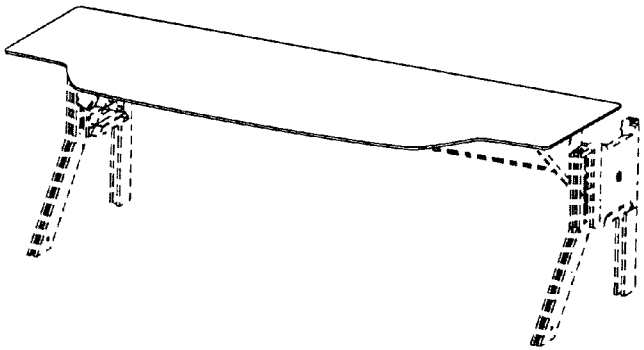
FIGS. 40, 41 show plan, elevation and perspective views of a standalone workstation comprising the desktop shown in FIG. 3*a*.
Figure 40:
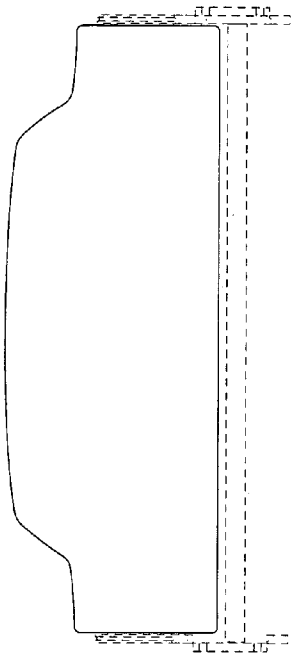
Figure 40:
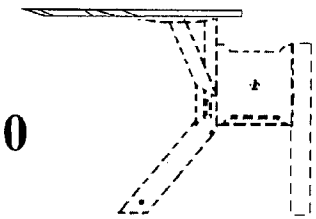
Figure 43:
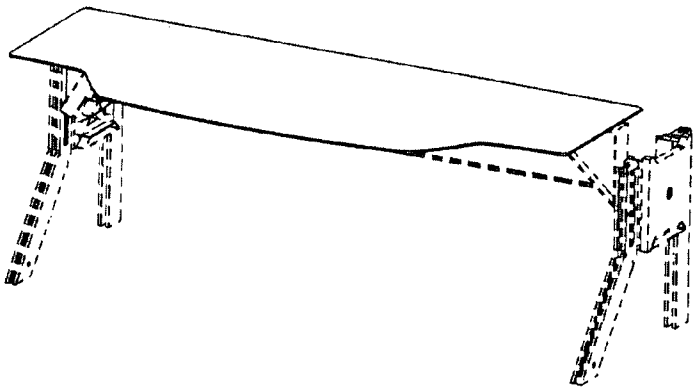
FIGS. 42, 43 shows plan, elevation and perspective views of a standalone workstation comprising the desktop shown in FIG. 3*b*, FIGS. 44, 45 show plan, elevation and perspective views of a standalone workstation comprising the desktop shown in FIG. 3*c*, FIGS. 46-51 show an alternative embodiment of the leg support.
Figure 42:
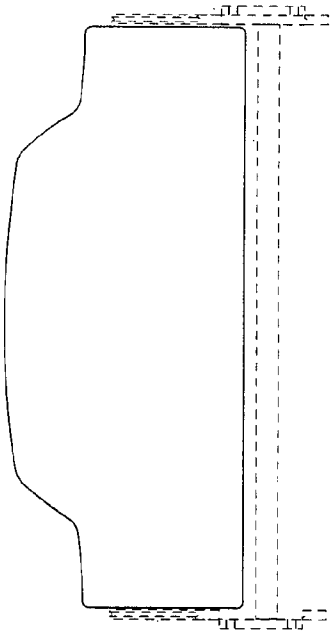
Figure 42:
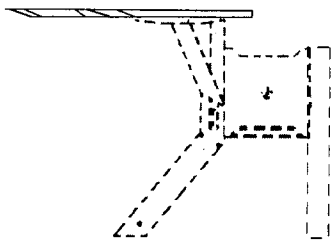
Figure 45:
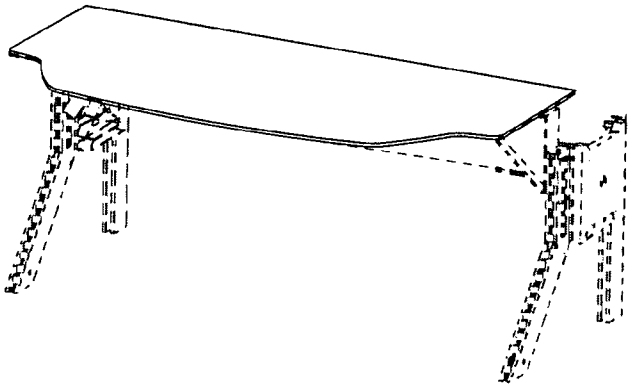
Figure 44:
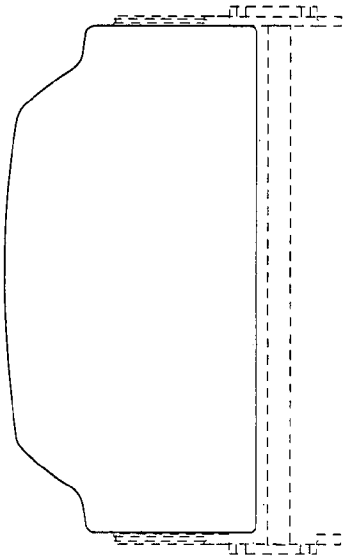
Figure 44:
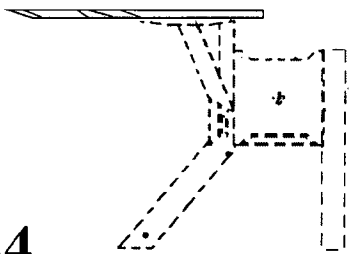

FIGS. 40-45 show a stand alone workstation. FIGS. 40, 41 show a workstation with a desktop of FIG. 3*a*; FIGS. 42 and 43 show a stand alone workstation using the desktop of FIG. 3*b*; and FIGS. 44, 45 show a stand alone workstation with the desktop of FIG. 3*c*.

Figure 47:
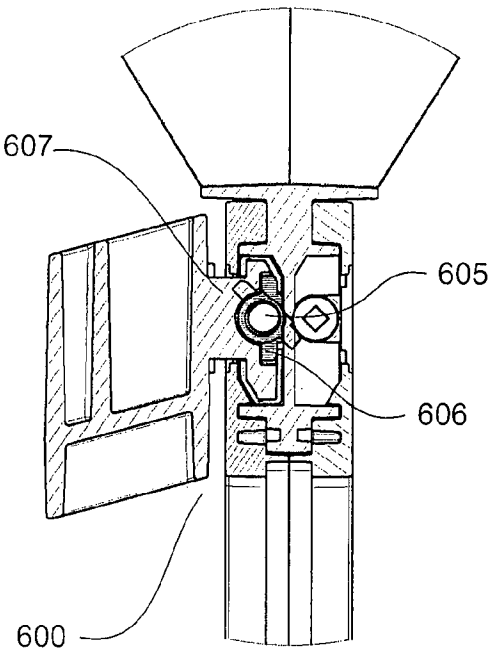

FIGS. 46-51*b* show an alternative leg support and foot embodiment that could be used with any of the embodiments described above. FIG. 47 shows a plan cross-section view of the leg. The leg assembly and foot of this embodiment are similar to that described in relation to FIGS. 31 to 34. The differences will be described here.

The desktop support 600 has a desktop coupling 601 with lateral slots rather than the longitudinal slots in FIG. 33. Further, on the cantilever member 602, a protrusion 603 is created providing a further hole 604 for coupling to the desktop. Two powder coat drain holes 605, 606 are provided in the cantilever member 602. The threaded rod 605 contains a winged coupling nut 606.

Figure 46:
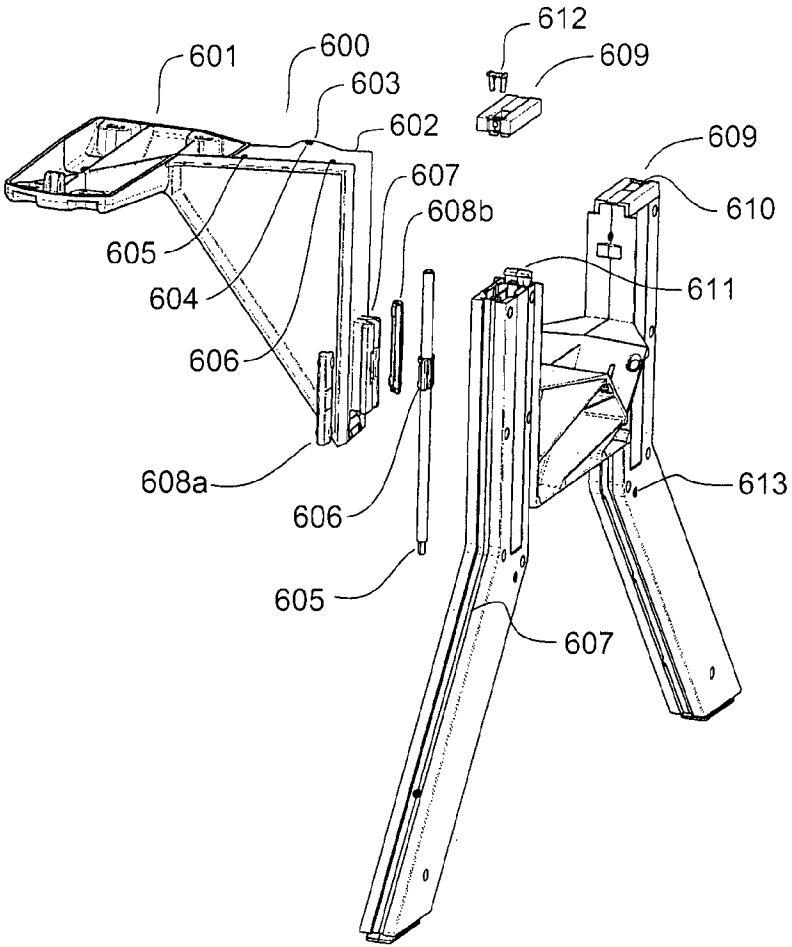
Figure 49:
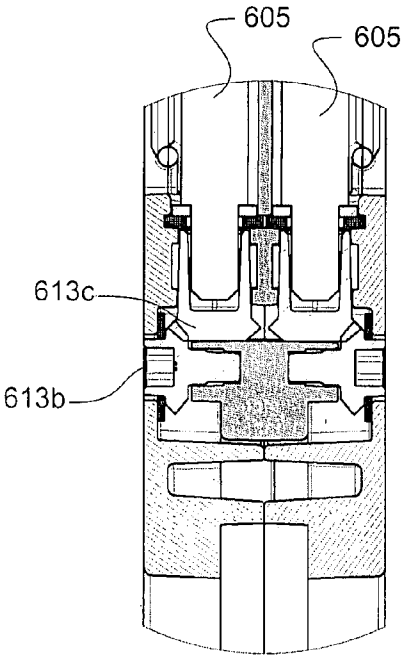
Figure 48:
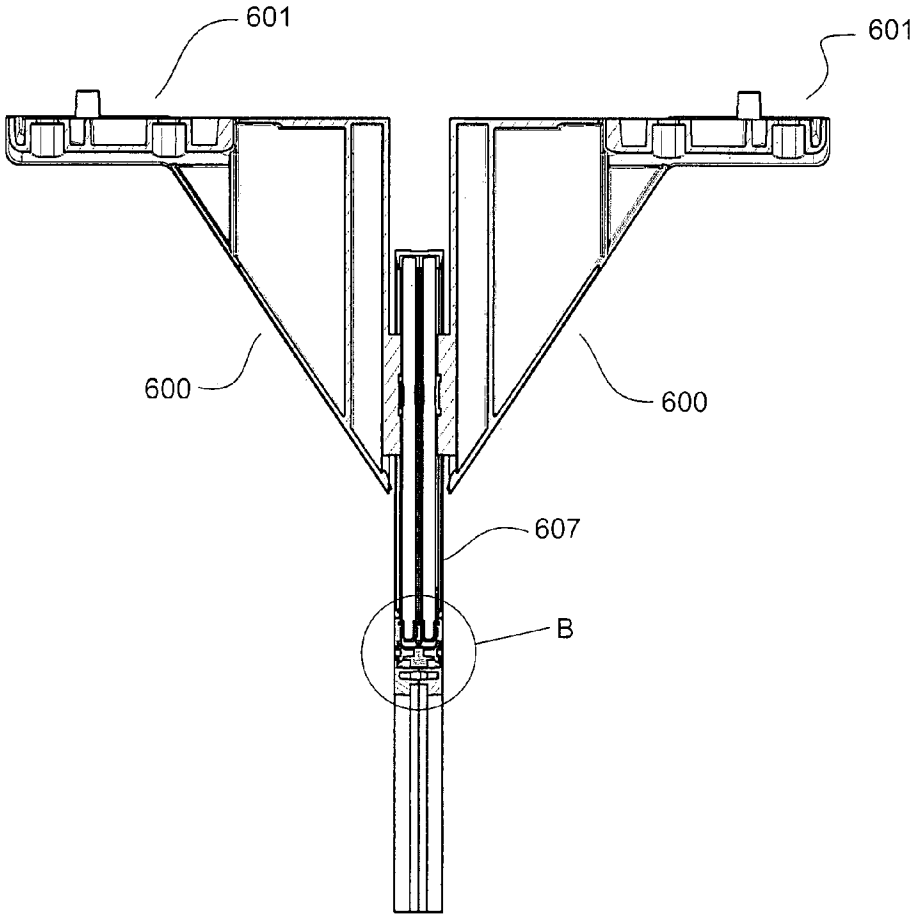

This allows for location and sliding of the nut 606 along rod in the channels 607 of the leg assembly, for example as shown in FIGS. 46 and 47. The winged coupling nut 606 is coupled to the desktop support 600 via a bracket 607. The bracket comprises two plastic shoes 608*a*, 608*b* which can be clipped on to the bracket 607 and around the winged nut 606 to couple the desktop support 600 to the threaded rod 605. The plastic shoes 608*a*, 608*b* have a tolerance that provides a bearing surface for the winged nut 606. The end or top caps 609 have a square aperture 610 for holding in place a worktop with square cross section support members or rods. Each top cap can be retained in place via the clip 611 on the top of the leg member and is also retained in place by a retainer clip 612.

Figure 50:
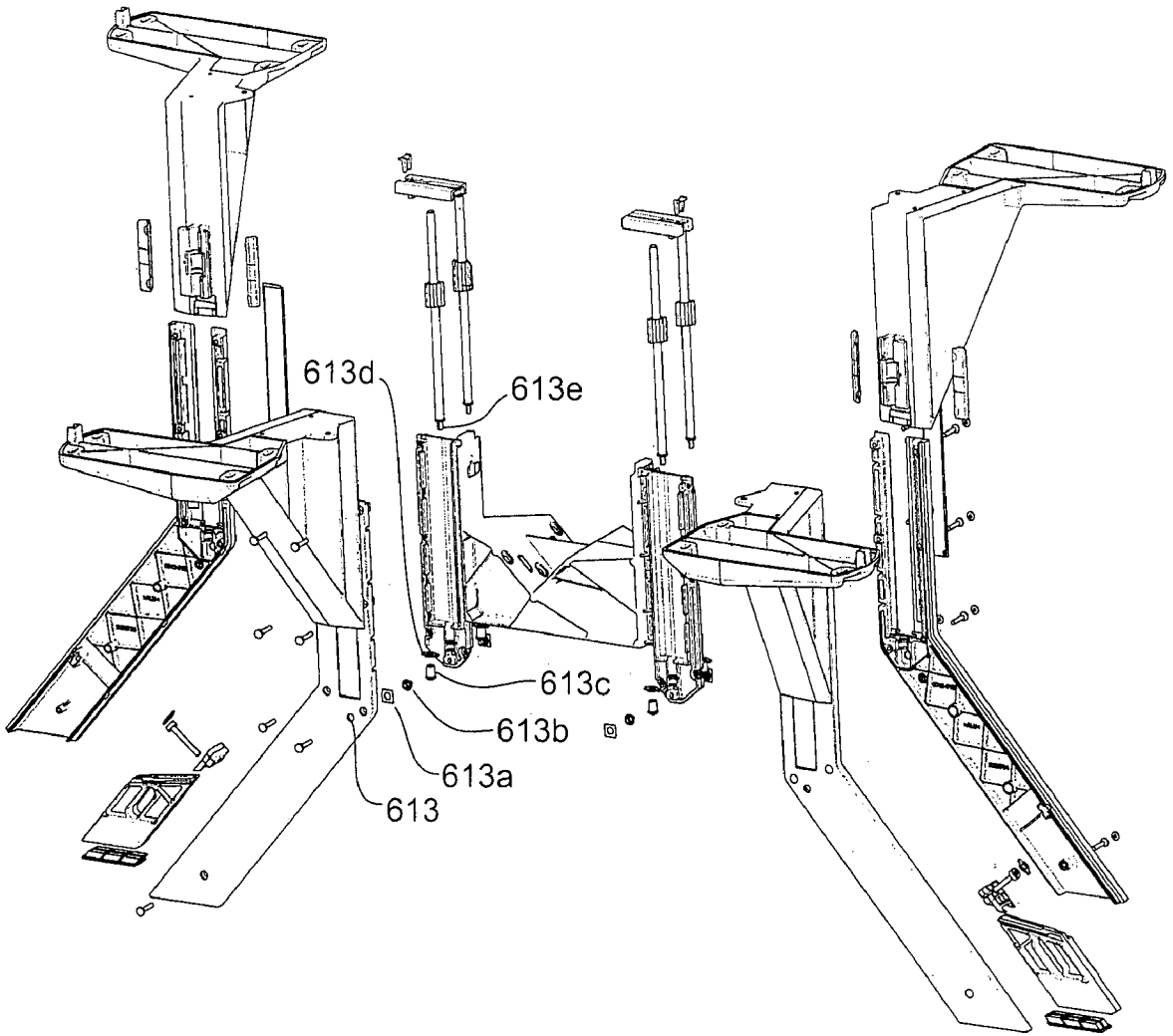

At the angled portion of each leg there is an aperture 613 for allowing adjustment of the winged nut 606 on the threaded rod 605 to alter the height of the desktop support 600. This can be seen more clearly in FIG. 50. Behind the aperture 613 is a square washer 613*a* and a right angled gear arrangement to affect rotation of the threaded rod. This comprises a first gear 613*b* with a hex aperture for receiving a hex headed tool for rotation of the first gear. A second gear 613*c* engages with the first gear 613*b* at right angles and includes an aperture and a washer which can be coupled to the square formed end 612*e* of the threaded rod 605. Once in place, rotation of the first gear 613*b* by a hex headed tool rotates the second gear 613*c* and thus the threaded rod 605, therefore adjusting the position of the winged coupling nut 606 and ultimately the height of the desktop support 600. As shown in FIG. 50, a web is provided in the cross member for supporting or retaining one end of the main rotated beam in place.

Figure 51B:
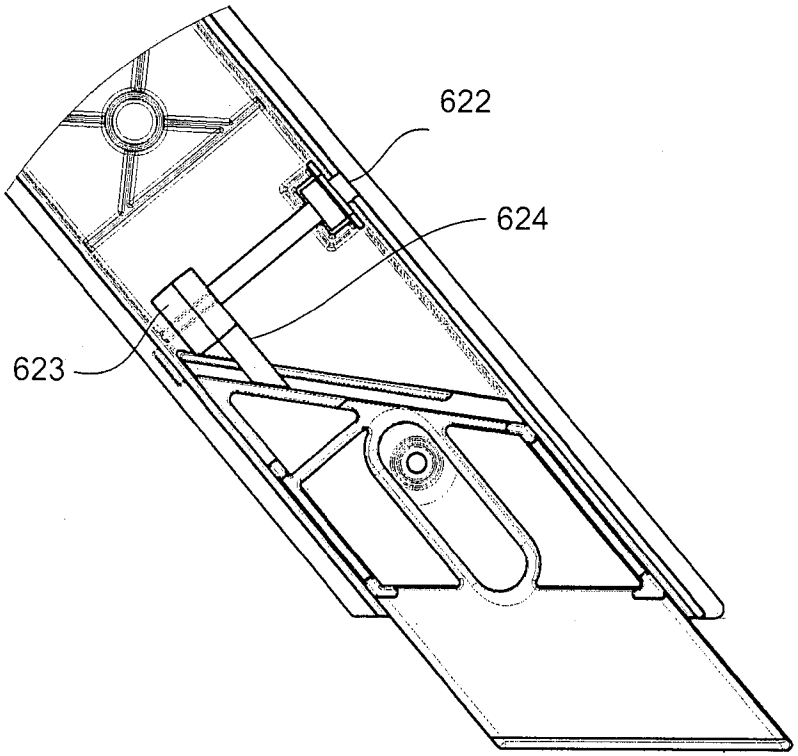
Figure 51A:
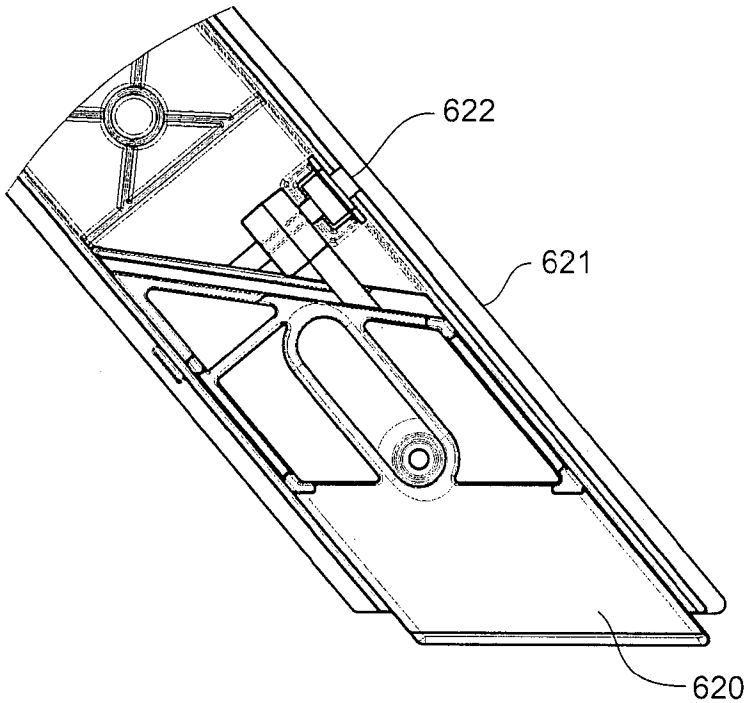

FIGS. 51*a*, 51*b* shows the foot member 620 which can retract into and be coerced out of the leg portion 621. The position of the foot 620 is controlled by an adjustment screw 622 that extends at right angles to the edge of the leg portion. The adjustment screw 622 comprises a levelling block nut 623 that is threaded onto the screw 622. The levelling block nut 623 comprises an elongate member 624 with a angled end that slidingly engages with the top end of the foot 620. Rotation of the screw 622 coerces the levelling block nut from a foot retraction position (shown on the left hand side in FIG. 51*a*) to a foot extension position (shown on the right hand side in FIG. 51*b*). In doing so, the elongate member 624 slides across the top end of the foot 620 thus coercing it downwards and out of the leg portion 621. Rotating the adjustment screw 622 in the other direction coerces the levelling block nut 623 back towards the retracted position allowing the foot 620 to return back to the retracted position.

Figure 52A:
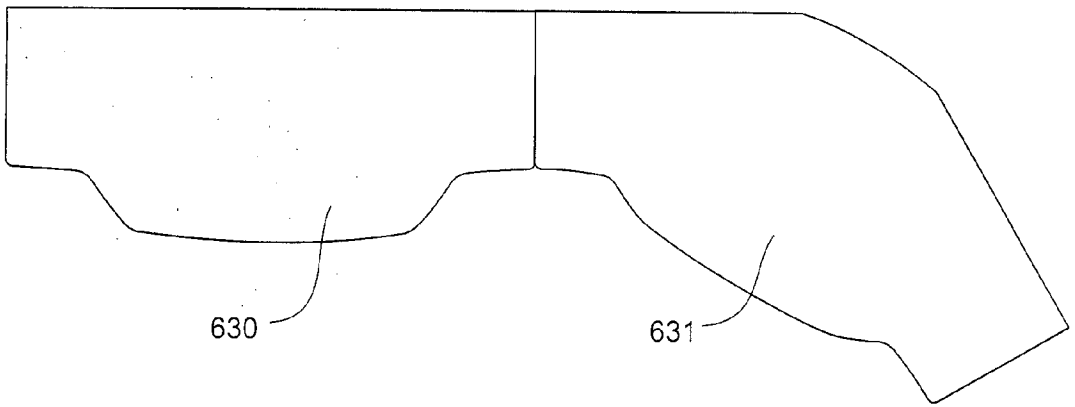
FIGS. 52*a* and 52*b* show various combinations of workstation systems.
Figure 52B:
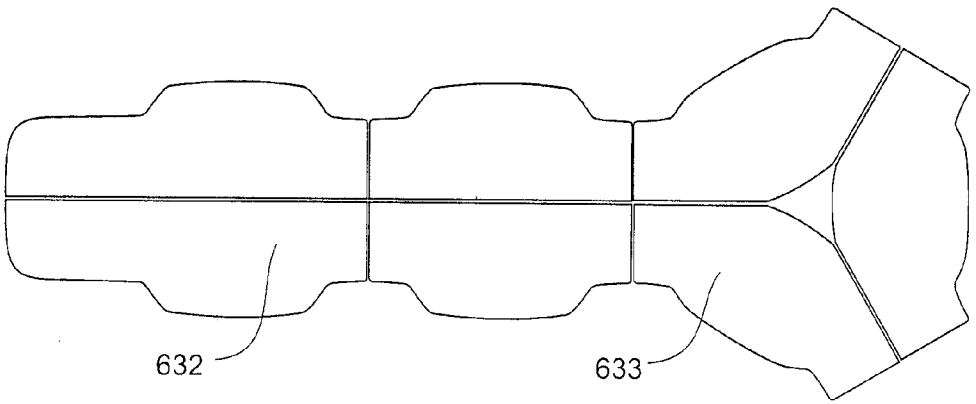

FIG. 52*a* shows how a 180 degree 630 and a 120 degree 631 workstation could be arranged together also. For example, one or more of the desktops shown in FIGS. 3*a* to 3*i* could be arranged side-by-side or back-to-back with any of the desktops shown in 14*a* to 14*c*. Other combinations are possible also, with the various embodiments. Further, as shown in FIG. 52*b* a full complement of four 180 degree desktops 632, such as shown in FIG. 1*a* could be arranged with a full complement of three 120 degree desktops 633, like those shown in FIG. 13, for example. Further a full complement of four 180 degree desktops could be arranged adjacent one or more further workstation systems comprising a full complement of four 180 degree desktops. Similarly, a full complement of three 120 degree desktops could be arranged adjacent one or more further workstation systems comprising a full complement of three 120 degree desktops. Combinations and permutations of the various workstations can be combined as required, as will be appreciated by those skilled in the art. For example, a workstation adapted for use in combination with a corresponding workstation, can be provided where the workstation comprises a desktop with front edge and a back edge, and at least one support adapted to support the desktop at a vertical distance above the ground, wherein the shape of the desktop is profiled along the front edge to comprise a first protruding surface providing a first work surface on the desktop, a first recessed portion adjacent a first lateral side of the protruding surface and a second recessed portions adjacent second lateral side of the protruding surface, wherein the back edge is adapted to be arranged in an opposing relationship with a corresponding back edge of a corresponding workstation such that the protruding surface of the desktop extends in a substantially opposite direction to that of a corresponding workstation and the recess portions of one desktop are at least partially aligned with the opposing corresponding recess portions of a corresponding workstation to provide opposing recess portion pairs that provide an interactive work area adapted to accommodate at least two people in a facing relationship.

The invention might also comprise a kit of components that can be assembled to form one or more of the embodiments described above. The kit could comprise sufficient components to assemble a workstation system with the required number of workstations. Each kit could contain a number of desktops, leg supports, support beams, modular accessories, overhead beams elements, vertical support elements, interactive work tables and screens. The kit could be sold or distributed and then assembled on site in an office or similar, by the purchaser, the selling party or a third party. Individual components could also be sold to supplement a kit where required. Kits could come as standard, with predetermined numbers of components, or alternatively be collated to comprise the required components according to a customer request.

Preferred embodiments (or "forms") of the invention have been described by way of example only and modifications may be made thereto without departing from the scope of the invention.

The invention claimed is:

1. A workstation system comprising:

at least two workstations, each comprising a desktop having a long edge adjacent which a user will be positioned in use of the desktop and a shorter side edge, at least one leg support adapted to support the desktops at a vertical distance above the ground, the leg support comprising:

a leg portion with a foot portion adapted to rest on the ground, and at least two oppositely extending desktop supports each coupled to a respective desktop at or adjacent its shorter side edge, the two coupled desktops being arranged on opposite sides of the respective leg support to each other with their shorter side edges adjacent each other, wherein each desktop support is independently coupled to the leg portion and is independently moveable relative to the leg portion to adjust the vertical distance above the ground of the respective desktop to which it is coupled, each desktop support comprising a body portion with a coupling attached to a desktop and a threaded portion, each threaded portion threadably engaged with a respective threaded rod attached to the leg portion, whereby rotation of the threaded rod moves the body portion and coupling vertically relative to the leg portion.

2. A workstation system according to claim 1 comprising four workstations, each comprising a desktop, and wherein at least one leg support comprises four desktop supports and two leg portions, each desktop support coupled to a respective desktop at or adjacent its shorter side edge and independently coupled and moveable relative to a leg portion of said at least one leg support to adjust the vertical distance above the ground of the desktop to which it is coupled.

3. A workstation system according to claim 2, wherein each of the four desktops comprises a front edge comprising the long edge, a back edge, a first shorter side edge, and a second shorter side edge, the shape of each desktop being profiled along the front edge to comprise a first protruding surface providing a primary work area on the desktop, a first recessed portion adjacent a first lateral side of the protruding surface and having the first shorter side edge, and a second recessed portion adjacent a second lateral side of the protruding surface and having the second shorter side edge, and wherein the first recessed portion of a first one of the desktops is arranged adjacent the second recessed portion of a second one of the desktops to provide an interactive work area adapted to accommodate at least two people in a side-by-side relationship, and wherein the first recessed portion of a third one of the desktops is arranged adjacent the second recessed portion of a fourth one of the desktops to provide an interactive work area adapted to accommodate at least two people in a side-by-side relationship, and wherein the back edges of the first and second desktops are arranged in an opposing relationship with the back edges of the third and fourth desktops such that the protruding surfaces of the first and second desktops extend in a substantially opposite direction from the protruding surfaces of the third and fourth desktops, and such that the recessed portions of the third and fourth desktops are at least partially aligned with the opposing recessed portions of the first and second desktops to provide opposing recessed portion pairs, and wherein each recessed portion pair provides an interactive work area adapted to accommodate at least two people in a facing relationship, and wherein the or each leg support is disposed such that each of the four desktops is supported by the leg supports at or adjacent the shorter side edges to provide free space under the primary work area and the recessed portions to accommodate a user's legs under the primary work area and the recessed portions without impediment from the leg support(s), and to enable a user to readily move between the recessed portions with their legs under the desktop without impediment from the leg support(s).

4. A workstation system according to claim 3, wherein the opposing recessed portion pairs provide substantially open interactive work areas in which users of the workstations can freely interact in a face-to-face relationship.

5. A workstation system according to claim 3, comprising a plurality of said leg supports.

6. A workstation system according to claim 1, wherein each threaded rod is housed within the leg portion, and the body portion of each desktop support is located substantially external to the leg portion, with the threaded portion of each desktop support coupled to the body portion of the desktop support through a respective slot in a side of the leg portion.

7. A workstation system according to claim 1, wherein the two coupled desktops each comprise a front edge comprising the long edge, a back edge, and first and second shorter side edges, wherein the shape of the desktop is profiled along the front edge to comprise a first protruding surface providing a primary work area on the desktop, a first recessed portion adjacent a first lateral side of the protruding surface and having the first shorter side edge, and a second recessed portion adjacent a second lateral side of the protruding surface and having the second shorter side edge, wherein the first recessed portion of one desktop is arranged adjacent the second recessed portion of the other desktop to provide an interactive work area adapted to accommodate at least two people in a side-by-side relationship, and wherein the or each leg support is disposed such that each of the two desktops is supported by the leg support(s) at or adjacent the shorter sides edges to provide free space under the primary work area and the recessed portions to accommodate a user's legs under the primary work area and the recessed portions without impediment from the leg support(s), and to enable a user to readily move between the recessed portions with their legs under the desktop without impediment from the leg support(s).

8. A workstation system according to claim 7, further comprising a work top supported above the two desktops in the vicinity of the first recessed portion of said one desktop and the second recessed portion of said other desktop and extending over at least a major part of the interactive work area of the two desktops to provide an interactive work surface.

9. A workstation system according to claim 7, wherein the protruding surface of each of the two desktops is profiled as a convex edge forming a section of the front edge of the desktop.

10. A workstation system according to claim 7, wherein each recessed portion is profiled as a concave edge forming a section of the front edge of each of the two desktops.

11. A workstation system according to claim 7, wherein the back edge of each of the two desktops comprises two substantially straight sections arranged at an angle of substantially 120 degrees with respect to each other.

12. A workstation system according to claim 11, further comprising a third desktop supported by the leg supports(s), the third desktop having a front edge comprising a long edge, a back edge, a first shorter side edge, and a second shorter side edge, the shape of the third desktop being profiled along the front edge to comprise a first protruding surface providing a primary work area on the third desktop, a first recessed portion adjacent a first lateral side of the protruding surface and having the first shorter side edge, and a second recessed portion adjacent a second lateral side of the protruding surface and having the second shorter side edge, and wherein the back edge of the third desktop comprises at least a first section and a second section that extend at an angle of substantially 120 degrees with respect to each other, wherein a part of the back edge of the third desktop is arranged in opposing relationship with a part of the back edge of one of the two desktops such one of the recessed portions of the third desktop is at least partially aligned with one of the opposed recessed portions of said one of the two desktops to provide an opposing recessed portion pair, wherein the opposing recessed portion pair provides an interactive work area adapted to accommodate at least two people in a facing relationship, and wherein the or each leg support is disposed such that the third desktop is supported by leg support(s) at or adjacent the shorter side edges to provide free space under the primary work area and the recessed portions of the third desktop to accommodate a user's legs under the primary work area and the recessed portions of the third desktop without impediment from the leg support(s), and to enable a user to readily move between the primary work area and the recessed portions of the third desktop with their legs under the desktop without impediment from the leg support(s).

13. A workstation system according to claim 12, wherein the opposing recessed portion pair provides a substantially open interactive work area in which users of the workstations can freely interact in a face-to-face relationship.

14. A workstation system according to claim 7, wherein the back edge of each of the two desktops is substantially straight.

15. A leg support adapted for use in a workstation system comprising at least two workstations with respective desktops having a long edge adjacent which a user will be positioned in use and a shorter side edge, the leg support adapted to at least partially support at least two desktops and comprising:

a generally forwardly extending leg portion with a foot portion adapted to rest on the ground, and two desktop supports, each desktop support extending from opposite sides of the leg portion and transversely to the leg portion and adapted to be coupled to a respective desktop at or adjacent its shorter side edge, wherein each desktop support is independently coupled to the leg portion and is independently moveable relative to the leg portion to adjust the vertical distance above the ground of the desktop support, each desktop support comprises a body portion with a coupling for attachment to a desktop and a threaded portion, each threaded portion threadably engaged with a respective threaded rod attached to the leg portion, whereby rotation of the threaded rod moves the body portion and coupling vertically relative to the leg portion.

16. A leg support according to claim 15 for use in a workstation system comprising at least four workstations with respective desktops, wherein the leg support is adapted to at least partially support four desktops each having a long edge adjacent which a user will be positioned in use and a shorter side edge, and the leg support further comprises:

a generally rearwardly extending leg portion with a foot portion adapted to rest on the ground, and two further desktop supports, each further desktop support extending from opposite sides of the generally rearwardly extending leg portion and transversely to the generally rearwardly extending leg portion and adapted to be coupled to a respective desktop at or adjacent its shorter side edge, wherein each of the further desktop supports is independently coupled to the generally rearwardly extending leg portion and is independently moveable relative to the generally rearwardly extending leg portion to adjust the vertical distance above the ground of a respective desktop to which it is coupled, each further desktop support comprises a body portion with a coupling for attachment to a desktop and a threaded portion, each threaded portion threadably engaged with a respective threaded rod attached to the generally rearwardly extending leg portion, whereby rotation of the threaded rod moves the body portion and coupling vertically relative to the generally rearwardly extending leg portion.

17. A leg support according to claim 15 wherein the leg portion comprises an adjustment screw threadably engaged in a threaded portion coupled to the leg, and the leg support further comprises:

a foot portion adapted to rest on the ground, the foot portion slidingly engaged with the leg portion and comprising an upper end adapted to abut a first end of the adjustment screw or a block coupled to the adjustment screw, a spring attached to the leg portion and foot portion to bias the upper end of the foot portion into abutment with the first end of the adjustment screw or a block coupled to the adjustment screw, and at least one desktop support attached or coupled to the leg support, the desktop support adapted to be coupled to a respective desktop, wherein rotation of the adjustment screw in a first direction moves the screw through the threaded portion to slide the foot portion relative to the leg portion against the bias of the spring, and wherein rotation of the adjustment screw in a second direction moves the screw through the threaded portion allowing the foot portion to slide relative to the leg portion under bias of the spring.

18. A leg support according to claim 15 wherein the foot portion is an extendable and retractable foot that can be extended from and retracted into the leg portion to provide a leveling adjustment.

19. A leg support according to claim 18 wherein the foot portion comprises an adjustment screw one end of which is engaged in a block slideably engaged with a top surface of a foot via a coupling, wherein rotation of the adjustment screw causes longitudinal movement of the block to retract or extend the foot and wherein the foot slides laterally with respect to the coupling during retraction or extension.

20. A leg support according to claim 15, wherein each threaded rod is housed within the leg portion, and the body portion of each desktop support is located substantially external to the leg portion, with the threaded portion of each desktop support positioned in the leg portion and coupled to the body portion of the desktop support through a respective slot in a side of the leg portion.

* * * * *

UNITED STATES PATENT AND TRADEMARK OFFICE

CERTIFICATE OF CORRECTION

PATENT NO. : 8,402,900 B2
APPLICATION NO. : 12/444372
DATED : March 26, 2013
INVENTOR(S) : Burak et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 765 days.

Signed and Sealed this
First Day of September, 2015

Michelle K. Lee

Michelle K. Lee
*Director of the United States Patent and Trademark Office*